US007862973B2

(12) United States Patent
Nakayama et al.

(10) Patent No.: US 7,862,973 B2
(45) Date of Patent: Jan. 4, 2011

(54) TONER AND DEVELOPER, AND IMAGE FORMING APPARATUS, IMAGE FORMING METHOD AND PROCESS CARTRIDGE

(75) Inventors: Shinya Nakayama, Numazu (JP); Akihiro Kotsugai, Numazu (JP); Yasuaki Iwamoto, Numazu (JP); Yasutada Shitara, Numazu (JP); Yohichiroh Watanabe, Fuji (JP)

(73) Assignee: Ricoh Company, Ltd., Tokyo (JP)

( * ) Notice: Subject to any disclaimer, the term of this patent is extended or adjusted under 35 U.S.C. 154(b) by 454 days.

(21) Appl. No.: 11/943,972

(22) Filed: Nov. 21, 2007

(65) Prior Publication Data

US 2008/0118855 A1 May 22, 2008

(30) Foreign Application Priority Data

Nov. 22, 2006 (JP) ..... 2006-315674
Nov. 22, 2006 (JP) ..... 2006-316353

(51) Int. Cl.
*G03G 9/00* (2006.01)

(52) U.S. Cl. ..... 430/109.4

(58) Field of Classification Search ..... 430/109.4
See application file for complete search history.

(56) References Cited

U.S. PATENT DOCUMENTS 6,344,302 B1 2/2002 Kurose et al.
6,946,229 B2 9/2005 Suzuki et al.
7,166,403 B2 1/2007 Ichikawa et al.
7,172,844 B2 2/2007 Umemura et al.
7,198,874 B2 4/2007 Saito et al.
7,261,989 B2 8/2007 Sugiura et al.
7,318,989 B2 1/2008 Kotsugai et al.

(Continued)

FOREIGN PATENT DOCUMENTS

EP 0 716 351 A2 6/1996

(Continued)

OTHER PUBLICATIONS

U.S. Appl. No. 12/297,952, filed Oct. 21, 2008, Iwatmoto et al.

(Continued)

*Primary Examiner*—Mark A Chapman
(74) *Attorney, Agent, or Firm*—Oblon, Spivak, McClelland, Maier & Neustadt, L.L.P.

(57) ABSTRACT

Provided is a toner that comprises a binder resin, a releasing agent, and a colorant, wherein the mass average particle diameter of the toner is 3 μm to 8 μm, the content of particles having a particle diameter of no more than 5 μm is from 60% by number to 90% by number, the binder resin comprises a polyester resin (A) having a softening temperature Tm(A) from no lower than 120° C. to no higher than 160° C. and a polyester resin (B) having a softening temperature Tm(B) from no lower than 80° C. to lower than 120° C., and at least one of the polyester resins (A) and (B) is prepared by condensation polymerization between an alcohol component and a carboxylic acid component, and the alcohol component comprises divalent alcohol of 1,2-propanediol in a content of no less than 65% by mole and consists substantially of aliphatic alcohol; and also provided is a developer that comprises the toner and a carrier.

22 Claims, 14 Drawing Sheets

U.S. PATENT DOCUMENTS

| | | | | |
|---|---|---|---|---|
| 2002/0098434 | A1 | 7/2002 | Anno et al. | |
| 2003/0108808 | A1 | 6/2003 | Inoue et al. | |
| 2005/0079433 | A1 | 4/2005 | Watanabe et al. | |
| 2005/0089786 | A1 | 4/2005 | Sugiura et al. | |
| 2005/0089787 | A1 | 4/2005 | Uchinokura et al. | |
| 2005/0277046 | A1 | 12/2005 | Sawada et al. | |
| 2006/0068312 | A1 | 3/2006 | Yamashita et al. | |
| 2006/0160011 | A1 | 7/2006 | Inoue et al. | |
| 2006/0165989 | A1 | 7/2006 | Takikawa et al. | |
| 2006/0172215 | A1 | 8/2006 | Kotsugai et al. | |
| 2006/0204883 | A1* | 9/2006 | Nakayama et al. | 430/111.4 |
| 2006/0240348 | A1 | 10/2006 | Tamura | |
| 2006/0240349 | A1 | 10/2006 | Watanabe et al. | |
| 2007/0031752 | A1 | 2/2007 | Watanabe et al. | |
| 2007/0248380 | A1 | 10/2007 | Iwamoto et al. | |
| 2007/0281236 | A1 | 12/2007 | Watanabe et al. | |
| 2007/0281237 | A1 | 12/2007 | Iwamoto et al. | |

FOREIGN PATENT DOCUMENTS

| | | |
|---|---|---|
| JP | 59-133573 | 7/1984 |
| JP | 59-157661 | 9/1984 |
| JP | 60-41079 | 3/1985 |
| JP | 63-313182 | 12/1988 |
| JP | 1-263679 | 10/1989 |
| JP | 5-341617 | 12/1993 |
| JP | 6-82227 | 10/1994 |
| JP | 7-60273 | 6/1995 |
| JP | 8-22206 | 1/1996 |
| JP | 2002-169331 | 6/2002 |
| JP | 2002-244335 | 8/2002 |
| JP | 2002-287427 | 10/2002 |
| JP | 2003-15341 | 1/2003 |
| JP | 2004-280084 | 10/2004 |
| JP | 2005-242007 | 9/2005 |
| JP | 2005-316262 | 11/2005 |
| JP | 2007-292792 | 11/2007 |

OTHER PUBLICATIONS

U.S. Appl. No. 12/253,558, filed Oct. 17, 2008, Nakayama et al.
U.S. Appl. No. 12/142,311, filed Jun. 19, 2008, Nakayama et al.
U.S. Appl. No. 12/112,601, filed Apr. 30, 2008, Sabu et al.
U.S. Appl. No. 12/118,006, filed May 9, 2008, Nakayama et al.

* cited by examiner

TONER AND DEVELOPER, AND IMAGE FORMING APPARATUS, IMAGE FORMING METHOD AND PROCESS CARTRIDGE

BACKGROUND OF THE INVENTION

1. Field of the Invention

The present invention relates to toners, image forming apparatuses, image forming methods, and process cartridges that are suited to electrophotographic image formation such as of copiers, electrostatic printing, printers, facsimiles, and electrostatic recording.

2. Description of the Related Art

Electrophotographic images have been heretofore formed in a wide variety of manners; typically, a surface of a latent electrostatic image bearing member (hereinafter, sometimes referred to as "photoconductor", "electrophotographic photoconductor", or "image bearing member") is charged, then the charged surface of photoconductors is exposed to form an electrostatic latent image. Then the electrostatic latent image is developed by use of a toner, thereby to form a visible image on the photoconductor. The visible image is then is transferred directly or through an intermediate transferring member to a recording medium, then the transferred image is fixed by means of heat and/or pressure, thereby a recorded matter on which images being formed is produced. Residual toner on the photoconductor, after the transferring of images, is cleaned by conventional means such as blades, brushes, and rollers. The toner, which having been cleaned, may also be transported to a developing unit and used again. The cleaning can also be carried out without cleaning units when the developing unit has a developer carrier that contacts with the surface of the photoconductor, develops electrostatic latent images on the photoconductor, and collects residual toners on the photoconductor.

Full-color image-forming apparatuses on the basis of such electrophotographic processes are typically classified into two types. One is single or single-drum type, in which one photoconductor and four developing units for four colors of cyan, magenta, yellow and black are mounted in one image forming apparatus. In such single type, a four-color image is formed on a photoconductor or a recording medium. The single type may share a charging, an exposing, a transferring, and a cleaning units, disposed around the photoconductor, thus making possible to downsize and lower the cost compared to tandem type.

Another is tandem or tandem-drum type, in which plural photoconductors are mounted on an image forming apparatus (see Japanese Patent Application Laid-Open (JP-A) No. 05-341617). In general, each one of charging, developing, transferring, and cleaning units are mounted per photoconductor to construct an image forming unit, and plural image forming units, typically four units, are disposed in an image forming apparatus. In the tandem type, visible images are successively transferred on a recording medium through forming one-color visible images by one image forming unit to form full-color images. The tandem type allows high-speed image formation since visible images of respective colors are formed in parallel. That is, the tandem type can shorten the image-processing period by one-fourth compared to the single type, thus leading to four-times high-speed printing. In addition, durability of the members of image forming units like photoconductors may be enhanced indeed. This is due to that four steps of charging, exposing, developing and transferring are carried out to form a full-color image as regards one photoconductor in the single type, whereas only one step of these steps is carried out as regards one photoconductor in the tandem type.

However, the tandem type suffers from larger and expensive systems due to plural image forming units.

For this countermeasure, the diameter of photoconductors is decreased, the respective units around photoconductors are downsized, and the image forming units are small-sized. Consequently, the image forming apparatuses are small-sized and thus material cost is correspondingly reduced, and the total cost can be reduced in a degree. However, the compacted and small-sized image forming apparatuses bring about new requirements for higher performance of the image forming units and significant stabilization thereof.

Recently, image forming apparatuses such as printers, copiers and facsimiles have been commercially demanded for energy conservation and higher speed. In order to achieve these properties, it is essential to improve heat efficiency of fixing units of image forming apparatuses.

In image forming apparatuses, unfixed toner images are typically formed on recording media such as recording sheets, printing papers, photosensitive papers, and electrostatic recording papers in an indirect or direct way by image forming processes such as electrophotographic, electrostatic, and magnetic recording processes. Contact-heating processes such as heat-roller, film-heating, and electromagnetic induction-heating processes are employed generally for fixing the unfixed toner images.

The heat-roller fixing units are typically constructed from a fixing roller, capable of being controlled at a predetermined temperature by use of a heat source such as halogen lump disposed inside thereof, and a pressure roller being urged to press the fixing roller as a pair of rotating rollers. A recording medium is inserted and conveyed between the contacting portion, i.e. so-called nip portion, of the pair of rotating rollers, thereby unfixed toner images are fused and fixed by action of heat and pressure from the pressure roller.

The film-heating-fixing unit is, for example, disclosed in JP-A Nos. 63-313182 and 01-263679. In the film-heating-fixing unit, a heating member, fixed and supported by a support member, is contacted with a recording medium through a heat-resistant thin fixing film, then the fixing film is slid and moved against the heating member, thereby the heat is supplied from the heating member to the recording media through the fixing film.

The heating member is exemplified by a ceramic heater where an electric resistance layer is disposed on a ceramic substrate such as alumina and aluminum nitride having proper heat resistance, insulating property and thermal conductivity. The fixing unit, equipped with such a lower heat-capacity fixing film, may exhibit higher thermal conductivity than the heat-roller fixing units and shorten the warm-up period, and also allow quick-starting and energy-saving.

The fixing unit of the electromagnetic induction-heating processes is exemplified by electromagnetic induction-heating in which Joule heat is generated in a magnetic metal member through an eddy current by action of alternate magnetic filed to cause electromagnetic induction-heating of a heating member (see JP-A No 08-22206).

In the fixing unit of the electromagnetic induction-heating processes, a film with an elastomeric layer is disposed between a heating member and a recording medium in order to heat and melt visible images uniformly in a sufficient enclosing manner of the visible images. When the elastomeric layer is formed of silicone rubber, its lower thermal conductivity degrades thermal response, and thus the thermal difference is remarkably enlarged between the inside face of the film heated by the heating member and the out side of the film contacting with toner. As a result, surface temperature of belts may rapidly drop in cases of much deposited amount of toner, causing possibly so-called cold offset due to insufficient fixing ability.

In addition, the fixing unit of electrophotographic image forming apparatuses is typically demanded for releasing ability of toner with heating members (hereinafter, sometimes referred to as "hot-offset resistance"). The hot-offset resistance may be improved by the presence of release agent at toner surface. However, unusual toners or reuse of toners may reduce the release agent at the toner surface, possibly deteriorating the hot-offset resistance.

In addition to energy conservation, market needs are growing on image forming apparatus with respect to environment-conscious products such as resource saving, lower production energy, and recycle. For example, toners remaining on photoconductors are recovered by a cleaning unit and used again. Specifically, JP-A No. 60-41079 proposes a recycle system, in which toners remaining on photoconductors are recovered by a cleaning unit and return to a developing unit. A so-called cleaningless system is also proposed, in which toners remaining on photoconductors are developed and recovered by a developing unit (see JP-A Nos. 59-133573 and 59-157661). However, recycled toners suffer from degradation of image quality and problems in systems. These are derived from degradation of charging ability and flowability since the recycles toners are mechanically or thermally damaged from developing units to cleaning units. Furthermore, the content of fine particles is relatively large in recycled toners, therefore, the content of fine powders increases in toners within developing units, which arises such problems as smear on developing sleeves, photoconductors, carriers, etc. and leads to abnormal images.

In relation to requirements to enhance image quality of image forming apparatuses in recent years, Japanese Patent Application Publication (JP-B) Nos. 06-082227 and 07-060273 disclose a developer, in which the toner has a relatively small average particle diameter, and the content of particles having a particle diameter of no more than 5 μm and the particle diameter distribution are defined. Toners, of which the content of particles having a particle diameter of no more than 5 μm is large, may be excellent in graininess and sharpness of images and may achieve high quality images. When the content of particles having a particle diameter of no more than 5 μm is large, however, smear or pollution on developing sleeves, photoconductors, carriers, etc. tends to occur, resulting in abnormal images.

JP-A No. 2002-244335 proposes a developer that may be stably used even in recycle systems with high quality images on the basis of defining particle size distribution and charging amount; however, there arises a problem of smear or pollution on developing sleeves due to higher content of particles with smaller diameters. JP-A No. 2003-15341 proposes a toner that is relatively resistant to mechanical or thermal stresses even when the content of particles having a particle diameter of no more than 5 μm is large. However, this proposal does not define binder resin, thus remarkably lacks the mechanical strength depending on the species of resin in use.

Furthermore, speed-up and energy saving of image forming apparatuses demand a toner with excellent low temperature fixability and also excellent hot-offset resistance and storage stability (blocking resistance) that are contradictory to the low temperature fixability. A toner is hence proposed to employ an aromatic polyester resin, however, there is a deficiency that milling ability is poor at producing the toner. A method is hence also proposed, in which a low-molecular mass polyester with a superior milling ability, which being prepared from an aliphatic alcohol as the monomer, and a high-molecular mass polyester are blended (see JP-A No 2002-287427). However, the low-molecular mass polyester, prepared from the aliphatic alcohol, has lower glass-transition temperatures due to its inherent structure, thus the storage stability of toners is poor; consequently, it is difficult to satisfy the low temperature fixability and the hot-offset resistance as well as the storage stability at higher level.

Accordingly, a toner that can be far from smear or pollution on members in developing units or on carriers, can be excellent in terms of durability, low temperature fixability, hot-offset resistance, storage stability, and milling ability, and can provide high quality images for a long period, even while using a toner recycle system, and also image forming apparatuses, image forming methods, and process cartridges that employ the toner are currently desired to provide promptly.

In addition, a developer that can be far from smear or pollution on members in developing units or on carriers, can be excellent in terms of durability, low temperature fixability, hot-offset resistance, and storage stability, and can provide very high quality images that are free from abnormal images such as density reduction and background smear even under variable temperature and humidity, and also image forming apparatuses, image forming methods, and process cartridges that employ the developer are currently desired to provide promptly.

BRIEF SUMMARY OF THE INVENTION

It is an object of the present invention in the first aspect to provide a toner that can be far from smear or pollution on members in developing units or on carriers, can be excellent in terms of durability, low temperature fixability, hot-offset resistance, storage stability, and milling ability, and can provide high quality images for a long period that are excellent in graininess and sharpness of images, even while using a toner recycle system, and also image forming apparatuses, image forming methods, and process cartridges that employ the toner and can form very high quality images for a long period that are free from change of color tone or abnormal images like density reduction and background smear.

It is another object of the present invention in the second aspect to provide a developer that can be far from smear or pollution on members in developing units or on carriers, can be excellent in terms of durability, low temperature fixability, hot-offset resistance, and storage stability, and can provide very high quality images that are free from abnormal images such as density reduction and background smear even under variable temperature and humidity, and also image forming apparatuses, image forming methods, and process cartridges that employ the developer and can form very high quality images for a long period that are free from change of color tone or abnormal images like density reduction and background smear.

The problems described above can be solved by the present invention as follows:

<1a> A toner, comprising a binder resin, a releasing agent, and a colorant, wherein the mass average particle diameter of the toner is 3 μm to 8 μm, the content of particles having a particle diameter of no more than 5 μm is from 60% by number to 90% by number, the binder resin comprises a polyester resin (A) having a softening temperature Tm(A) from no lower than 120° C. to no higher than 160° C. and a polyester resin (B) having a softening temperature Tm(B) from no lower than 80° C. to lower than 120° C., and at least one of the polyester resins (A) and (B) is prepared by condensation polymerization between an alcohol component and a carboxylic acid component, and the alcohol component comprises divalent alcohol of 1,2-propanediol in a content of no less than 65% by mole and consists substantially of aliphatic alcohol.

<2a> The toner according to <1a>, wherein the ratio $D_4$/Dn is 1.65 to 2.00 ($D_4$: mass average particle diameter of toner, Dn: number average particle diameter of toner).

<3a> The toner according to <1a> or <2a>, wherein a maximum endothermic peak appears in a range of 60° C. to 120° C. when the releasing agent is measured by DSC.

<4a> The toner according to any one of <1a> to <3a>, wherein the releasing agent comprises carnauba wax.

<5a> The toner according to any one of <1a> to <4a>, wherein the content of the aliphatic alcohol in the alcohol component is no less than 90% by mole.

<6a> The toner according to any one of <1a> to <5a>, wherein at least one of alcohol components of the polyester resins (A) and (B) further comprises glycerin.

<7a> The toner according to any one of <1a> to <6a>, wherein the alcohol component of the polyester resin (A) further comprises 1,3-propanediol.

<8a> The toner according to any one of <1a> to <7a>, wherein at least one of carboxylic acid components of the polyester resins (A) and (B) comprises an aliphatic dicarboxylic acid of 2 to 4 carbon atoms.

<9a> The toner according to any one of <1a> to <8a>, wherein at least one of carboxylic acid components of the polyester resins (A) and (B) comprises a purified rosin.

<10a> The toner according to any one of <1a> to <9a>, wherein the mass ratio (A)/(B) of the polyester resin (A) and the polyester resin (B) is 1/9 to 9/1.

<11a> The toner according to any one of <1a> to <10a>, wherein the difference [Tm(A)−Tm(B)] between Tm(A) and Tm(B) is no less than 10° C.

<12a> A developer, comprising the toner according to any one of <1a> to <11a>.

<13a> A toner-containing container, filled with the toner according to any one of <1a> to <11a>.

<14a> An image forming apparatus, comprising:

a latent electrostatic image bearing member, a charging unit configured to charge the surface of the latent electrostatic image bearing member, an exposing unit configured to expose the charged surface of the latent electrostatic image bearing member to form a latent electrostatic image, a developing unit configured to develop the latent electrostatic image using a toner to form a visible image, a transfer unit configured to transfer the visible image onto a recording medium, and a fixing unit configured to fix the transferred image on the recording medium, wherein the toner is according to any one of <1a> to <11a>.

<15a> The image forming apparatus according to <14a>, wherein the charging unit charges the latent electrostatic image bearing member in a contactless manner.

<16a> The image forming apparatus according to <14a>, wherein the charging unit charges the latent electrostatic image bearing member through contacting therewith.

<17a> The image forming apparatus according to any one of <14a> to <16a>, wherein the developing unit comprises a magnetic field-generating unit disposed therein and a rotatable developer bearing member that bears a two-component developer of a magnetic carrier and a toner thereon.

<18a> The image forming apparatus according to any one of <14a> to <16a>, wherein the developing unit comprises a developer bearing member, to which the toner being supplied, and a layer thickness-control member for forming a toner-thin layer on the surface of the developer bearing member.

<19a> The image forming apparatus according to any one of <14a> to <18a>, wherein the transfer unit transfers a visible image formed on the latent electrostatic image bearing member onto a recording medium.

<20a> The image forming apparatus according to any one of <14a> to <19a>, comprising plural image forming elements each comprising a latent electrostatic image bearing member, a charging unit, a developing unit, and a transferring unit, wherein the transfer unit transfers images formed on the latent electrostatic image bearing member in series onto recording media of which the surface moves through the transfer site while facing the latent electrostatic image bearing member.

<21a> The image forming apparatus according to any one of <14a> to <18a>, wherein the transfer unit comprises an intermediate transfer member to which the visible image formed on the latent electrostatic image bearing member is primarily transferred and a secondary transfer unit that transfers the visible image formed on the intermediate transfer member onto the recording medium.

<22a> The image forming apparatus according to any one of <14a> to <21a>, comprising a cleaning unit, wherein the cleaning unit comprises a cleaning blade that comes into contact with the surface of the latent electrostatic image bearing member.

<23a> The image forming apparatus according to any one of <14a> to <21a>, wherein the developing unit comprises a developer bearing member that comes into contact with the surface of the latent electrostatic image bearing member, and the developing unit develops a latent electrostatic image formed on the surface of the latent electrostatic image bearing member, and collects the toner remaining on the latent electrostatic image bearing member.

<24a> The image forming apparatus according to any one of <14a> to <23a>, wherein the fixing unit comprises at least one of a roller and a belt, and the fixing unit is heated from the side other than in contact with the toner, and fixes the image transferred on the recording medium by heat and pressure.

<25a> The image forming apparatus according to any one of <14a> to <23a>, wherein the fixing unit comprises at least one of a roller and a belt, and the fixing unit is heated from the side in contact with the toner, and fixes the image transferred on the recording medium by heat and pressure.

<26a> An image forming method, comprising:

a charging step to charge a surface of a latent electrostatic image bearing member, an exposing step to expose the charged surface of the latent electrostatic image bearing member to form a latent electrostatic image, a developing step to develop the latent electrostatic image using a toner to form a visible image, a transferring step to transfer the visible image onto a recording medium, and a fixing step to fix the transferred image on the recording medium, wherein the toner is according to any one of <1a> to <11a>.

<27a> The image forming method according to <26a>, wherein the charging step is carried out by a charging unit that charges the latent electrostatic image bearing member in a contactless manner.

<28a> The image forming method according to <26a>, wherein the charging step is carried out by a charging unit that charges the latent electrostatic image bearing member through contacting therewith.

<29a> The image forming method according to any one of <26a> to <28a>, wherein the developing step uses a rotatable developer bearing member that comprises a magnetic field-generating unit fixed therein and rotates while bearing a two-component developer of a magnetic carrier and a toner thereon.

<30a> The image forming method according to any one of <26a> to <28a>, wherein the developing step uses a developer bearing member, to which the toner being supplied, and a layer thickness-control member for forming a toner-thin layer on the surface of the developer bearing member.

<31a> The image forming method according to any one of <26a> to <30a>, wherein the transfer step transfers a visible image formed on the latent electrostatic image bearing member onto a recording medium.

<32a> The image forming method according to any one of <26a> to <31a>, comprising plural image forming elements each comprising a latent electrostatic image bearing member, a charging unit, a developing unit, and a transferring unit, wherein the transfer unit transfers images formed on the latent electrostatic image bearing member in series onto recording media of which the surface moves through the transfer site while facing the latent electrostatic image bearing member.

<33a> The image forming method according to any one of <26a> to <30a>, wherein the transfer step uses an intermediate transfer member to which the visible image formed on the latent electrostatic image bearing member is primarily transferred, and a secondary transfer unit that transfers the visible image formed on the intermediate transfer member onto the recording medium.

<34a> The image forming method according to any one of <26a> to <33a>, comprising a cleaning step, wherein the cleaning step uses a cleaning blade that comes into contact with the surface of the latent electrostatic image bearing member.

<35a> The image forming method according to any one of <26a> to <33a>, wherein the developing step comprises a developer bearing member that comes into contact with the surface of the latent electrostatic image bearing member, and the developing step develops a latent electrostatic image formed on the surface of the latent electrostatic image bearing member, and collects the toner remaining on the latent electrostatic image bearing member.

<36a> The image forming method according to any one of <26a> to <35a>, wherein the fixing step comprises at least one of a roller and a belt, and heating from the side other than in contact with the toner, and fixing the image transferred on the recording medium by heat and pressure.

<37a> The image forming method according to any one of <26a> to <35a>, wherein the fixing step comprises at least one of a roller and a belt, and heating from the side in contact with the toner, and fixing the image transferred on the recording medium by heat and pressure.

<38a> A process cartridge, comprising a latent electrostatic image bearing member and a developing unit configured to develop the latent electrostatic image formed on the latent electrostatic image bearing member using a toner to form a visible image, wherein the process cartridge is detachably mounted to an image forming apparatus, and the toner is according to any one of <1a> to <11a>.

The toner according to the present invention comprises a binder resin, a releasing agent, and a colorant, wherein the mass average particle diameter of the toner is 3 μm to 8 μm, the content of particles having a particle diameter of no more than 5 μm is from 60% by number to 90% by number, the binder resin comprises a polyester resin (A) having a softening temperature Tm(A) from no lower than 120° C. to no higher than 160° C. and a polyester resin (B) having a softening temperature Tm(B) from no lower than 80° C. to lower than 120° C., at least one of the polyester resins (A) and (B) is prepared by condensation polymerization between an alcohol component and a carboxylic acid component, and the alcohol component comprises divalent alcohol of 1,2-propanediol in a content of no less than 65% by mole and consists substantially of aliphatic alcohol.

In the toner according to the present invention, the polyester resin (A) having a higher softening temperature contributes to enhance the hot-offset resistance and the polyester resin (B) having a lower softening temperature contributes to enhance the low temperature fixability; thus combination thereof can effectively satisfy both of the hot-offset resistance and the low temperature fixability and also provide excellent compatibility with releasing agents. 1,2-propanediol, which is a branched chain alcohol having 3 carbon atoms, effectively contributes to enhance the low temperature fixability while maintaining the hot-offset resistance compared to alcohols having 2 or less carbon atoms, thus makes possible the fixture at considerably lower temperatures and enhances the storage stability. Furthermore, the mass average particle diameter of 3 to 8 μm in the toner may lead to excellent reproducibility even for fine dots of latent images. When the content of particles having a particle diameter of no more than 5 μm is from 60% to 90% by number in the toner, fine particles make smooth the edge portions of images, thus high quality images can be taken with superiority in graininess, sharpness, and thin line reproducibility. Synergetic effects of these features can result in forming high quality images for a long period that are excellent in graininess and sharpness of images, even while using a toner recycle system, without smear or pollution on members in developing units or on carriers, with superiority in terms of durability, low temperature fixability, hot-offset resistance, storage stability, and milling ability.

The developer, according to the present invention in the first aspect, contains the toner according to the present invention. As a result that images are formed by electrophotographic processes using the developer, high quality images can be formed for a long period that are excellent in graininess and sharpness of images, even while using a toner recycle system, without smear or pollution on members in developing units or on carriers, with superiority in terms of durability, low temperature fixability, hot-offset resistance, storage stability, and milling ability.

The toner-containing container according to the present invention contains the inventive toner described above within a container. As a result that images are formed by electrophotographic processes using the toner in the toner-containing container, high quality images can be formed for a long period that are excellent in graininess and sharpness of images, even while using a toner recycle system, without smear or pollution on members in developing units or on carriers, with superiority in terms of durability, low temperature fixability, hot-offset resistance, storage stability, and milling ability.

The image forming apparatus according to the present invention comprises a latent electrostatic image bearing member, a charging unit configured to charge the surface of the latent electrostatic image bearing member, an exposing unit configured to expose the charged surface of the latent electrostatic image bearing member to form a latent electrostatic image, a developing unit configured to develop the latent electrostatic image using a toner to form a visible image, a transfer unit configured to transfer the visible image onto a recording medium, and a fixing unit configured to fix the transferred image on the recording medium; and the toner is the inventive toner described above.

In the image forming apparatus according to the present invention, the charging unit charges uniformly the surface of the latent electrostatic image bearing member; the exposing unit exposes the surface of the latent electrostatic image bearing member to form a latent electrostatic image; the developing unit develops the latent electrostatic image using the toner to form a visible image; the transfer unit transfers the visible image onto a recording medium; and the fixing unit fixes the transferred image on the recording medium. The toner is the inventive toner described above, therefore, high quality images can be formed for a long period that are free from tone change and abnormal images such as density reduction and background smear.

The image forming method according to the present invention comprises a charging step to charge a surface of a latent electrostatic image bearing member, an exposing step to expose the charged surface of the latent electrostatic image bearing member to form a latent electrostatic image, a developing step to develop the latent electrostatic image using a toner to form a visible image, a transferring step to transfer the visible image onto a recording medium, and a fixing step to fix the transferred image on the recording medium; and the toner is the inventive toner described above.

In the image forming method according to the present invention, the charging step charges uniformly the surface of the latent electrostatic image bearing member; the exposing step exposes the surface of the latent electrostatic image bearing member to form a latent electrostatic image; the developing step develops the latent electrostatic image using the toner to form a visible image; the transfer step transfers the visible image onto a recording medium; and the fixing step fixes the transferred image on the recording medium. The toner is the inventive toner described above, therefore, high quality images can be formed for a long period that are free from tone change and abnormal images such as density reduction and background smear.

The process cartridge according to the present invention comprises a latent electrostatic image bearing member and a developing unit configured to develop the latent electrostatic image formed on the latent electrostatic image bearing member using a toner to form a visible image; the process cartridge is detachably mounted to an image forming apparatus thus is excellently convenient; and the toner is the inventive toner described above, therefore, high quality images can be formed for a long period that are free from tone change and abnormal images such as density reduction and background smear.

The problems described above can be solved by the present invention as follows:

<1b> A developer, comprising a toner and a carrier, wherein the toner comprises a binder resin, a releasing agent, and a colorant, the carrier comprises a core material and a coating layer on the surface of the core material, the binder resin comprises a polyester resin (A) having a softening temperature Tm(A) from no lower than 120° C. to no higher than 160° C. and a polyester resin (B) having a softening temperature Tm(B) from no lower than 80° C. to lower than 120° C., at least one of the polyester resins (A) and (B) is prepared by condensation polymerization between an alcohol component and a carboxylic acid component, and the alcohol component comprises divalent alcohol of 1,2-propanediol in a content of no less than 65% by mole and consists substantially of aliphatic alcohol, the coating layer comprises a condensation product between an N-alkoxyalkylated benzoguanamine resin and a resin capable of reacting with the N-alkoxyalkylated benzoguanamine resin, and the resin capable of reacting with the N-alkoxyalkylated benzoguanamine resin is a silicone resin that has at least one of a silanol group and a hydrolyzable group.

<2b> The developer according to <1b>, wherein the resin capable of reacting with the N-alkoxyalkylated benzoguanamine resin comprises a methyl silicone resin that has a silanol group.

<3b> The developer according to <1b> or <2b>, wherein the coating layer comprises fine particles of an inorganic oxide.

<4b> The developer according to any one of <1b> to <3b>, wherein the releasing agent comprises carnauba wax.

<5b> The developer according to any one of <1b> to <4b>, wherein the content of the aliphatic alcohol in the alcohol component is no less than 90% by mole.

<6b> The developer according to any one of <1b> to <5b>, wherein at least one of alcohol components of the polyester resins (A) and (B) further comprises glycerin.

<7b> The developer according to any one of <1b> to <6b>, wherein the alcohol component of the polyester resin (A) further comprises 1,3-propanediol.

<8b> The developer according to any one of <1b> to <7b>, wherein at least one of carboxylic acid components of the polyester resins (A) and (B) comprises an aliphatic dicarboxylic acid of 2 to 4 carbon atoms.

<9b> The developer according to any one of <1b> to <8b>, wherein at least one of carboxylic acid components of the polyester resins (A) and (B) comprises a purified rosin.

<10b> The developer according to any one of <1b> to <9b>, wherein the mass ratio (A)/(B) of the polyester resin (A) and the polyester resin (B) is 1/9 to 9/1.

<11b> The developer according to any one of <1b> to <10b>, wherein the difference [Tm(A)−Tm(B)] between Tm(A) and Tm(B) is no less than 10° C.

<12b> A developer-containing container, filled with the toner according to any one of <1b> to <11b>.

<13b> An image forming apparatus, comprising:

a latent electrostatic image bearing member, a charging unit configured to charge the surface of the latent electrostatic image bearing member, an exposing unit configured to expose the charged surface of the latent electrostatic image bearing member to form a latent electrostatic image, a developing unit configured to develop the latent electrostatic image using a developer to form a visible image, a transfer unit configured to transfer the visible image onto a recording medium, and a fixing unit configured to fix the transferred image on the recording medium, wherein the developer is according to any one of <1b> to <11b>.

<14b> The image forming apparatus according to <13b>, wherein the charging unit charges the latent electrostatic image bearing member in a contactless manner.

<15b> The image forming apparatus according to <13b>, wherein the charging unit charges the latent electrostatic image bearing member through contacting therewith.

<16b> The image forming apparatus according to any one of <13b> to <15b>, wherein the developing unit comprises a magnetic field-generating unit disposed therein and a rotatable developer bearing member that bears a two-component developer of a magnetic carrier and a toner thereon.

<17b> The image forming apparatus according to any one of <13b> to <16b>, wherein the transfer unit transfers a visible image formed on the latent electrostatic image bearing member onto a recording medium.

<18b> The image forming apparatus according to any one of <13b> to <17b>, comprising plural image forming elements each comprising a latent electrostatic image bearing member, a charging unit, a developing unit, and a transferring unit, wherein the transfer unit transfers images formed on the latent electrostatic image bearing member in series onto recording media of which the surface moves through the transfer site while facing the latent electrostatic image bearing member.

<19b> The image forming apparatus according to any one of <13b> to <16b>, wherein the transfer unit comprises an intermediate transfer member to which the visible image formed on the latent electrostatic image bearing member is primarily transferred, and a secondary transfer unit that transfers the visible image formed on the intermediate transfer member onto the recording medium.

<20b> The image forming apparatus according to any one of <13b> to <19b>, comprising a cleaning unit, wherein the cleaning unit comprises a cleaning blade that comes into contact with the surface of the latent electrostatic image bearing member.

<21b> The image forming apparatus according to any one of <13b> to <19b>, wherein the developing unit comprises a developer bearing member that comes into contact with the surface of the latent electrostatic image bearing member, and the developing unit develops a latent electrostatic image formed on the surface of the latent electrostatic image bearing member, and collects the toner remaining on the latent electrostatic image bearing member.

<22b> The image forming apparatus according to any one of <13b> to <21b>, wherein the fixing unit comprises at least one of a roller and a belt, and the fixing unit is heated from the side other than in contact with the toner, and fixes the image transferred on the recording medium by heat and pressure.

<23b> The image forming apparatus according to any one of <13b> to <21b>, wherein the fixing unit comprises at least one of a roller and a belt, and the fixing unit is heated from the side in contact with the toner, and fixes the image transferred on the recording medium by heat and pressure.

<24b> An image forming method, comprising:

charging a surface of a latent electrostatic image bearing member, exposing the charged surface of the latent electrostatic image bearing member to form a latent electrostatic image, developing the latent electrostatic image using a developer to form a visible image, transferring the visible image onto a recording medium, and fixing the transferred image on the recording medium, wherein the developer is according to any one of <1b> to <11b>.

<25b> A process cartridge, comprising a latent electrostatic image bearing member and a developing unit configured to develop the latent electrostatic image formed on the latent electrostatic image bearing member using a developer to form a visible image, wherein the process cartridge is detachably mounted to an image forming apparatus, and the developer is according to any one of <1b> to <11b>.

The developer according to the present invention in the second aspect comprises a toner and a carrier, wherein the toner comprises a binder resin, a releasing agent, and a colorant, the carrier comprises a core material and a coating layer on the surface of the core material, the binder resin comprises a polyester resin (A) having a softening temperature Tm(A) from no lower than 120° C. to no higher than 160° C. and a polyester resin (B) having a softening temperature Tm(B) from no lower than 80° C. to lower than 120° C., at least one of the polyester resins (A) and (B) is prepared by condensation polymerization between an alcohol component and a carboxylic acid component, and the alcohol component comprises divalent alcohol of 1,2-propanediol in a content of no less than 65% by mole and consists substantially of aliphatic alcohol, the coating layer comprises a condensation product between an N-alkoxyalkylated benzoguanamine resin and a resin capable of reacting with the N-alkoxyalkylated benzoguanamine resin, and the resin capable of reacting with the N-alkoxyalkylated benzoguanamine resin is a silicone resin that has at least one of a silanol group and a hydrolyzable group.

In the developer according to the present invention of the second aspect, the polyester resin (A) having a higher softening temperature contributes to enhance the hot-offset resistance and the polyester resin (B) having a lower softening temperature contributes to enhance the low temperature fixability; thus combination thereof can effectively satisfy both of the hot-offset resistance and the low temperature fixability and provide excellent compatibility with releasing agents. 1,2-propanediol, which is a branched chain alcohol having 3 carbon atoms, effectively contributes to enhance the low temperature fixability while maintaining the hot-offset resistance compared to alcohols having 2 or less carbon atoms, thus makes possible the fixture at considerably lower temperatures and enhances the storage stability. The coating layer of the carrier comprises a condensation product between an N-alkoxyalkylated benzoguanamine resin and a resin capable of reacting with the N-alkoxyalkylated benzoguanamine resin, and the resin capable of reacting with the N-alkoxyalkylated benzoguanamine resin is a silicone resin that has at least one of a silanol group and a hydrolyzable group, consequently, the film strength of the coating layer is high, the distribution of charge amount is very sharp, and the change of charge amount is likely to be small under variable environmental conditions such as temperature and humidity. Synergetic effects of these features can result in forming very high quality images that are far from abnormal images such as density reduction and background smear even under variable temperature and humidity, without smear or pollution on members in developing units or on carriers, with superiority in terms of durability, low temperature fixability, hot-offset resistance, and storage stability.

The developer-containing container according to the present invention contains the inventive developer in the second aspect described above within a container. When images are formed by electrophotographic processes using the developer in the developer-containing container, therefore, very high quality images can be formed that are far from abnormal images such as density reduction and background smear even under variable temperature and humidity, without smear or pollution on members in developing units or on carriers, with superiority in terms of durability, low temperature fixability, hot-offset resistance, and storage stability.

The image forming apparatus according to the present invention comprises a latent electrostatic image bearing member, a charging unit configured to charge the surface of the latent electrostatic image bearing member, an exposing unit configured to expose the charged surface of the latent electrostatic image bearing member to form a latent electrostatic image, a developing unit configured to develop the latent electrostatic image using a developer to form a visible image, a transfer unit configured to transfer the visible image onto a recording medium, and a fixing unit configured to fix the transferred image on the recording medium; and the developer is the inventive developer of the second aspect described above.

In the image forming apparatus according to the present invention, the charging unit charges uniformly the surface of the latent electrostatic image bearing member; the exposing unit exposes the surface of the latent electrostatic image bearing member to form a latent electrostatic image; the developing unit develops the latent electrostatic image using the developer to form a visible image; the transfer unit transfers the visible image onto a recording medium; and the fixing unit fixes the transferred image on the recording medium. The developer is the inventive developer described above, therefore, very high quality images can be formed for a long period that are free from tone change and abnormal images such as density reduction and background smear.

The image forming method according to the present invention comprises charging a surface of a latent electrostatic image bearing member, exposing the charged surface of the latent electrostatic image bearing member to form a latent electrostatic image, developing the latent electrostatic image using a developer to form a visible image, transferring the visible image onto a recording medium, and fixing the transferred image on the recording medium; and the developer is the inventive developer of the second aspect described above.

In the image forming method according to the present invention, the charging step charges uniformly the surface of the latent electrostatic image bearing member; the exposing step exposes the surface of the latent electrostatic image bearing member to form a latent electrostatic image; the developing step develops the latent electrostatic image using the developer to form a visible image; the transfer step transfers the visible image onto a recording medium; and the fixing step fixes the transferred image on the recording medium. The developer is the inventive developer of the second aspect described above, therefore, high quality images can be formed for a long period that are free from tone change and abnormal images such as density reduction and background smear.

The process cartridge according to the present invention comprises a latent electrostatic image bearing member and a developing unit configured to develop the latent electrostatic image formed on the latent electrostatic image bearing member using a toner to form a visible image; the process cartridge is detachably mounted to an image forming apparatus thus is excellently convenient; and the developer is the inventive developer of the second aspect described above, therefore, high quality images can be formed for a long period that are free from tone change, density reduction, and abnormal images such as background smear.

DETAILED DESCRIPTION OF THE INVENTION

Toner

Figure 1:
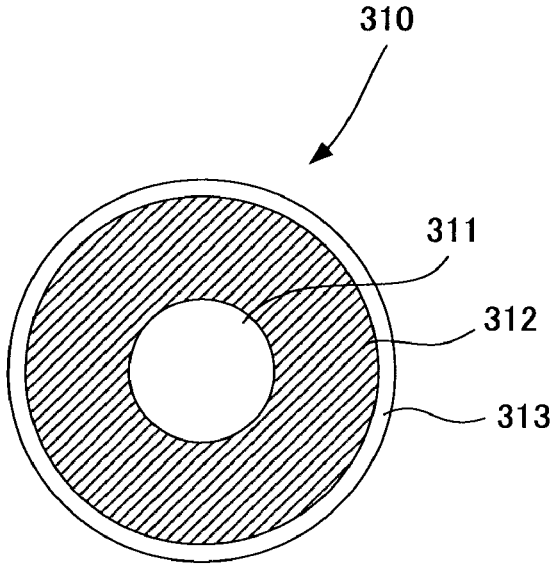
FIG. 1 is a schematic cross-section that exemplarily shows a charging roller utilized in an inventive image forming apparatus.

The toner according to the present invention contains at least a binder resin, a releasing agent, and a colorant, and also other optional ingredients such as a charge control agent and an external additive.

Binder Resin

The binder resin contains the polyester resin (A) having a softening temperature Tm(A) from no lower than 120° C. to no higher than 160° C. and the polyester resin (B) having a softening temperature Tm(B) from no lower than 80° C. to lower than 120° C., and these polyester resins (A) and (B) may each be prepared by condensation polymerization between an alcohol component and a carboxylic acid component.

The binder resin may be excellent in low temperature fixability, hot-offset resistance, and high temperature stability, and also superior in mechanical strength. Furthermore, the binder resin may exhibit excellent compatibility with releasing agents, in particular dispersibility is significantly appropriate at melting and kneading.

The softening temperature Tm(A) of the polyester resin (A) is from no lower than 120° C. to no higher than 160° C., preferably 130° C. to 155° C., more preferably 135° C. to 155° C.

The softening temperature Tm(B) of the polyester resin (B) is from no lower than 80° C. to lower than 120° C., preferably 85° C. to 115° C., more preferably 90° C. to 110° C.

It is preferred that the difference [Tm(A)−Tm(B)] between Tm(A) and Tm(B) is no less than 10° C., more preferably 15° C. to 55° C., still more preferably 20° C. to 50° C.

It is preferred that the mass ratio (A)/(B) of the polyester resin (A) and the polyester resin (B) is 1/9 to 9/1, more preferably 2/8 to 8/2, still more preferably 3/7 to 7/3.

The polyester resin (A) having these properties and a higher softening temperature contributes to enhance the hot-offset resistance and the polyester resin (B) having a lower softening temperature contributes to enhance the low temperature fixability; thus combination thereof can effectively satisfy both of the low temperature fixability and the hot-offset resistance.

In accordance with the present invention, at least one of the polyester resins (A) and (B) is prepared by condensation polymerization between an alcohol component and a carboxylic acid component, and the alcohol component comprises divalent alcohol of 1,2-propanediol in a content of no less than 65% by mole and consists substantially of aliphatic alcohol.

Alcohol Component 1,2-propanediol, which is a branched chain alcohol having 3 carbon atoms and used as the alcohol component, effectively contributes to enhance the low temperature fixability while maintaining the hot-offset resistance compared to alcohols having 2 or less carbon atoms, and effectively prevents degradation of storage ability due to lowering the glass transition temperature compared to branched chain alcohols having 4 or more carbon atoms, consequently, such surprising effects are derived that the fixture is possible at considerably lower temperatures and the storage stability is improved. The polyester resin, which being derived from 1,2-propanediol as the alcohol component, may exhibit excellent compatibility with releasing agents and significantly appropriate dispersibility at melting and kneading. When the content of 1,2-propanediol is no less than 65% by mole in divalent alcohol components, the dispersibility is significantly proper, mechanical strength of the toner is higher, and high temperature stability of the toner is excellent.

The alcohol component may contain alcohols other than 1,2-propanediol within an appropriate range; the content of 1,2-propanediol is no less than 65% by mole within the divalent alcohol component, preferably no less than 70% by mole, more preferably no less than 80% by mole, still more preferably no less than 90% by mole. Examples of the divalent alcohols other than 1,2-propanediol are 1,3-propanediol, ethylene glycols having a different carbon number, hydrogenated bisphenol A, and aliphatic dialcohols thereof adducted with alkylene (carbon number: 2 to 4) oxide (average adduct mole number: 1 to 16).

The content of the divalent alcohol is preferably 60% to 95% by mole within the alcohol component, more preferably 65% to 90% by mole.

It is preferred that the alcohol component of the polyester resin (A) contains 1,3-propanediol in view of hot-offset resistance. The mole ratio 1,2-propanediol/1,3-propanediol in the alcohol component of the polyester resin (A) is preferably 99/1 to 65/35, more preferably 95/5 to 70/30, still more preferably 90/10 to 75/25, particularly preferably 85/15 to 77/23.

At least one of alcohol components of the polyester resins (A) and (B) may contain aromatic alcohol such as bisphenol A adducted with alkylene oxides, for example, polyoxypropylene (2,2)-2,2-bis(4-hydroxyphenyl)propane, polyoxyethylene (2,2)-2,2-bis(4-hydroxyphenyl)propane, etc.; however, at least one of the alcohol components of the polyester resins (A) and (B) consists substantially of aliphatic alcohol, preferably, both of the alcohol components of the polyester resins (A) and (B) consists substantially of aliphatic alcohol.

In this specification, the expression "consists substantially of aliphatic alcohol" means that the content of aliphatic alcohol is no less than 90% by mole in the alcohol component, more preferably no less than 95% by mole, still more preferably no less than 98% by mole, particularly preferably no less than 99% by mole.

Carboxylic Acid Component

The carboxylic acid component may be properly selected depending on the application; preferably, the carboxylic acid component contains aliphatic dicarboxylic acid of 2 to 4 carbon atoms. The aliphatic dicarboxylic acid of 2 to 4 carbon atoms is exemplified by adipic acid, maleic acid, malic acid, succinic acid, fumaric acid, citraconic acid, itaconic acid, or anhydrides thereof. Among these, the aliphatic dicarboxylic acid selected from at least one of succinic acid, fumaric acid, citraconic acid, and itaconic acid are preferable, and itaconic acid is particularly preferable from the viewpoint of effective enhancement in low temperature fixability.

The content of the aliphatic dicarboxylic acid of 2 to 4 carbon atoms is preferably 0.5% to 20% by mole in the carboxylic acid component in view of enhancing the low temperature fixability and preventing the decrease of glass transition temperature, more preferably 1% to 10% by mole. When the polyester resin is prepared by condensation polymerization of aliphatic carboxylic acids with no aromatic ring and 1,2-propanediol, the resulting polyester resin has higher compatibility with releasing agents, thus combination with the releasing agents may further enhance the filming resistance.

It is preferred that the carboxylic acid component contains a rosin. Rosins, having a polycyclic aromatic ring, may reduce water-absorbing property inherent for conventional polyester derived from aliphatic alcohol, and thus the effect to suppress the charging amount may be more pronounced under high temperature and high humidity conditions.

The rosin is a natural resin obtained from pines; its main component is a resin acid such as abietic acid, neoabietic acid, parastoline acid, pimaric acid, isopimaric acid, sandaraco pimaric acid, dehydroabietic acid, or mixtures thereof.

The rosin is classified into tall oil that is a by-product in production processes of pulp, gum rosin obtained from neat pitch pine, or wood rosin obtained from cut stocks of pines; the tall rosin is preferable in view of low temperature fixability.

The rosin may be modified ones such as disproportionated or hydrogenated rosins; it is preferred in the present invention that the rosin is unmodified rosin, i.e. raw rosin, in view of low temperature fixability and storage stability.

It is preferred that the rosin is a purified rosin in view of elongating the storage stability and odor.

The purified rosin means one that is reduced for its impurities through a purifying step. The main impurities are exemplified by 2-methylpropane, acetaldehyde, 3-methyl-2-butanone, 2-methylpropanoic acid, butanoic acid, pentanoic acid, n-hexanal, octane, hexanoic acid, benzaldehyde, 2-pentylfuran, 2,6-dimethylcyclohexanone, 1-methyl-2-(1-methylethyl)benzene, 3,5-dimethyl-2-cyclohexene, and 4-(1-methylethyl)benzaldehyde. Among these, in the present invention, three peak strengths of 2-methylpropane, pentanoic acid, and benzaldehyde detected by a head space GC-MS method as volatile components may be employed as an index of purified rosin. The index based on the volatile components rather than absolute amount of impurities is derived from the fact that the purified rosin is employed in the invention for the purpose of improving odor over the previous polyester resins.

The purified rosin in the present invention indicates those having a peak strength of no more than $0.8\times10^7$ for hexanoic acid, a peak strength of no more than $0.4\times10^7$ for pentanoic acid, and a peak strength of no more than $0.4\times10^7$ for benzaldehyde measured by the head space GC-MS method under conditions described in Examples. From the viewpoint of storage stability and odor, the peak strength of hexanoic acid is preferably no more than $0.6\times10^7$, more preferably no more than $0.5\times10^7$; the peak strength of pentanoic acid is preferably no more than $0.3\times10^7$, more preferably no more than $0.2\times10^7$; and the peak strength of benzaldehyde is preferably no more than $0.3\times10^7$, more preferably no more than $0.2\times10^7$.

Moreover, it is preferred from the viewpoint of storage stability and odor that n-hexanal and 2-pentylfuran are also reduced in addition to the three compounds. The peak strength of n-hexanal is preferably no more than $1.7\times10^7$, more preferably no more than $1.6\times10^7$, still more preferably no more than $1.5\times10^7$. The peak strength of 2-pentylfuran is preferably no more than $1.0\times10^7$, more preferably no more than $0.9\times10^7$, still more preferably no more than $0.8\times10^7$.

The method for purifying rosin may be conventional ones such as distillation, recrystallization, and extraction, preferably, the rosin is purified by distillation. The distillation method may be vacuum distillation, molecular distillation, steam distillation, or the like as described in JP-A No. 07-286139, for example; it is preferred that the purification is carried out by vacuum distillation. The vacuum distillation is typically carried out under a pressure of no more than 6.67 kPa at 200° C. to 300° C. The vacuum distillation may be thin-film distillation or rectification distillation in addition to conventional simple distillation. Under typical distillation conditions, 2% to 10% by mass of polymer components is removed from raw rosin as a pitch ingredient, and also 2% to 10% by mass of initial distilled ingredients is removed.

The softening temperature of the unmodified rosin is preferably 50° C. to 100° C., more preferably 60° C. to 90° C., still more preferably 65° C. to 85° C. The purification may reduce the impurities within the rosin. The softening temperature of rosin means one measured by the method described in Examples later in a way that a rosin is once melted followed by allowing to cool in an atmosphere of temperature 25° C. and relative humidity 50% for one hour and then the softening temperature is measured.

The acid value of the unmodified rosin is preferably 100 to 200 mgKOH/g, more preferably 130 to 180 mgKOH/g, still more preferably 150 to 170 mgKOH/g.

The content of the purified rosin is preferably 2% to 50% by mole in the carboxylic acid component, more preferably 5% to 40% by mole, still more preferably 10% to 30% by mole.

The carboxylic aid component may contain carboxylic acids other than the aliphatic carboxylic acids and rosins described above, as long as in an appropriate range; preferably, such aromatic dicarboxylic acids are contained as phthalic acid, isophthalic acid, and terephthalic acid in view of maintaining the glass transition temperature. The content of the aromatic dicarboxylic acid is preferably 40% to 95% by mole in the carboxylic acid component, more preferably 50% to 90% by mole, still more preferably 60% to 80% by mole.

It is preferred that the polyester resin is a cross-linked polyester resin and that a raw monomer of trivalent or more is included into at least one of the alcohol component and the carboxylic acid component. The content of the raw monomer of trivalent or more is preferably 0% to 40% by mole based on the total amount of the alcohol component and the carboxylic acid component, more preferably 5% to 30% by mole.

As regards the raw monomer of trivalent or more, for example, the polyvalent carboxylic acid of trivalent or more is trimellitic acid or its derivatives. Examples of the polyhydric alcohol of trivalent or more are glycerin, pentaerythritol, trimethylolpropane, sorbitol, and adducts with alkylene (carbon number: 2 to 4) oxide (average adduct number: 1 to 16) thereof, etc. Among these, glycerin is particularly preferable since glycerin acts as a cross-linker and also effectively enhances the low temperature fixability. It is preferred from these viewpoints that at least one of the polyester resins (A) and (B) contains glycerin as the alcohol component. The content of the glycerin is preferably 5% to 40% by mole in the alcohol component, more preferably 10% to 35% by mole.

Esterification Catalyst

It is preferred that the condensation polymerization between the alcohol component and the carboxylic acid component is carried out under the presence of an esterification catalyst. The esterification catalyst is exemplified by Lewis acids such as p-toluenesulfonic acid, titanium compounds, and tin (II) compounds having no Sn—C bond. These catalysts may be used alone or in combination. Among these, titanium compounds and tin (II) compounds having no Sn—C bond are particularly preferable.

The titanium compound is preferably those having a Ti—O bond, more preferably having an alkoxy group, an alkenyloxy, or an acyloxy group of 1 to 28 carbon atoms in total.

Examples of the titanium compound include titaniumdiisopropylate bistriethanolaminato $Ti(C_6H_{14}O_3N)_2(C_3H_7O)_2$, titaniumdiisopropylate bisdiethanolaminato $Ti(C_4H_{10}O_2N)_2(C_3H_7O)_2$, titaniumdipentylate bistriethanolaminato $Ti(C_6H_{14}O_3N)_2(C_5H_{11}O)_2$, titaniumdiethylate bistriethanolaminato $Ti(C_6H_{14}O_3N)_2(C_2H_5O)_2$, titaniumdihydroxy octylatebistriethanolaminato $Ti(C_6H_{14}O_3N)_2(OHC_8H_{16}O)_2$, titaniumdistearate bistriethanolaminato $Ti(C_6H_{14}O_3N)_2(C_{18}H_{37}O)_2$, titaniumtriisopropylate triethanolaminato $Ti(C_6H_{14}O_3N)(C_3H_7O)_3$, and titanium monopropylatetris (triethanolaminato) $Ti(C_6H_{14}O_3N)_3(C_3H_7O)$. Among these, titaniumdiisopropylate bistriethanolaminato, titaniumdiisopropylate bisethanolaminato, and titanium dipentylate bistriethanolaminato are preferable in particular. These may be commercially available from Matsumoto Trading Co., for example.

Specific examples of the other preferable titanium compounds are tetra-n-butyltitanate $Ti(C_4H_9O)_4$, tetrapropyltitanate $Ti(C_3H_7O)_4$, tetrastearyltitanate $Ti(C_{18}H_{37}O)_4$, tetramyristyltitanate $Ti(C_{14}H_{29}O)_4$, tetraoctyltitanate $Ti(C_8H_{17}O)_4$, dioctyldihydroxyoctyltitanate $Ti(C_8H_{17}O)_2(OHC_8H_{16}O)_2$, and dimyristyldioctyltitanate $Ti(C_{14}H_{29}O)_2(C_8H_{17}O)_2$; among these, tetrastearyltitanate, tetramyristyltitanate, tetraoctyltitanate, and dioctyldihydroxyoctyltitanate are preferable. These may be synthesized by reaction of halogenated titanium and corresponding alcohols, or commercially available from Nisso Co., for example.

The amount of the titanium compound is preferably 0.01 to 1.0 part by mass based on 100 parts by mass of the total amount of the alcohol component and the carboxylic acid component, more preferably 0.1 to 0.7 parts by mass.

The tin (II) compound having no Sn—C bond described above is preferably tin (II) compounds having an Sn—O bond or tin (II) compounds having an Sn—X bond (X: halogen atoms), more preferably tin (II) compounds having an Sn—O bond.

The tin (II) compounds having an Sn—O bond are exemplified by tin (II) carboxylates of 2 to 28 carbon atoms such as tin (II) oxalate, tin (II) diacetate, tin (II) dioctanoate, tin (II) dilaurate, tin (II) distearate, and tin (II) dioleate; tin (II) dialkoxide of 2 to 28 carbon atoms such as dioctyloxy tin (II), dilauryloxy tin (II), distearyloxy tin (II), and dioleyloxy tin (II); tin (II) oxide, and tin (II) sulfate.

The tin (II) compounds having an Sn—X bond (X: halogen atoms) are exemplified by halogenated tin (II) such as tin (II) chloride and tin (II) bromide; in particular, tin (II) fatty acid expressed by $(R^1COO)_2Sn$ ($R^1$: alkyl or alkenyl group of 5 to 19 carbon atoms), $(R^2O)_2Sn$ ($R^2$: alkyl or alkenyl group of 6 to 20 carbon atoms), and tin (II) oxide expressed by SnO are preferable in view of an effect at initial charging and catalytic ability; tin (II) fatty acid expressed by $(R^1COO)_2Sn$ and tin (II) oxide are more preferable; tin (II) dioctanoate, tin (II) distearate, and tin (II) oxide are more preferable.

The amount of the tin (II) compound having no Sn—C bond is preferably 0.01 to 1.0 part by mass based on 100 parts by mass of the total of the alcohol component and the carboxylic acid component, more preferably 0.1 to 0.7 part by mass.

When the titanium compound and the tin (II) compound having no Sn—C bond are used together, the total amount of the titanium compound and the tin (II) compound is preferably 0.01 to 1.0 part by mass based on 100 parts by mass of the total of the alcohol component and the carboxylic acid component, more preferably 0.1 to 0.7 part by mass.

The condensation polymerization of the alcohol component and the carboxylic acid component may be carried out at 180° C. to 250° C. under inert atmosphere in the presence of the esterification catalyst. The softening temperature of the polyester resin can be arranged by reaction temperature.

The glass transition temperatures of the polyester resins (A) and (B) are preferably 45° C. to 75° C., more preferably 50° C. to 70° C., preferably 50° C. to 65° C., in view of fixability, storage stability, and durability. The acid value is preferably 1 to 80 mgKOH/g, more preferably 10 to 50 mgKOH/g, in view of charging ability and environmental stability.

It is preferred in the present invention that the polyester resins (A) and (B) are amorphous rather than crystalline. In this specification, "amorphous polyester" refers to a polyester of which the difference between the softening temperature and the glass transition temperature Tg is no less than 30° C.

The polyester resins (A) and (B) may each be a modified polyester resin. The "modified polyester resin" refers to a polyester resin grafted or blocked by phenol, urethane, etc.

The binder resin may contain other optional conventional resins such as vinyl resins like styrene-acrylic resins, epoxy resins, polycarbonate resins, and polyurethane resins; the content of the polyester resins (A) and (B) in the binder resin is preferably no less than 70% by mass, more preferably no less than 80% by mass, still more preferably no less than 90% by mass, particularly preferable is 100% by mass substantially.

Releasing Agent (Wax)

The releasing agent may be properly selected from conventional ones depending on the application; examples thereof include aliphatic hydrocarbon waxes such as low molecular weight polyethylene, low molecular weight polypropylene, polyolefin wax, microcrystalline wax, paraffin wax, and Sasol wax; oxides of aliphatic hydrocarbon waxes such as oxidized polyethylene wax or block copolymers thereof; plant waxes such as candelilla wax, carnauba wax, Japan wax, and jojoba wax; animal waxes such as beeswax, lanolin, and whale wax; mineral waxes such as ozokerite, ceresin, and petrolatum; waxes based on aliphatic esters such as montanic acid ester wax and castor wax; and waxes prepared by deoxidizing partially or entirely fatty acid ester such as deoxidized carnauba wax.

Examples of the waxes further include saturated linear fatty acids such as palmitic acid, stearic acid, montanic acid, and linear alkylcarboxylic acids having a linear alkyl group; unsaturated fatty acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and long chain alkylalcohols; polyhydric alcohols such as sorbitol; fatty acid amides such as linoleic acid amide, oleic acid amide, and lauric acid amide; saturated fatty acid bisamides such as methylene bis-capric acid amide, ethylene bis-lauric acid amide, and hexamethylene bis-stearic acid amide; unsaturated fatty acid amides such as ethylene bis-oleic acid amide, hexamethylene bis-oleic acid amide, N,N'-dioleyl adipic acid amide, and N,N'-dioleyl sebacic acid amide; aromatic bisamides such as m-xylene bis-stearic acid amide, and N,N'-distearyl isophthalic acid amide; metal salts of fatty acids such as calcium stearate, calcium laurate, zinc stearate and magnesium stearate; waxes prepared by grafting a vinyl monomer such as styrene or acrylic acid to an aliphatic hydrocarbon wax; partial esters between fatty acids such as behenic acid monoglyceride and a polyhydric alcohol; and methyl esters having a hydroxyl group, which are obtained by hydrogenizing a plant oil and fat.

In addition, available waxes are polyolefins that are prepared by radical polymerization of olefin under a high pressure; polyolefins that are purified for low molecular-weight byproducts at polymerization of high molecular-weight polyolefins; polyolefins polymerized using catalysts such as Ziegler catalysts and metallocene catalysts under a low pressure; polyolefins polymerized by means of radiation ray, electromagnetic wave, or light; low molecular-weight polyolefins prepared by heat decomposition of high molecular-weight polyolefins; paraffin wax, microcrystalline wax, and Fischer-Tropsch wax; synthetic hydrocarbon waxes prepared by synthol method, hydrocoal method or Arge method; synthetic waxes prepared from a monomer having one carbon atom; hydrocarbon waxes having functional groups such as hydroxyl and carboxyl groups; mixtures of hydrocarbon waxes and hydrocarbon waxes having functional groups, and modified waxes of these waxes grafted by vinyl monomers such as styrene, maleic acid esters, acrylates, methacrylates, and maleic anhydride.

In addition, these waxes may be arranged to sharpen the molecular-weight distribution by means of press sweating, solvents, recrystallization, vacuum distillation, supercritical gas extraction, or solution or to remove solid fatty acids of lower molecular weight, solid alcohols of lower molecular weight, solid compounds of lower molecular weight, or other impurities.

When toners are produced through milling processes, the milling tends to occur at interface between binder resins and waxes thereby to expose waxes at the surface of toners, which then causing problems of filming on photoconductors or carriers; in contrast, the polyester resin used as binder resin in the present invention may exhibit remarkably adequate dispersibility for waxes, thus the waxes are unlikely to separate from toners by virtue of compatibility between the binder resin and the waxes. Consequently, the inventive toner is less likely to occur the filming compared to conventional toners. Among the waxes described above, carnauba wax is more preferable due to most adequate dispersibility with the inventive binder resin, particularly preferable is carnauba wax that is removed for free fatty acids.

The melting point of the wax is preferably 60° C. to 120° C., more preferably 70° C. to 110° C., in view of balance between fixability and hot-offset resistance. When the melting point is below 60° C., the blocking resistance may be poor, and when above 120° C., the effect on hot-offset resistance may not appear.

When two or more species of different waxes are used together, plasticizing effect and mold-releasing effect of waxes may be represented at the same time. The wax having the plasticizing effect is exemplified by waxes with a lower melting point, waxes with a branched molecular structure, and waxes having a polar group. The wax having the mold-releasing effect is exemplified by waxes with a higher melting point; the molecular structure of the wax may be linear or nonpolar with no functional group. For example, two or more species of different waxes are combined such that the difference of their melting points is 10° C. to 100° C., or a polyolefin and a graft-modified polyolefin are combined.

When two species of waxes are selected from those having similar structures, the wax having a lower melting point exhibits the plasticizing effect and the wax having a higher melting point exhibits mold-releasing effect. It is preferred that the difference of their melting points is 10° C. to 100° C. from the viewpoint of effective respective functions. When the difference of their melting points is below 10° C., the respective functions may be insignificant, and when the difference is above 100° C., the synergic effect to generate the functions may be insufficient. It is preferred that at least one of the waxes has a melting point of 60° C. to 120° C., more preferably 70° C. to 110° C. so as to easily exhibit the respective functions.

It is preferred that the waxes are relatively selected such that one, having a branched structure or a polar group like functional groups or being modified by a constituent other than main constituent, exhibits the plasticizing effect and one, having a more linear structure or being nonpolar with no functional group and unmodified straight, exhibits the mold-releasing effect. Preferable combinations are exemplified by (1) combinations between polyethylene homopolymers or copolymers based on ethylene and polyolefin homopolymers or copolymers based on an olefin other than ethylene, (2) combinations between polyolefins and graft-modified polyolefins, (3) combinations between alcohol waxes, fatty acid waxes or ester waxes, and hydrocarbon waxes, (4) combinations between Fischer-Tropsch waxes or polyolefin waxes and paraffin waxes or microcrystal waxes, (5) combinations between Fischer-Tropsch waxes and polyolefin waxes, (6) combinations between paraffin waxes and microcrystal waxes, and (7) combinations between carnauba wax, candelilla wax, rice wax, or montan wax and hydrocarbon waxes.

It is preferred in any cases that the peak top temperature of maximum peak observed in DSC measurement of the releasing agent is in a range of 60° C. to 120° C., more preferably the maximum peak appears in a range of 70° C. to 110° C. so as to balance easily the storage stability and the fixability of toner.

The melting point of waxes is defined in the present as the peak top temperature of maximum peak of releasing agents or waxes in the DSC measurement.

The maximum endothermic peak of waxes is determined from a DSC curve measured by use of a differential scanning calorimeter (TA-60WS, DSC-60, by Shimadzu Co.) as a DSC measuring apparatus, for example. The measuring method is based on ASTM D3418-82. The DSC curve in the present invention may be measured at heat-up rate 10° C./min after eliminating prior hysteresis by heating up and cooling down each one time.

The content of the wax in the toner is preferably 0.2 to 30 parts by mass based on 100 parts by mass of the binder resin, more preferably 1 to 15 parts by mass, still more preferably 3 to 10 parts by mass.

Colorant

The colorant may be selected from conventional dyes and pigments depending on the application; examples thereof include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Heio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, and lithopone. These may be used singly or in combination.

The color of the coloring agent may be properly selected depending on the purpose, and may be those for monochrome or color. These may be used alone or in combination of two or more.

Examples of black colorants include carbon black (C.I. pigment black 7) such as furnace black, lamp black, acetylene black, and channel black; metals such as copper iron (C.I. pigment black 11) and titanium oxide; organic pigments such as aniline black (C.I. pigment black 1).

Examples of magenta colorants include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, and 211; C.I. Pigment Violet 19; C.I.; C.I. Vat Red 1, 2, 10, 13, 15, 23, 29, and 35.

Examples of cyan colorants include C.I. Pigment Blue 2, 3, 15, 15:1, 15:2, 15:3, 15:4, 15:6, 16, 17, and 60; C.I. Vat Blue 6; C.I. Acid Blue 45 or Cu phthalocyanine pigments with a phthalocyanine skeleton having 1 to 5 substituted phthalimide methyl groups; Green 7, and Green 36.

Examples of magenta colorants include yellow pigments include C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, and 180; C.I. Vat Yellow 1, and 3, 20; Orange 36.

The content of the colorant in the toner may be properly selected depending on the application; preferably, the content is 1% to 15% by mass, and more preferably 3% to 10% by mass. When the content is less than 1% by mass, tinting strength of the colorant is insufficient, and when the content is more than 15% by mass, pigment dispersion is likely to be insufficient in the toner, resulting in degradation of tinting strength or electric properties of the toner.

The colorants may be combined with resins to form masterbatches. Such resins may be properly selected depending on the application; examples thereof include polymers of styrene or substituted styrenes, styrene copolymers, polymethyl methacrylates, polybuthyl methacrylates, polyvinyl chlorides, polyvinyl acetates, polyethylenes, polypropylenes, polyesters, epoxy resins, epoxy polyol resins, polyurethanes, polyamides, polyvinyl butyral, polyacrylic acid resins, rosin, modified rosins, terpene resins, aliphatic or alicyclic hydrocarbon resins, aromatic petroleum resins, chlorinated paraffin, paraffin, and the like. These may be used alone or in combination.

Examples of polymers of styrene or substituted styrenes include polyester resin, polystyrene, poly-p-chlorostyrene, polyvinyl toluene, and the like. Examples of styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl alpha-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic ester copolymers, and the like.

The masterbatch may be produced by mixing and kneading resins for the masterbatch and a colorant with high shear force. In order to improve interaction between colorant and a resin, an organic solvent may be used. In addition, the "flushing process" in which a wet cake of colorant being applied directly is preferable because drying is unnecessary. In the flushing process, a water-based paste containing colorant and water is mixed and kneaded with the resin and an organic solvent so that the colorant migrates towards the resin, and that water and the organic solvent are removed. The materials are preferably mixed and kneaded using a triple roll mill and other high-shear dispersing devices.

Charge Control Agent

The charge control agent may be properly selected depending on the application; preferably, the charge control agent is preferably colorless or white so as to be free from affecting the color tone. Examples of charge control agent include triphenylmethane dyes, molybdic acid chelate pigments, rhodamine dyes, alkoxy amines, quaternary ammonium salts such as fluoride-modified quaternary ammonium salts, alkylamide, phosphoric monomer or compound thereof, tungsten monomer or compounds thereof, fluoride activators, salicylic acid metallic salts, metallic salts of salicylic acid derivative, and the like. These may be used alone or in combination.

The charge control agent may be of commercially available ones. Specific examples thereof include Bontron P-51 of a quaternary ammonium salt, Bontron E-82 of an oxynaphthoic acid metal complex, Bontron E-84 of a salicylic acid metal complex and Bontron E-89 of a phenol condensate (Orient Chemical Industries, Ltd.); TP-302 and TP-415 of a quaternary ammonium salt molybdenum metal complex (by Hodogaya Chemical Co.); Copy Charge PSY VP2038 of a quaternary ammonium salt, Copy Blue PR of a triphenylmethane derivative and Copy Charge NEG VP2036 and Copy Charge NX VP434 of a quaternary ammonium salt (by Hoechst Ltd.); LRA-901, and LR-147 of a boron metal complex (by Japan Carlit Co., Ltd.); quinacridone, azo pigment, and other high-molecular mass compounds having functional group of sulfonic acid, carboxyl, quaternary ammonium salt, or the like.

The charge control agent may be dissolved and/or dispersed in the toner material after kneading with the masterbatch. The charge control agent may also be added directly at dissolving or dispersing into the organic solvent together with the toner material. In addition, the charge control agent may be added onto the surface of the toner particles after producing the toner particles.

The content of the charge control agent depends on binder resins, external additives, and dispersion processes; preferably, the content of charge control agent is 0.1 to 10 parts by mass, and more preferably 0.2 to 5 parts by mass based on 100 parts by mass of the binder resin. When the content is less than 0.1 part by mass, the charge may be uncontrollable; when the content is more than 10 parts by mass, charging ability of the toner becomes excessively significant, which lessens the effect of charge control agent itself and increases electrostatic attraction force with a developing roller, leading to decrease of developer flowability or image density degradation.

External Additive

The external additive may be properly selected from conventional ones depending on the application; examples thereof include silica fine particles, metal salts of fatty acids such as zinc stearate and aluminum stearate; metal oxides such as titanium oxide, alumina, tin oxide and antimony oxide, hydrophobized products thereof, and fluoropolymers. Among these, particularly preferable are silica particles, titanium oxide particles, and hydrophobized titanium oxide particles.

The silica fine particles may be those commercially available; examples thereof include HDK H2000, HDK H2000/4, HDK H2050EP, HVK21 and HDK H1303 (by Hoechst Co.); R972, R974, RX200, RY200, R202, R805 and R812 (Nippon Aerosil Co.). The titanium oxide fine particles may be those commercially available; examples thereof include P-25 (by Nippon Aerosil Co.); STT-30, STT-65C-S (by Titan Kogyo K. K.); TAF-140 (by Fuji Titanium Industry Co.); MT-150W, MT-500B, MT-600B and MT-150A (by Tayca Co.). The hydrophobized titanium oxide fine particles may be those commercially available; examples thereof include T-805 (by Nippon Aerosil Co.); STT-30A and STT-65S-S (by Titan Kogyo K.K.); TAF-500T and TAF-1500T (by Fuji Titanium Industry Co.); MT-100S and MT-100T (by Tayca Co.); and IT-S (Ishihara Sangyo Kaisha Ltd.).

The hydrophobized oxide fine particles such as of silica, titanium oxide or alumina fine particles may be produced through treating hydrophilic particles with silane coupling agents such as methyl trimethoxy silane, methyl triethoxy silane, or octyl trimethoxy silane.

Examples of the hydrophobilizing agents include silane coupling agents such as trialkyl halogenated silanes, alkyl trihalogenated silanes, and hexaalkyl disilazane; sililating agents, silane coupling agents having a fluorinated alkyl group, organotitanate coupling agents, aluminum-containing coupling agents, silicone oils, and silicone vanish.

In addition, inorganic fine particles, treated with silicone oil while heating as required, are appropriately utilized.

Examples of inorganic fine particles include silica, alumina, titanium oxide, barium titanate, magnesium titanate, calcium titanate, strontium titanate, iron oxide, copper oxide, zinc oxide, tin oxide, quartz sand, clay, mica, silicic pyroclastic rock, diatomaceous earth, chromic oxide, cerium oxide, iron oxide red, antimony trioxide, magnesium oxide, zirconium oxide, barium sulfate, barium carbonate, calcium carbonate, silicon carbide and silicon nitride. Among these, silica and titanium dioxide are especially preferable.

Examples of silicone oil include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether modified silicone oil, phenol-modified silicone oil, carboxyl-modified silicone oil, mercaptol-modified silicone oil, acryl-modified silicone oil, methacryl-modified silicone oil, and alpha-methylstyrene-modified silicone oil.

The average particle diameter of primary particles of the inorganic fine particles is preferably 1 to 100 nm, and preferably 3 nm to 70 nm. When the average primary particle diameter is less than 1 nm, the inorganic fine particles may be embedded into the toner, and the function of the inorganic fine particles may be ineffective; and when the average primary particle diameter is more than 100 nm, the inorganic fine particles may non-uniformly damage the surface of a photoconductor. As for the external additives, inorganic fine particles or hydrophobized inorganic fine particles may be used together. The average particle size of hydrophobized primary particles is preferably 1 nm to 100 nm, more preferably 5 nm to 70 nm. It is more preferred that the external additive contains two or more types of hydrophobilized inorganic fine particles having an average particle diameter of 20 nm or less at least one type of inorganic fine particles having an average particle diameter of 30 nm or more. In addition, the specific surface area of the inorganic fine particles is preferably 20 to 500 $m^2/g$ measured by BET method.

The amount of the external additive is preferably 0.1% to 5% by mass based on the toner, more preferably 0.3% to 3% by mass.

Some types of resin fine particles may be added as the external additive; examples thereof include such polymer particles as of polystyrenes prepared by soap-free emulsion polymerization, suspension polymerization, or dispersion polymerization; copolymers of (meth)acrylate; condensation polymers like silicone, benzoguanamine, and nylon; and thermosetting resins. Addition of these resin fine particles may improve charging ability of toner, decrease the amount of reversely charged toner, and suppress background smear. The amount of the resin fine particles is preferably 0.01% to 5% by mass based on the toner, more preferably 0.1% to 2% by mass.

Other Ingredients

The other ingredients may be properly selected depending on the application; the other ingredients are exemplified by flowability improver, cleaning improver, magnetic material, metal soap, and the like.

The flowability improver is an agent that improves the hydrophobic property of resin particles through surface treatment and is capable of preventing reduction of the flowability and/or charging ability of resin particles even under high humidity environment; examples thereof include silane coupling agents, sililating agents, silane coupling agents having a fluorinated alkyl group, organotitanate coupling agents, aluminum-based coupling agents, silicone oils, and modified silicone oils.

The cleaning improver is added to the toner to remove developers remaining on photoconductors and/or on primary transferring members after a transferring step; examples thereof include metal salts such as zinc stearate, calcium stearate, and stearic acid; polymer particles prepared by soap-free emulsion polymerization such as of polystyrene fine particles. The polymer particles are preferably of narrower particle size distribution, and the volume-average particle diameter is preferably 0.01 to 1 μm.

The magnetic material may be properly selected from conventional ones depending on the application; examples thereof include iron powder, magnetites, and ferrites. Among these, white materials are preferable in view of color tone.

Method for Producing Toner

The method for producing the toner may be properly selected from conventional methods in the art, for example, such processes are available as kneading and pulverizing processes, polymerization processes, dissolving and suspending processes, and spraying and granulating processes. Among these, kneading and pulverizing processes are particularly preferable in view of dispersing ability of releasing agents and colorants and productivity.

Kneading and Pulverizing Process

In the kneading and pulverizing process, toner materials containing at least a binder resin, a colorant, and a releasing agent are melted and kneaded, then the resulting kneaded material is pulverized and classified, thereby to produce parent particles of the toner.

In order to prepare the kneaded material, toner raw materials are mixed, and the mixture is melted and kneaded in a melting kneader. Uniaxial or two-axial-continuous kneaders or roll mill kneaders of batch type are usable as the melting kneader, for example. KTK type two-axis extruder (by Kobe Steel, Ltd.), TEM type two-axis extruder (by Toshiba Machine Co., Ltd.), two-axis extruder (by KCK; PCM type), two-axis extruder (by Ikegai, Ltd.), and Co-kneader (by Buss Co.) are usable, for example. These melting kneaders are appropriately operated under free from cutting or disconnect of molecular chains of binder resins. Specifically, the melt-kneading temperature is appropriately selected considering softening temperatures of binder resins so as to avoid excessive cutting at higher temperatures as well as insufficient dispersion at lower temperatures.

In the pulverization, the kneaded material obtained by the kneading process is pulverized. Specifically, it is preferable in the pulverization that the kneaded material is crushed and then finely pulverized. The preferable pulverizing processes are ones where the kneaded material is made collided with a collision plate in a jet stream, particles are made collided with each other, or the kneaded product is pulverized in a gap between a mechanically rotating roller and a stater.

The pulverized product is then is classified and size-controlled into a predetermined particle diameter. The classification may be performed by removing fine particles using, for example, cyclones, decanters, centrifugal separators, or the like.

Following the pulverization and classification of particles, the pulverized product is classified in an airflow using centrifugal force to produce toner base particles having predetermined particle diameters.

Subsequently, an external additive is added to the toner base particles. The toner base particles and the external additive are mixed and stirred using a mixer, and then the external additive is coated to the surface of toner base particles during pulverizing. At this time, it is important that the external additives such as the inorganic particles and the resin fine particles are uniformly and strongly adhered to the toner base particles in terms of durability.

Polymerization Method

The toner production method by the polymerization is exemplified by that toner materials containing at least a modified polyester resin able to form a urea or urethane bond and a colorant are dissolved and/or dispersed in an organic solvent. Then, the dissolved and/or dispersed solution is dispersed in an aqueous medium and subjected to polyaddition reaction. The solvent of the dispersion is removed, and the residue is washed, to thereby obtain the toner.

Examples of the modified polyester resin which may be able to form urea bonding or urethane bonding include a polyester prepolymer having an isocyanate group, which is resulted from a carboxylic acid group and a hydrogen group in the polyester end is reacted with a polyisocyanate compound (PIC). The modified polyester resin is obtained through cross-linking and/or elongation reaction of molecular chains by the reaction between a polyester prepolymer having an isocyanate group and amines. The modified polyester resin can make the hot-offset property better with maintaining the low-temperature fixability.

Examples of the polyisocyanate (PIC) include aliphatic polyisocyanates such as tetramethylene diisocyanate, hexamethylene diisocyanate, and 2,6-diisocyanato methyl caproate; alicyclic polyisocyanates such as isophorone diisocyanate, and cyclohexyl methane diisocyanate; aromatic diisocyanates such as tolylene diisocyanate and diphenylmethane diisocyanate; aromatic-aliphatic diisocyanates such as α,α,α',α'-tetramethylxylene diisocyanate; isocyanurates; polyisocyanates blocked with phenol derivatives, oxime, or caprolactam. These may be used alone or in combination.

The ratio of the polyisocyanate (PIC) is, defined as an equivalent ratio [NCO]/[OH] of isocyanate [NCO] to hydroxyl group [OH] of the polyester having a hydroxyl group, preferably 5/1 to 1/1, more preferably 4/1 to 1.2/1, and still more preferably 2.5/1 to 1.5/1.

The number of isocyanate group included in one molecule of polyester prepolymer having an isocyanate group (A) is usually one or more, preferably 1.5 to 3 on an average, and more preferably 1.8 to 2.5 on an average.

Examples of the amines (B) to be reacted with a polyester prepolymer (A) include divalent amine compounds (B1), polyamine compounds with three or more valences (B2), amino alcohols (B3), amino mercaptans (B4), amino acids (B5) and components in which an amino group of B1 to B5 is blocked (B6).

Examples of the divalent amine compound (B1) include aromatic diamines such as phenylene diamine, diethyltoluene diamine, and 4,4'-diaminodiphenylmethane; alicyclic diamines such as 4,4'-diamino-3,3'-dimethyldicyclohexylmethane, diamine cyclohexane and isophorone diamine; and aliphatic diamines such as ethylene diamine, tetramethylene diamine, and hexamethylene diamine.

Examples of the polyamine compounds with three or more valences (B2) include diethylenetriamine and triethylenetetramine. Examples of the amino alcohol (B3) include ethanolamine and hydroxyethylaniline. Examples of the amino mercaptan (B4) include aminomethyl mercaptan and aminopropyl mercaptan. Examples of the amino acid (B5) include aminopropionic acid and aminocaproic acid.

Examples of the component in which an amino group of B1 to B5 is blocked (B6) include ketimine compounds obtained from the amines B1 to B5 and ketones such as acetone, methyl ethyl ketone and methyl isobutyl ketone; and an oxazolidine compound. Among these amines (B), B1 and a mixture of B1 with a small amount of B2 are preferable.

The ratio of the amines (B) is, defined as an equivalent ratio [NCO]/[$NH_x$] of an isocyanate [NCO] in the polyester prepolymer having an isocyanate group (A) to an amino group [$NH_x$] in the amines (B), preferably 1/2 to 2/1, more preferably 1.5/1 to 1/1.5, and still more preferably 1.2/1 to 1/1.2.

With the toner production method of the above polymerization, a spherical shaped toner having a small particle diameter may be prepared at lower-cost with less environmental load.

The coloration of the toner may be properly selected depending on the application; for example, the coloration may be at least one selected from black, cyan, magenta, and yellow. Each color toner is obtained by appropriately selecting the colorant, and it is preferably a color toner.

The mass average particle diameter of the toner is 3 to 8 μm, preferably 4 to 7 μm, more preferably 5 to 6 μm. The range of the mass average particle diameter may lead to excellent reproducibility even for fine dots of latent images. When the mass average particle diameter is less than 3 μm, flowability of the toner may be poor even if the reproducibility may be excellent, and when the mass average particle diameter is more than 8 μm, the tendency to decrease the dot reproducibility may be remarkable.

In the toner according to the present invention, the content of particles having a particle diameter of no more than 5 μm is 60% to 90% by number, preferably 60% to 80% by number, more preferably 60% to 70% by number. When the content of particles is within the range, the fine particles make smooth the edge portions of images, thus high quality images can be taken with superiority in graininess, sharpness, and thin line reproducibility. When the content of particles having a particle diameter of no more than 5 μm is below 60% by number, the image quality may degrade, and when the content is above 90% by number, flowability and transferability of the toner may degrade.

The particle diameter distribution of the toner may be expressed in terms of the ratio $D_4$/Dn, in which $D_4$ is a mass average particle diameter and Dn is a number average particle diameter. The particle size distribution $D_4$/Dn of toners is preferably 1.65 to 2.00, more preferably 1.70 to 1.90. When the content of particles with smaller particle diameters is higher in toners, the image quality may be excellent, however, flowability and transferability of toners tends to degrade, thus the inventive toner has a particle diameter distribution with an adequate broadness so as to suppress the degradation of flowability and transferability.

The mass average particle diameter ($D_4$) and the particle diameter distribution ($D_4/Dn$) of toners, and the content of particles having a particle diameter of no more than 5 μm can be measured, for example, as follows:

Measuring instrument: Coulter Multisizer III (by Beckman Coulter Co.)

Aperture diameter: 100 μm

Analysis Software: Beckman Coulter Multisizer 3 version 3.51 (by Beckman Coulter Co.)

Electrolyte: Isoton III (by Beckman Coulter Co.)

Dispersion liquid: 10% by mass surfactant (alkylbenzene sulfonate, Neogen SC-A, Dai-ichi Kogyo Seiyaku Co.)

Dispersion condition: 10 mg of a test sample is added to 5 ml of the dispersion liquid, the mixture is dispersed by an ultrasonic-dispersing device, followed by adding 25 ml of the electrolyte and dispersing further for one minute using the ultrasonic-dispersing device.

Measuring condition: 100 ml of the electrolyte and the dispersion liquid are added to a beaker, then about 30000 particles are measured at a concentration capable of measuring for 20 seconds, thereby the mass average particle diameter ($D_4$), the particle diameter distribution ($D_4/Dn$), and the content of particles having a particle diameter of no more than 5 μm can be measured from the particle diameter distribution.

Developer

The developer according to the present invention in the first aspect contains the inventive toner described above and appropriately selected other ingredients such as carriers.

The developer may be either of one-component or two-component; when it is applied to high-speed printers that support increasing information processing rates of recent years, two-component developers are preferable in view of achieving excellent shelf life.

In the case of one-component developers containing the toners of the present invention, the variations in the toner particle diameter are minimized even after consumption or addition of toner, and toner filming to a developing roller and toner adhesion to members such as a blade to reduce layer thickness of the toner are prevented. Thus, it is possible to provide excellent and stable developing properties and images even after a long usage of the developing unit, i.e. after long time agitation of developer. Meanwhile, in the case of two-component developers containing the toners of the present invention, even after many cycles of consumption and addition of toner, the variations in the toner particle diameter are minimized and, even after a long-time agitation of the developer in the developing unit, excellent and stable developing properties may be obtained.

Carrier

The carrier may be properly selected depending on the application, preferably, is one having a core material and a resin layer coating the core material.

The material for the core may be properly selected from conventional ones; preferable examples thereof include materials based on manganese-strontium (Mn—Sr) of 50 emu/g to 90 emu/g and materials based on manganese-magnesium (Mn—Mg) are preferable. From the standpoint of securing image density, high magnetizing materials such as iron powder (100 emu/g or more) and magnetite (75 to 120 emu/g) are preferable. In addition, weak magnetizing materials such as copper-zinc (Cu—Zn) based materials (30 to 80 emu/g) are preferable from the standpoint for achieving higher-grade images by reducing the contact pressure against the photoconductor having standing toner particles. These materials may be used singly or in combination.

The particle diameter of the core material, in terms of volume-average particle diameter ($D_{50}$), is preferably 10 to 200 μm, more preferably 40 μm to 100 μm. In cases where the average particle diameter (volume-average particle diameter ($D_{50}$)) is less than 10 μm, fine particles make up a large proportion of the carrier particle distribution, causing carrier scattering due to reduced magnetization per particle in some cases, on the other hand, and in cases where it exceeds 200 μm, the specific surface area of the particle decreases, causing toner scatterings and reducing the reproducibility of images, particularly in full-color images with many solid images.

Materials for the resin layer may be properly selected from conventional ones depending on the application; examples thereof include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomers, copolymers of vinylidene fluoride and vinyl fluoride, fluoroterpolymers such as terpolymers of tetrafluoroethylene, vinylidene fluoride and non-fluoride monomers, and silicone resins. These resins may be used singly or in combination. Among these, silicone resins are preferable in particular.

The silicone resin may be properly selected from conventional ones depending on the application; examples thereof include straight silicone resins comprising only an organosiloxane bond, and silicone resins which are modified with alkyd resins, polyester resins, epoxy resins, acrylic resins, and urethane resins.

As for the silicone resin, commercially available ones may be used; examples of the straight silicone resins include KR271, KR255, and KR152 (by Shin-Etsu Chemical Co.); and SR2400, SR2406, and SR2410 (by Toray Dow Corning Co.).

As for the modified silicone resins, commercially available ones may be used; examples thereof include KR206 which is modified with an alkyd resin, KR5208 which is modified with an acrylic resin, ES1001N which is modified with an epoxy resin, KR305 which is modified with a urethane resin (by Shin-Etsu Chemical Co.); and SR2115 which is modified with an epoxy resin, and SR2110 which is modified with an alkyd resin (by Toray Dow Corning Co.).

Each of these silicone resins may be used alone or may be used in combination with ingredients capable of cross-linking therewith, controlling the charge amount, or the like.

Electroconductive powder may be incorporated into the resin layer as required. Examples of the electroconductive powder are metal powders, carbon black, titanium oxide, tin oxide, zinc oxide, and the like. It is preferable that the average particle diameter of these electroconductive powders is 1 μm or less. When the average particle diameter is more than 1 μm, control of electric resistance may be difficult.

The resin layer may be formed by dissolving a resin such as a silicon resin in a solvent to prepare a solution and applying the solution uniformly on a surface of the core material by way of conventional processes. The application process may be dipping, spraying, or brushing processes.

The solvent may be selected appropriately depending on the application; examples thereof include toluene, xylene, methylethylketone, methylisobutylketone, cellosolve, butyl acetate, and the like.

The baking process may be by external or internal heating; the baking process is exemplified by those using fixed electric furnaces, fluid electric furnaces, rotary electric furnaces, burner furnaces, those using microwaves, and the like.

The amount of the resin in the carrier is preferably 0.01% to 5.0% by mass. When the amount of the resin is less than 0.01% by mass, the resin layer may be formed non-uniformly on the surface of the core material, and when the amount of the resin is more than 5.0% by mass, the resin layer becomes excessively thick, and there tends to arise a carrier granulation, thus uniform carrier particles may not be prepared.

When the developer is a two-component developer, the carrier content in the two-component developer may be properly selected depending on the application; for example, the content is preferably 90% to 98% by mass, more preferably 93% to 97% by mass.

The mixing ratio of the carrier and the toner in the two-component developer is typically 1.0 to 10.0 parts by mass of the toner based on 100 parts by mass of the carrier.

Developer

The developer according to the present invention in the second aspect contains a toner, a carrier, and other optional ingredients.

The toner, which may be similar as the inventive toner described above, specifically contains at least a binder resin, a releasing agent, and a colorant;

the binder resin comprises a polyester resin (A) having a softening temperature Tm(A) from no lower than 120° C. to no higher than 160° C. and a polyester resin (B) having a softening temperature Tm(B) from no lower than 80° C. to lower than 120° C., at least one of the polyester resins (A) and (B) is prepared by condensation polymerization between an alcohol component and a carboxylic acid component, and the alcohol component comprises divalent alcohol of 1,2-propanediol in a content of no less than 65% by mole and is substantially comprised of aliphatic alcohol.

Carrier

The carrier contains a core material, a coating layer that coats the surface of the core material, and other optional ingredients. The core material may be the same as those of the first aspect described above.

Coating Layer

The coating layer comprises a condensation product between an N-alkoxyalkylated benzoguanamine resin and a resin capable of reacting with the N-alkoxyalkylated benzoguanamine resin, fine particles of inorganic oxide, and other optional ingredients.

The N-alkoxyalkylated benzoguanamine resin is preferably various alkylol melamines, represented by tetramethylolbenzoguanamine, and derivatives thereof since high film strength and high charge amount can be simultaneously obtained. Among these, tetrabutoxy benzoguanamine is particular preferable due to very excellent charge amount under variable temperature and humidity.

The resin capable of reacting with the N-alkoxyalkylated benzoguanamine resin is exemplified by silicone resins having at least one of a silanol group and hydrolyzable groups. Among these, methyl silicone resins having a silanol group are particularly preferable. Examples of the hydrolyzable groups include alkoxy groups such as methoxy group and ethoxy group, ester groups, and hydroxyl group.

The N-alkoxyalkylated benzoguanamine resin may be mixed and dissolved, for example, with a silicone resin having a silanol group and an optional catalyst to promote the cross-linking to prepare a coating liquid, then the coating liquid is coated on the surface of core material to dry and to heat-cure, thereby to form a coating film. The N-alkoxyalkylated benzoguanamine resin may also be used through being mixed with one or more species of resins having a hydroxyl group.

The resin ingredients within the coating layer are the condensation product of the N-alkoxyalkylated benzoguanamine resin and the resin capable of reacting with the N-alkoxyalkylated benzoguanamine resin; the other resins may be used together as required by appropriately selecting from conventional resins. Preferable resins are exemplified by resins having a hydroxyl group to condensate with benzoguanamine, in particular. Specific examples of the resins are acrylic resins, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomers, copolymers of vinylidene fluoride and vinyl fluoride, fluoroterpolymers such as terpolymers of tetrafluoroethylene, vinylidene fluoride and non-fluoride monomers, and modified products thereof. These resins may be used singly or in combination.

When the carrier contains fine particles of inorganic oxide within the coating layer, the film strength may be further enhanced.

The fine particles of inorganic oxide may be properly selected depending on the application; examples thereof include silica, alumina, titanium oxide, iron oxide, copper oxide, zinc oxide, tin oxide, chromium oxide, cerium oxide, magnesium oxide, and zirconium oxide. These may be used alone or in combination. Among these, silica, alumina, and titanium oxide are preferable in particular.

The fine particles of inorganic oxide may be or not be surface-treated for hydrophobic property etc. The content of the fine particles of inorganic oxide is preferably 2% to 70% by mass within the coating layer, more preferably 5% to 40% by mass.

Electroconductive powders may be incorporated into the coating layer as required. Examples of the electroconductive powders are metal powders, carbon black, titanium oxide, tin oxide, zinc oxide, and the like. Among these, carbon black is particularly preferable. It is preferable that average particle diameter of these electroconductive powders is 1 μm or less. When the average particle diameter is more than 1 μm, control of electric resistance may be difficult.

The coating layer may be formed, for example, by dissolving the N-alkoxyalkylated benzoguanamine resin into a non-aqueous solvent while heating as required to prepare a solution; mixing the fine particles of inorganic oxide into the solution and dispersing uniformly by use of dispersing devices such as homogenizers to prepare a dispersion; preparing separately another non-aqueous solvent solution of a silanol-condensable silicone resin, to which mixing the dispersion and dispersing similarly by use of dispersing devices such as homogenizers; optionally, mixing a charge control agent, resistance adjuster, etc. to prepare a coating liquid; coating the coating liquid onto the surface of the core material by way of conventional processes, and drying followed by baking. The coating process may be properly selected from conventional ones; examples thereof are dipping, spraying, or brushing processes.

The solvent may be selected appropriately depending on the application; examples thereof include toluene, xylene, methylethylketone, methylisobutylketone, cellosolve, butyl acetate, and the like.

The baking process, which being properly selected depending on the application, may be by external or internal heating; the baking process is exemplified by processes using fixed electric furnaces, fluid electric furnaces, rotary electric furnaces, burner furnaces, processes using microwaves, and the like.

The amount of the coating layer in the carrier is preferably 0.01% to 5.0% by mass. When the amount of the coating layer is less than 0.01% by mass, the coating layer may be formed non-uniformly on the surface of the core material, and when the amount of the coating layer is more than 5.0% by mass, the coating layer becomes excessively thick, and there tends to arise a carrier granulation, thus uniform carrier particles may not be prepared.

It is preferred that the content of particles having a particle diameter of smaller than 42 μm is no less than 70% by mass and magnetic moment is no less than 76 emu/g at 1 kOe. When the content of particles having a particle diameter of smaller than 42 μm is more than 70% by mass, uneven images, in particular, streak-like brush marks tend to appear significantly on images. When writing density of images is above 600 dpi (minimum dot diameter: 42 μm), the size of minimum dot diameter is similar with carrier diameter, therefore, the particle diameter is required to be smaller.

On the other hand, the smaller is the carrier diameter, the smaller is the magnetic moment per one particle of carrier, thus there arise such problems as carrier scattering, carrier development (deposition) on image or non-image portions. In order to prevent these problems, the magnetic moment of carrier is preferably no less than 76 emu/g.

The content of carrier in the developer may be properly selected depending on the application; preferably, the content is 90% to 98% by mass, more preferably 93% to 97% by mass.

The mixing ratio of the toner to the carrier is preferably 1 to 10.0 parts by mass of the toner based on 100 parts by mass of the carrier.

Image Forming Apparatus and Image Forming Method

The image forming apparatus of the present invention comprises a latent electrostatic image bearing member, a charging unit, an exposing unit, a developing unit, a transfer unit, and a fixing unit, and also other units such as a cleaning unit, a discharging unit, a recycling unit, and a controlling unit as required. In some cases, the charging unit and the exposing unit are collectively referred to as a "latent electrostatic image forming unit".

The image forming method of the present invention comprises a charging step, an exposing step, a developing step, a transfer step, and a fixing step, and also other steps such as a cleaning step, a discharging step, a recycling step, and a controlling step as required. In some cases, the charging unit and the exposing unit are collectively referred to as a "latent electrostatic image forming step".

The image forming method of the present invention can be preferably carried out by the image forming apparatus of the present invention; the charging step can be preferably carried out by the charging unit; the exposing step can be preferably carried out by the exposing unit; the developing step can be preferably carried out by the developing unit; the transfer step can be preferably carried out by the transfer unit; the fixing step can be preferably carried out by the fixing unit; the cleaning step can be preferably carried out by the cleaning unit; and the other steps can be preferably carried out by the other units.

Latent Electrostatic Image Bearing Member

The latent electrostatic image bearing member may be properly selected in terms of material, shape, configuration, size, etc.; the shape may be of drum, sheet, or endless belt; the configuration may be of mono-layer or multi-layer; the size may be properly selected depending on the type and specification of the image forming apparatus. The materials thereof are, for example, inorganic photoconductors such as of amorphous silicon, selenium, CdS, and ZnO, organic photoconductors (OPC) such as polysilane and phthalopolymethine, and the like.

The amorphous silicon photoconductor is formed, for example, by heating a substrate at 50° C. to 400° C., and forming a photoconductive layer on the substrate by depositing a-Si in accordance with a film formation method such as vapor deposition, sputtering, ion plating, thermal-CVD, photo-CVD, and plasma-CVD methods. Among these methods, the plasma-CVD method is preferable, where an a-Si deposition layer is formed on the substrate by decomposing a source gas with DC, or high-frequency or microwave glow discharge.

The organic photoconductors (OPC) have been conventionally utilized as the image-bearing member due to such reasons as (1) optical properties including wide wavelength band of optical absorption and large amount of light absorption; (2) electric properties including high-sensitive and stable charge property; (3) wide selection of material; (4) easy production; (5) low cost; and (6) non-toxicity. The layer structure of the organic photoconductor is classified broadly into a single-layered structure, and a laminated structure.

The photoconductors of the single-layered structure contains a substrate, a single-layered photosensitive layer on the substrate, and further contains a protective layer, an intermediate layer and other layers as necessary. The photoconductors of the laminated structure contain a substrate, a laminated photosensitive layer having at least a charge generating layer, and a charge transport layer in this order, and further contains a protective layer, an intermediate layer and other layers as necessary.

Charging Step and Charging Unit

The charging step is one where the surface of latent electrostatic image bearing member is charged and is carried out by the charging unit.

The charging unit may be appropriately selected according to the purpose as long as capable of charging uniformly the surface of the latent electrostatic image bearing member by applying a voltage. There are two types of charging units, i.e. (1) charging unit of contact type configured to contact and charge the image bearing member and (2) charging unit of non-contact type configured to charge the latent electrostatic image bearing member without contacting.

Charging Unit of Contact Type

Examples of (1) the contact charging unit include conductive or semiconductive charging rollers, magnetic brushes, fur brushes, films, and rubber blades. Among these, the charging roller can significantly reduce the amount of generated ozone compared with corona discharges, and is excellent in stability when latent electrostatic image bearing member are repeatedly used, and is effective to prevent deterioration of image quality.

The magnetic brush is typically made from a nonmagnetic conductive sleeve that supports various ferrite particles such as of Zn—Cu ferrite and a magnetic roll inserted into the sleeve. The fur brush is typically constructed by way of winding or laminating a fur, having been made conductive using carbon, cupper sulfide, metals or metal oxides, onto a core metal.

FIG. 1 is a schematic cross-section that exemplarily shows a charging roller. The charging roller 310 has a core metal 311 of a cylindrical conductive support, conductivity-adjusting layer 312 around outer surface of the core metal 311, and a protective layer 313 to coat and to protect leak of the conductivity-adjusting layer 312.

The conductivity-adjusting layer 312 may be formed by extrusion molding or injection molding a thermoplastic resin composition, which containing a thermoplastic resin and an ion conductive polymer, around the surface of the core metal 311.

The volume resistivity of the conductivity-adjusting layer 312 is preferably $10^6$ to $10^9$ ohm·cm. The volume resistivity above $10^9$ ohm·cm may make impossible for the photoconductor drum to take a charged voltage sufficient for uniform images due to insufficient charge amount, and the volume resistivity below $10^6$ ohm·cm may possibly generate leak toward the entire photoconductor drums.

The thermoplastic resin, which being utilized in the conductivity-adjusting layer 312, may be properly selected depending on the application; examples of the resin include polyethylene (PE), polypropylene (PP), polymethylmethacrylate (PMMA), polystyrene (PS), and PS copolymers such as AS and ABS.

The ion conductive polymer may be those having a specific resistivity of about $10^6$ to $10^{10}$ ohm·cm and capable of reducing the resistivity of the resins; examples thereof are compounds having a constituent of polyether ester amide. In order to achieve the resistivity of the conductivity-adjusting layer 312 within the range described above, the amount of the ion conductive polymer is preferably 30 to 70 parts by mass based on 100 parts by mass of the thermoplastic resin.

The ion conductive polymer may be a polymer containing a quaternary ammonium base. The polymer containing a quaternary ammonium base is exemplified by polyolefins containing a quaternary ammonium base. In order to achieve the resistivity of the conductivity-adjusting layer 312 within the range described above, the amount of the polyolefin is preferably 10 to 40 parts by mass based on 100 parts by mass of the thermoplastic resin.

The ion conductive polymer may be dispersed into the thermoplastic resin by use of twin-axis mixers or kneaders. The ion conductive polymer may be uniformly dispersed into the thermoplastic resin in a molecular order, thus resistivity fluctuation scarcely generates in the conductivity-adjusting layer 312 due to inferior dispersion contrary to conductivity-adjusting layers in which conductive pigments being dispersed. The ion conductive polymer, by virtue of a polymer compound, is dispersed and fixed within the thermoplastic resin composition and thus is unlikely to bleed out.

The protective layer 313 is designed to have a resistivity higher than that of the conductivity-adjusting layer 312, by which leak into defective portions of photoconductor drum may be avoided. In cases where the resistivity of the protective layer 313 is excessively high, the charging efficiency tends to be decreased, thus it is preferred that the difference of the resistivities is no more than $10^3$ ohm·cm between the protective layer 313 and the conductivity-adjusting layer 312.

The material of the protective layer 313 is preferably resin materials in view of proper film-formability. The resin materials are preferably fluorocarbon resins, polyamide resins, polyester resins, and polyvinylacetal resins due to excellent non-tackiness in view of preventing toner deposition. The resin materials are typically electrically insulative, thus the property of charging rollers is unsatisfactory when the protective layers 313 is formed from the resin material itself. Therefore, the resistivity of the protective layer 313 is adjusted by dispersing various electrically conductive agents into the resin material. A reactive hardener such as of isocyanate may be optionally included into the resin material in order to enhance the adhesion between the protective layers 313 and the conductivity-adjusting layer 312.

The charging roller 310 is connected to a power source to apply a predetermined voltage. The voltage may be of direct current voltage (DC), more preferably DC superimposed with an alternating current voltage (AC). Such application of AC voltage may bring about more uniformly charged surfaces of photoconductor drums.

Figure 2:
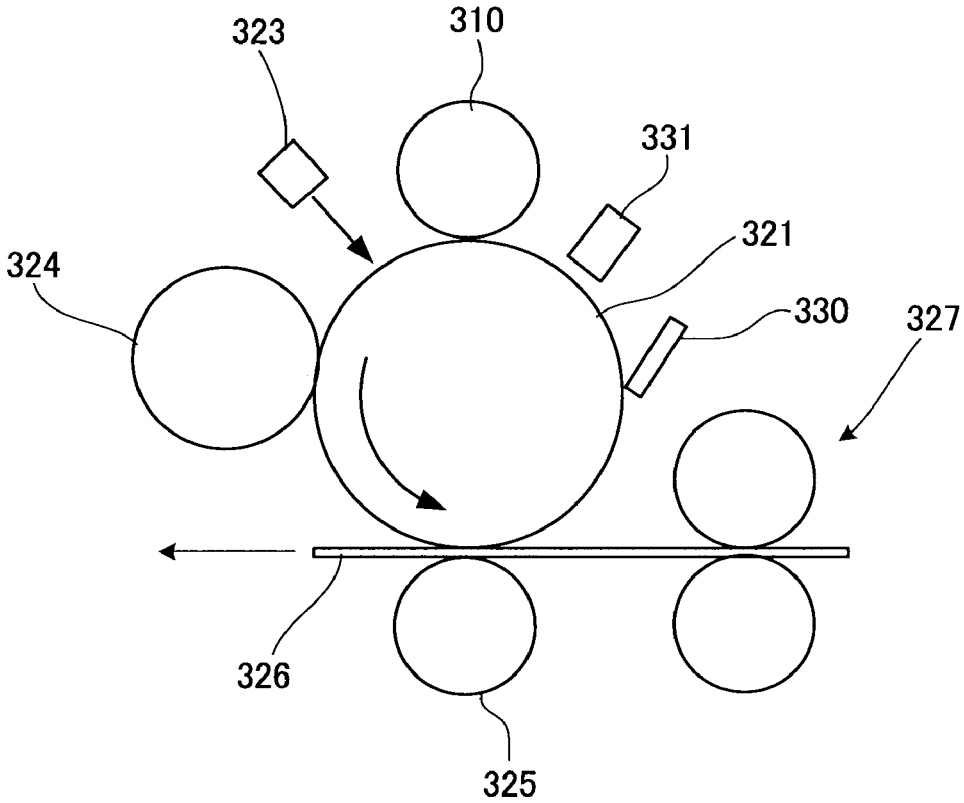
FIG. 2 is a schematic view that exemplarily shows an inventive image forming apparatus equipped with a charging roller of contacting type.

FIG. 2 is a schematic view that exemplarily shows an image forming apparatus equipped with a charging roller 310 of contacting type as shown in FIG. 1. As shown in FIG. 2, a charging unit 310 configured to charge the surface of the photoconductor, an exposing unit 323 configured to expose the charged surface of the photoconductor, a developing unit 324 configured to develop a visible image from the electrostatic latent image by use of a toner, a transferring unit 325 configured to transfer the visible image onto a recording medium, a fixing unit 327 configured to fix the transferred image on the recording medium, a cleaning unit 330 configured to remove the residual toner on the photoconductor, and a charge eliminating unit 331 configured to eliminate the residual toner on the photoconductor drum are disposed in order around the photoconductor drum 321 as a latent electrostatic image bearing member. The charging roller 310 of contact-type as shown in FIG. 1 is disposed as the charging unit 310, by which the surface of the photoconductor drum 321 is uniformly charged.

Charging Unit of Non-Contact Type

The charging unit (2) of non-contact type described above may be non-contact chargers, needle electrode devices, solid discharging elements on the basis of corona discharge, or conductive or semiconductive charging rollers disposed with a small clearance from the photoconductor.

The corona discharge may be useful as a non-contact charging means in which positive or negative ions generated by corona discharge in air atmosphere is applied to surface of photoconductors. There exist coroton chargers where a certain amount of electric charge is applied on photoconductors and scoroton chargers where a certain voltage is applied on photoconductors.

The coroton chargers are constructed from a casing electrode that occupies about half space around a charging wire which is disposed almost at the center of the casing electrode.

The scoroton chargers are constructed by adding a grid electrode to the coroton charger. The grid electrode is typically disposed at a site of 1.0 to 2.0 mm from a surface of photoconductors.

Figure 3:
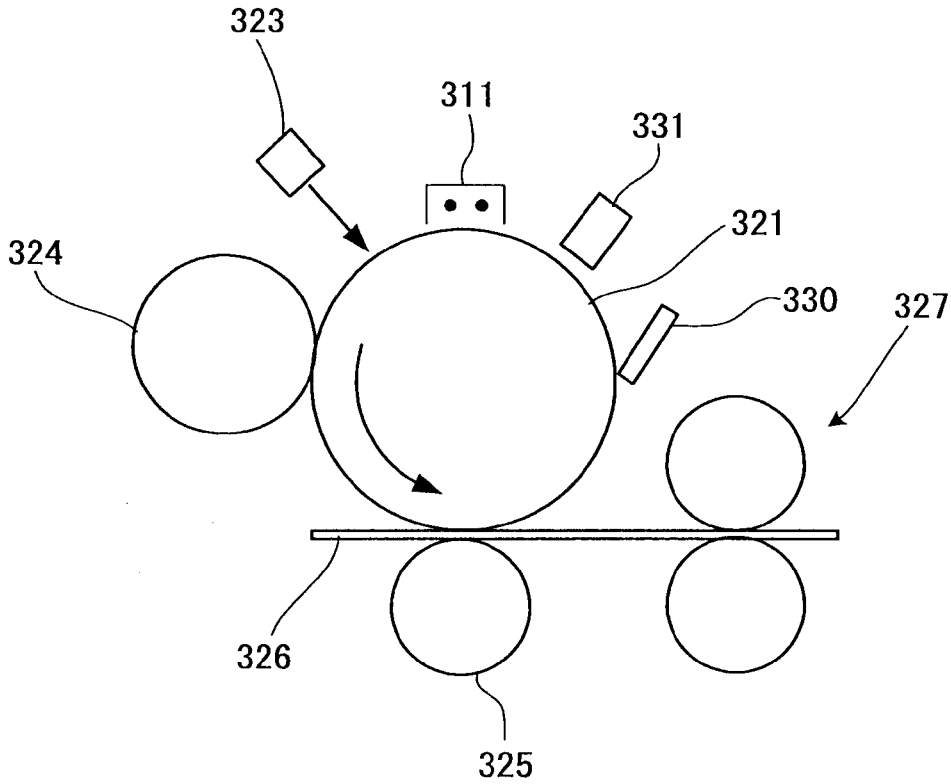
FIG. 3 is a schematic view that exemplarily shows an inventive image forming apparatus equipped with a corona charger of non-contacting type.

FIG. 3 is a schematic view that exemplarily shows an image forming apparatus equipped with a corona charger of non-contacting type. The reference numbers in FIG. 3 are the same as those of FIG. 2 when indicating the similar ones.

The charging unit, which being a corona charger 311 of non-contact type, charges uniformly the surface of photoconductor drum 321.

The charging roller, having a small clearance from the photoconductor, is improved on the basis of previous charging rollers as described above so as to take a small gap from the photoconductor. The small gap is preferably 10 to 200 μm, more preferably 10 to 100 μm.

Figure 4:
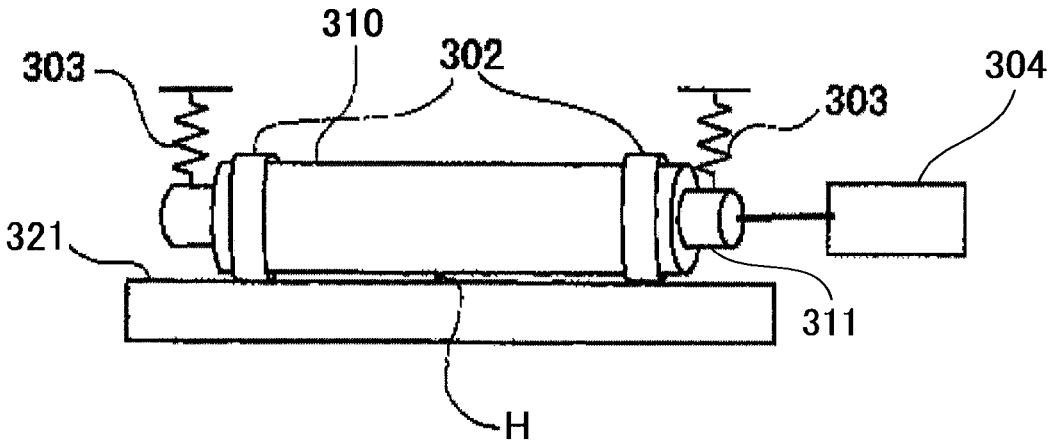
FIG. 4 is a schematic view that exemplarily shows a charging roller of non-contacting type applied to an inventive image forming apparatus.

FIG. 4 is a schematic view that exemplarily shows a charging roller of non-contacting type. The charging roller shown in FIG. 4 is disposed to have a small gap H from the photoconductor drum 321. The small gap H may be arranged by way that a spacer material is winded to a certain thickness at both ends of the charging roller 310 and then the surface of the spacer material is made contact with the surface of photoconductor drum 321. In FIG. 4, a power source 304 appears.

In the construction of FIG. 4, film 302 is winded as a spacer material at both ends of the charging roller 310. The spacer 302 is made contact with photoconductive surface of a photoconductor, thereby producing a certain small gap H between the charging roller and an image region of the photoconductor. As a bias, an AC superimposed voltage is applied and the photoconductor is charged by electric discharge at the small gap H between the charging roller and the photoconductor. The spring 303, which pressing the axis 311 of the charging roller as shown in FIG. 4, may increase the dimensional accuracy of the small gap H.

The spacer member formed of the spacer material may be formed integrally with the charging roller. In such a case, at least the surface of the gap portion is made insulative, thereby discharge at the gap portion may be avoided, thereby such a problem may be prevented that discharge product deposits at the gap portion, toner adheres firmly at the gap portion due to tackiness of the discharge product, and the gap is widened.

The spacer material may be a heat-shrinkable tube such as SUMI tube for 105° C. (article name: F105, by Sumitomo Chemical Co.).

Exposing Step and Exposing Unit

The exposing step is carried out to expose the charged surface of the photoconductor by use of the exposing unit.

The exposing may be carried out, for example, by irradiating imagewise the surface of photoconductors by use of the exposing unit.

The optical systems for the exposing may be classified into analogue optical systems and digital optical systems. The analogue optical systems are those projecting directly an original image onto photoconductors by use of an optical system, and the digital optical systems are those where image information is input as electric signals, which is then converted into optical signals and photoconductors are exposed to form images.

The exposing unit may be properly selected as long as capable of exposing imagewise on the surface of photoconductors charged by charging units; examples of the exposing unit include various irradiating systems such as optical copy systems, rod-lens-eye systems, optical laser systems, optical liquid crystal shatter systems, and LED optical systems. In the present invention, a backlight system may be applied for the exposure, in which the exposure is carried out imagewise from back side of photoconductors.

Developing Step and Developing Unit

In the developing unit, latent electrostatic images are developed to form visual images by use of toners or developers. The visible images may be formed, for example, by developing latent electrostatic images using toners or developers, which being carried out by the developing unit.

The developing unit may be conventional ones as long as capable of developing by use of toners or developers, preferable example is ones containing toners or developers and having a developing unit to apply in contact or non-contact manner the toners or developers to the latent electrostatic images.

The developing unit may be of dry type or wet type, and may be a monochrome developing or multi-color developing unit. For example, such a member is preferable that comprises a stirrer that charges the toner or developer by friction stirring, and a rotatable magnet roller.

In the developing unit, for example, the toner and the carrier are mixed and stirred; the toner is thereby charged by friction and sustained in a condition of standing rice ears, and forms a magnetic brush on the surface of the rotating magnet roller. Since the magnet roller is arranged near the photoconductor, part of the toner in the magnetic brush formed on the surface of this magnet roller moves to the surface of the photoconductor due to the force of electrical attraction. As a result, this toner develops a latent electrostatic image, and a visible toner image is formed on the surface of the photoconductor.

The developer housed in the developing unit is the developer containing the toner; the developer may be one-component or two-component developer.

One Component Developing Unit

One component developing devices are preferably employed for the one component developing unit that has a developer bearing member to which toner is supplied and a layer-thickness controlling member that provides a thin layer of toner on the developer bearing member.

Figure 5:
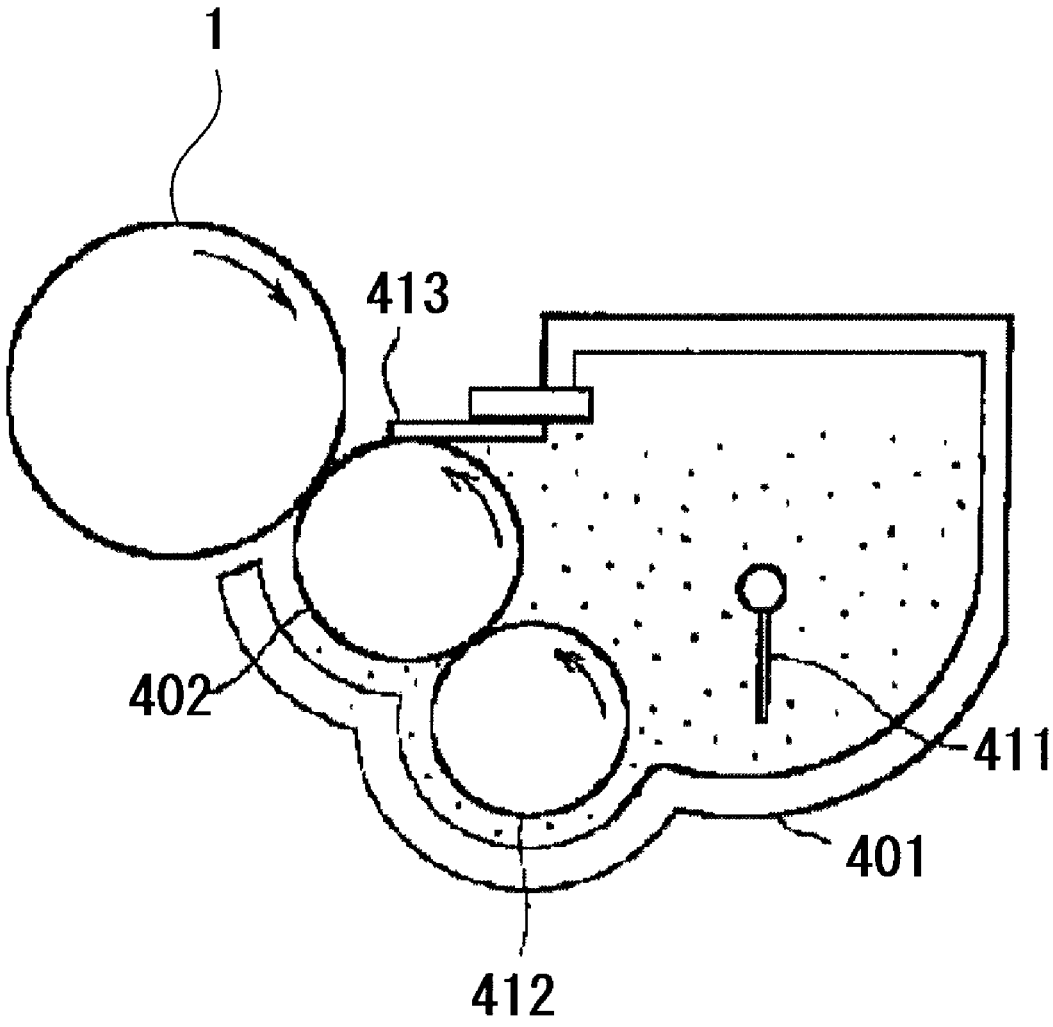
FIG. 5 is a schematic view that exemplarily shows a one-component developing unit applied to an inventive image forming apparatus.

FIG. 5 is a schematic view that exemplarily shows a one-component developing unit. In the one-component developing unit, one component developer of toner is employed, a toner layer is formed on a developing roller 402 of a developer bearing member, the toner layer on the developing roller 402 is conveyed while contacting with a photoconductor drum 1 of a latent electrostatic image bearing member, thereby latent electrostatic images are developed on the photoconductor drum 1.

As shown in FIG. 5, the toner in the casing 401 is stirred by rotating action of the agitator 411, and supplied mechanically to the supplying roller 412 of a toner supplying member. The supplying roller 412 is formed from flexible foamed polyurethane etc., and has a configuration with a cell diameter of 50 to 500 μm to easily sustain toners. The supplying roller has a relatively low JIS-A hardness of 10° to 30°, and may contact uniformly with the developing roller 402.

The supplying roller 412 and the developing roller 402 are rotated in a same direction, i.e. the both surfaces of the both rollers rotate oppositely at the facing portion. The ratio of liner velocity is preferably 0.5 to 1.5 between the supplying roller and the developing roller. In addition, the supplying roller 412 may be rotated in the reverse direction with that of the developing roller 402, i.e. the both surfaces of the both rollers may rotate reversely at the facing portion. In this embodiment, the supplying roller 412 rotated in the same direction as the developing roller 402 and the ratio of liner velocity is adjusted to 0.9. The biting level of the supplying roller 412 onto the developing roller 402 is adjusted to 0.5 to 1.5 mm. When the effective width of the unit is 240 mm (longitudinal length of A4 size) in this embodiment, the torque is required in a range of 14.7 to 24.5 N·cm.

The developing roller 402 is formed from a surface layer of a rubber material on an electroconductive substrate, the diameter is 10 to 30 mm, and the surface roughness Rz is adjusted to 1 to 4 μm by way of properly roughening the surface. The level of the surface roughness Rz is preferably 13% to 80% of the average particle diameter of the toner, thereby the toner may be conveyed without embedding into the surface of the developing roller 402. It is preferable in particular that the surface roughness Rz is 20% to 30% of the average particle diameter of the toner so as not to unduly sustain the toner.

The rubber material may be exemplified by silicone rubber, butadiene runner, NBR rubber, hydrin rubber, and EPDM rubber. It is also preferred that a coating layer is disposed on the surface of the developing roller 402 in order to stabilize quality with time. The material of the coating layer is exemplified by silicone material and Teflon® material. The silicone material is superior in charging property of toner; the Teflon® material is superior in releasing ability. An electroconductive material such as carbon black may also be appropriately included in order to afford electric conductivity. The thickness of the coating layer is preferably 5 to 50 μm. The level outside this range may suffer from cracking etc.

The toner, on or inside the supplying roller 412, having a certain polarity (negative polarity in this embodiment) is sustained on the developing roller 402, when inserted between the supplying roller 412 and the developing roller 402 while rotating, by action of electrostatic force due to negative charge caused by a frictional electrification effect and a conveying effect due to surface roughness of the developing roller 402. In this stage, however, the toner layer is considerably excessive rather than uniform on the developing roller 402 (1 to 3 mg/cm$^2$). Therefore, a regulating blade 413 as a layer thickness-controlling member is made contact with the developing roller 402, thereby forming a toner-thin layer with a uniform layer thickness on the developing roller 402. The regulating blade 413 has a tip pointing the downstream of the rotating direction of the developing roller 402 and the central portion of the regulating blade 413 contacts with the developing roller 402 in a so-called body touching manner. The contacting direction may be reversed, or the touching manner may be at the edge.

It is preferred that the material of the regulating blade 413 is metal such as SUS304 and the thickness is 0.1 to 0.15 mm. Materials other than metal may be available, such as rubber materials like polyurethane runner of 1 to 2 mm thick and relatively hard resin materials such as silicone resin. Various materials may be made into low-resistance by way of incorporating carbon black etc., thus an electric field may be applied between the regulating blade 413 and the developing roller 402 through connecting a bias electric source.

The regulating blade 413 as the layer thickness-controlling member preferably has a free edge length of 10 to 15 mm from the holder. In cases where the free edge length is above 15 mm, the developing unit is unduly large to make compact the image forming apparatus, and in cases where the free edge length is below 10 mm, vibration tends to generate when the regulating blade 413 contacts with the surface of the developing roller 402, thus abnormal images may appear such as nonuniformity as step-by-step in traverse direction.

The pressure of the regulating blade 413 for urging to contact is preferably 0.049 to 2.45 N/cm. The contacting pressure of above 2.45 N/cm tends to decrease the toner amount deposited on the developing roller 402 and to increase the charging level of the toner, thus possibly decreasing the developing amount and the image density, and the contacting pressure of below 0.049 N/cm may allow to pass the toner mass through the regulating blade without forming a uniform thin layer, resulting possibly in significantly poor image quality. In this embodiment, the developing roller 402 as a JIS-A hardness of 300 and the regulating blade 413 is a SUS plate of 0.1 mm thick with a contacting pressure of 60 gf/cm, thereby an intended deposited amount of the toner may be brought about on the developing roller.

It is also preferred that the contacting angle of the regulating blade 413 is 10° to 45° against the tangent line of the developing roller in a direction that the tip faces the downstream of the developing roller 402. The unnecessary portion for forming a toner-thin layer interposed between the regulating blade 413 and developing roller 402 is peeled from the developing roller 402 and a thin layer is formed with a uniform thickness of intended 0.4 to 0.8 mg/cm$^2$. At this stage, the toner charge is finally −10 to −30 μC/g, then the toner is used for developing a latent electrostatic image on the photoconductor drum 1.

As such, in accordance with the one-component developing apparatus in this embodiment, the distance between the surface of the photoconductor drum 1 and the surface of the developing roller 402 can be narrowed still further compared to conventional two-component developing units, thereby increasing the developing ability and making possible to develop with lower voltages.

Two-Component Developing Unit

The two-component developing unit is preferably one having a magnetic field-generating unit fixed therein and a rotatable developer bearing member that carries on its surface a two-component developer formed of a magnetic carrier and toner.

Figure 6:
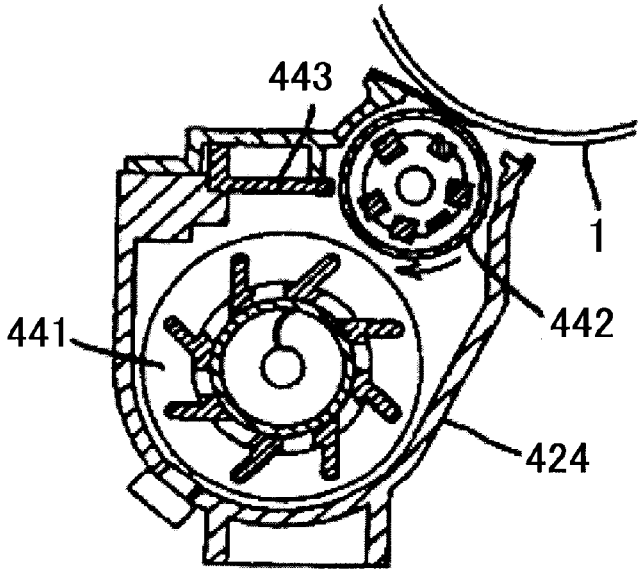
FIG. 6 is a schematic view that exemplarily shows a two-component developing unit applied to an inventive image forming apparatus.

FIG. 6 is a schematic view that exemplarily shows a two-component developing unit that uses a two-component developer formed of a magnetic carrier and toner. In this two-component developing unit of FIG. 6, a developer is stirred and transported by a screw 441 and sent to a developing sleeve 442. The two-component developer sent to the developing sleeve 442 is regulated by a doctor blade 443 and the supplied amount of the developer is controlled by a doctor gap, which is a space between the doctor blade 443 and the developing sleeve 442. When the doctor gap is too small, the amount of developer is insufficient, leading to insufficient image density, and when the doctor gap is too large, the developer is excessively supplied in amount, causing a problem of carrier attachment on the photoconductor drum 1. Therefore, the developing sleeve 442 is equipped with a magnet that forms a magnetic field so as to hold the developer vertically on the peripheral surface, and the developer is held vertically in a form of chains on the developing sleeve 442 along the magnetic field lines that are radiated from the magnet in the normal line direction.

The developing sleeve 442 and the photoconductor drum 1 are arranged so as to be adjacent to each other with a certain space (development gap) in between and a developing region is formed where the developing sleeve 442 and the photoconductor drum 1 are facing each other. The developing sleeve 442 is made of non-magnetic substance such as aluminum, brass, stainless steel, and electroconductive resin in a form of cylinder, and it is rotated by a rotary drive mechanism (not shown). The magnetic brush is transported to the developing region by the rotation of the developing sleeve 442. A developing voltage is applied to the developing sleeve 442 by means of a power source for development (not shown), the toner on the magnetic brush is separated from the carrier by means of development field formed between the developing sleeve 442 and the photoconductor drum 1, and is developed on the latent electrostatic image on the photoconductor drum 1. It is also possible for the developing voltage to be overlapped with alternating current.

The development gap can be set to approximately 5 to 30 times as much as the particle diameter of the developer, and when the particle diameter of the developer is 50 μm, the development gap can be set to 0.5 to 1.5 mm. When the development gap is wider than the above, it is difficult to obtain desired image density.

It is also preferable that the doctor gap is approximately equivalent or somewhat larger than the development gap. The drum diameter or drum linear density of the photoconductor drum 1 and the sleeve diameter or sleeve linear density of the developing sleeve 442 are determined depending on the copying speed or size of the apparatus, etc. The ratio of the sleeve linear velocity to the drum linear velocity is preferably 1.1 or more for obtaining required image density. It is also possible to install a sensor in a position after developing and to control the process condition by detecting the amount of toner attachment from optical reflectance.

Transferring Step and Transferring Unit

In the transferring step, a visible image is transferred onto a recording medium by use of a transferring unit. The transferring unit is classified into a transferring unit where a visible image on a latent electrostatic image bearing member is directly transferred onto a recording medium, and a secondary transferring unit where a visible image is firstly transferred onto an intermediate transferring member and then the visible image is secondarily transferred onto the recording medium.

The visible-image transfer may be carried out, for example, by charging the photoconductor using a transferring charger, which may be performed by the transferring unit. In a preferable aspect, the transferring unit contains the first transferring unit that transfers the visible image to the intermediate transferring member to form a compounded transfer image, and the second transferring unit that transfers the compounded transfer image to the recording medium.

Intermediate Transferring Member

The intermediate transferring member may be properly selected from conventional transferring members, for example, transfer belts and transfer rollers are preferable.

The stationary friction coefficient of the intermediate transferring member is preferably 0.1 to 0.6 and more preferably 0.3 to 0.5. The volume resistance of intermediate transferring member is preferably more than several ohm·cm and less than $10^3$ ohm·cm. The volume resistance within the range of several ohm·cm to $10^3$ ohm·cm may prevent charging of the intermediate transferring member itself, and the charge from the charging unit is unlikely to remain on the intermediate transferring member, therefore, transfer nonuniformity at the secondary transferring may be prevented and the application of transfer bias at the secondary transferring becomes relatively easy.

The materials of the intermediate transferring member may be properly selected from conventional ones depending on the application, preferable are as follows. The materials are, for example, (1) materials with high Young's modulus (tension elasticity) used as a single layer belt such as polycarbonates (PC), polyvinylidene fluoride (PVDF), polyalkylene terephthalate (PAT), blend materials of PC/PAT, ethylene tetrafluoroethylene copolymer (ETFE)/PC, and ETFE/PAT, thermosetting polyimides of carbon black dispersion, and the like. These single layer belts having high Young's modulus are small in their deformation against stress during image formation and are particularly advantageous in that registration error is less likely to occur during color image formation. (2) A double or triple layer belt using the belt having high Young's modulus as a base layer is available, where being added with a surface layer and an optional intermediate layer around the peripheral side of the base layer. The double or triple layer belt has a capability of preventing dropout in a lined image that is caused by hardness of the single layer belt. (3) An elastic belt with relatively low Young's modulus is available that incorporates a rubber or an elastomer. This belt is advantageous in that there is almost no print defect of unclear center portion in a line image due to its softness. Additionally, by making width of the belt wider than drive roller or tension roller and thereby using the elasticity of edge portions that extend over rollers, it can prevent meandering of the belt. It is also cost effective for not requiring ribs or units to prevent meandering. Among these, the elastic belt (3) is preferable in particular.

The elastic belt deforms corresponding to the surface roughness of toner layers and the recording medium having low smoothness in the transfer section. In other words, since elastic belts deform complying with local roughness and an appropriate adhesiveness can be obtained without excessively increasing the transfer pressure against toner layers, it is possible to obtain transfer images having excellent uniformity with no letter void even with a recording medium of low flatness.

The resin of the elastic belts may be selected depending on the application; examples thereof include polycarbonate resins, fluorine resins such as ETFE and PVDF; polystyrene resins, chloropolystyrene resins, poly-α-methylstyrene resins, styrene-butadiene copolymers, styrene-vinyl chloride copolymer, styrene-vinyl acetate copolymer, styrene-maleic acid copolymer, styrene-acrylate copolymers such as styrene-methyl acrylate copolymers, styrene-ethyl acrylate copolymers, styrene-butyl acrylate copolymers, styrene-octyl acrylate copolymers, and styrene-phenyl acrylate copolymers; styrene-methacrylate copolymers such as styrene-methyl methacrylate copolymers, styrene-ethyl methacrylate copolymers and styrene-phenyl methacrylate copolymer; styrene-α-chloromethyl acrylate copolymers, styrene-acrylonitrile acrylate copolymers, methyl methacrylate resins, butyl methacrylate resins, ethyl acrylate resins, butyl acrylate resins, modified acrylic resins such as silicone-modified acrylic resins, vinyl chloride resin-modified acrylic resins and acrylic urethane resin; vinyl chloride resins, styrene-vinyl acetate copolymers, vinyl chloride-vinyl acetate copolymers, rosin-modified maleic acid resins, phenol resins, epoxy resins, polyester resins, polyester polyurethane resins, polyethylene resins, polypropylene resins, polybutadiene resins, polyvinylidene chloride resins, ionomer resins, polyurethane resins, silicone resins, ketone resins, ethylene-ethylacrylate copolymers, xylene resins, polyvinylbutylal resins, polyamide resins, and modified polyphenylene oxide resins. These may be used alone or in combination.

The rubber of the elastic belts may be properly selected depending on the application; examples thereof include natural rubber, butyl rubber, fluorine-based rubber, acryl rubber, EPDM rubber, NBR rubber, acrylonitrile-butadiene-styrene rubber, natural rubber, isoprene rubber, styrene-butadiene rubber, butadiene rubber, ethylene-propylene rubber, ethylene-propylene terpolymers, chloroprene rubber, chlorosulfonated polyethylene, chlorinated polyethylene, urethane rubber, syndiotactic 1,2-polybutadiene, epichlorohydrin rubber, silicone rubber, fluorine rubber, polysulfide rubber, polynorbornene rubber, and hydrogenated nitrile rubber. These may be used alone or in combination.

The elastomers used for the elastic belts may be properly selected depending on the application; examples thereof include polystyrene thermoplastic elastomers, polyolefin thermoplastic elastomers, polyvinyl chloride thermoplastic elastomers, polyurethane thermoplastic elastomers, polyamide thermoplastic elastomers, polyurea thermoplastic elastomers, polyester thermoplastic elastomers, fluorocarbon thermoplastic elastomers, and the like. These may be used alone or in combination.

The electroconductive agents for adjusting resistance may be properly selected depending on the application; examples thereof include carbon black, graphite, metal powders such as aluminum and nickel; electroconductive metal oxides such as tin oxide, titanium oxide, antimony oxide, indium oxide, potassium titanate, antimony tin oxide (ATO), and indium tin oxide (ITO). The electroconductive metal oxides may be coated with insulating fine particles such as of barium sulfate, magnesium silicate, calcium carbonate, and the like.

The materials of the surface layer of the elastic belts are required to prevent contamination of the photoconductor due to elastic material as well as to reduce the surface friction of the transfer belt so that toner adhesion is lessened while improving the cleaning ability and the secondary transfer property. The surface layer preferably contains a binder resin such as polyurethane resin, polyester resin, epoxy resin, and the like and a material, which reduces surface energy and enhances lubrication, of powders or particles such as of fluorine resin, fluorine compound, carbon fluoride, titanium dioxide, silicon carbide, and the like. In addition, it is possible to use a material such as fluorine rubber that is treated with heat so that a fluorine-rich layer is formed on the surface and the surface energy is reduced.

Examples of methods to produce the elastic belts include, but not limited to, (1) centrifugal forming in which material is poured into a rotating cylindrical mold to form a belt, (2) spray application in which a liquid paint is sprayed to form a film, (3) dipping methods in which a cylindrical mold is dipped into a solution of material and then pulled out, (4) injection mold methods in which material is injected into inner and outer mold, and (5) methods in which a compound is applied onto a cylindrical mold and the compound is vulcanized and grounded.

Examples of methods to prevent elongation of the elastic belt include (1) methods in which materials that prevent elongation are added to a core layer and (2) methods in which a rubber layer is formed on the core layer which is less stretchable.

Examples of the materials to prevent the elongation include natural fibers such as cotton and silk; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, and phenol fibers; inorganic fibers such as carbon fibers, glass fibers, and boron fibers, metal fibers such as iron fibers, and copper fibers; preferably, materials that are in a form of a weave or thread may be used.

The method for forming the core layer may be properly selected depending on the application; examples thereof include (1) methods in which a weave that is woven in a cylindrical shape is placed on a mold or the like and a coating layer is formed on top of it, (2) methods in which a cylindrical weave is dipped in a liquid rubber or the like so that coating layer(s) is formed on one side or on both sides of the core layer, and (3) methods in which a thread is twisted helically around a mold or the like in an arbitrary pitch, and then a coating layer is formed thereon.

As the coated layer comes to thicker, elongation and contraction of the surface comes to more significant, therefore, excessive thickness such as above about 1 mm is undesirable.

The transfer unit, i.e. the primary transfer unit and the secondary transfer unit, preferably contains a transfer equipment that is configured to charge so as to separate the visible image formed on the latent electrostatic image bearing member and transfer the visible image onto a recording medium.

Examples of the transfer equipment are corona transfer equipments utilizing corona discharge, transfer belts, transfer rollers, pressure-transfer rollers, adhesion-transfer equipments, and the like.

The typical recording medium is a regular paper, and may be selected properly as long as capable of receiving transferred, unfixed image after developing; and PET bases for OHP may also be used.

Transferring Unit of Tandem Image Forming Apparatus

The tandem image forming apparatus has at least image forming elements arranged in plural numbers including a latent electrostatic image bearing member, a charging unit, a developing unit, and a transfer unit. The tandem image forming apparatus can form full-color images at higher speeds, because four image forming elements for yellow, magenta, cyan and black, each form visible image in parallel by means of four image forming elements and superimpose one another on a recording medium or intermediate transfer member.

Figure 7:
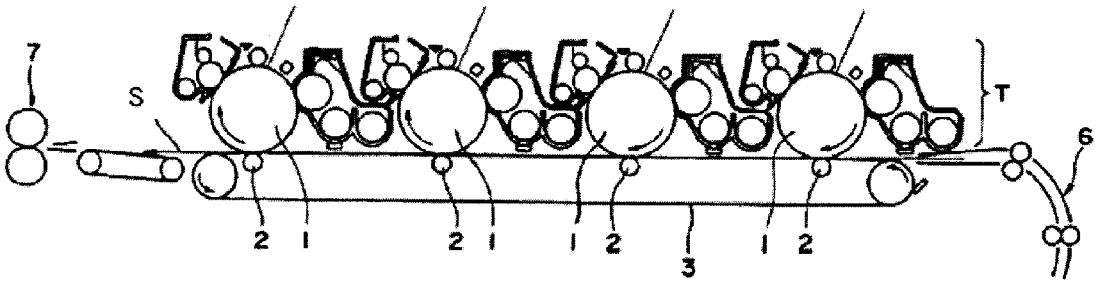
FIG. 7 is a schematic view that exemplarily shows an inventive tandem-type image forming apparatus in a direct transfer system.
Figure 8:
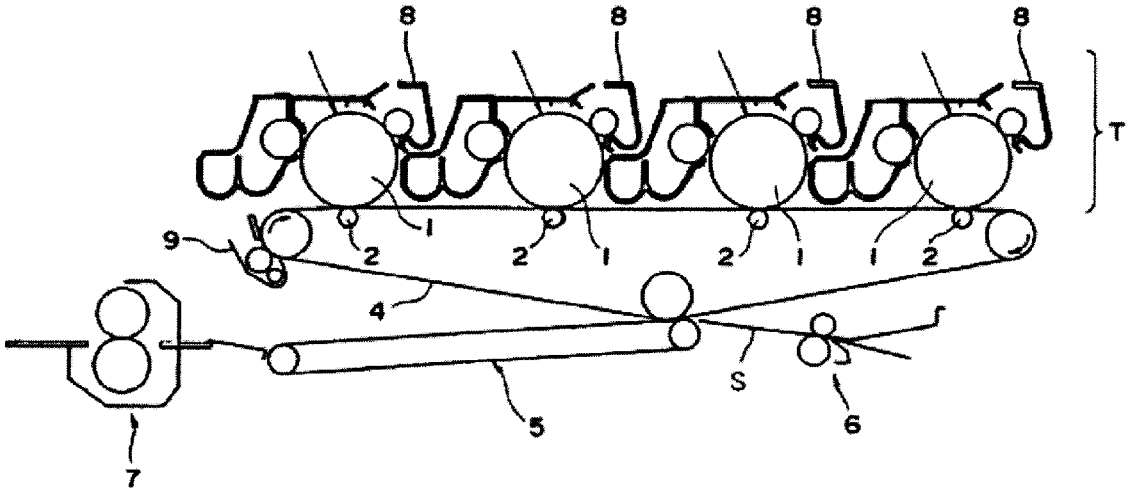
FIG. 8 is a schematic view that exemplarily shows an inventive tandem-type image forming apparatus in an indirect transfer system.

There are two types of tandem information forming apparatuses: (1) direct transfer type and (2) indirect transfer type. In direct transfer type, visible images formed on the photoconductor 1 are transferred sequentially by the transfer unit 2 to a recording medium S of which the surface is being transported so as to pass through the transfer position, which is facing each photoconductor 1 of multiple image forming elements as shown in FIG. 7. In indirect transfer type, visible images on each photoconductor 1 of multiple image forming elements are temporarily transferred sequentially by the primary transfer unit 2 to the intermediate transfer member 4 and then all the images on the intermediate transfer member 4 are transferred together to the recording medium S by the secondary transfer unit 5 as shown in FIG. 8.

The direct transfer type (1), compared to the indirect transfer type (2), has a drawback of glowing in size in a transporting direction of the recording medium because the paper feeding unit 6 must be placed on the upper side of the tandem image forming part T where the photoconductor 1 is aligned, whereas the fixing unit 7 must be placed on the lower side of the apparatus. On the other hand, in the indirect transfer type (2), the secondary transfer site may be installed relatively freely, and the paper feeding unit 6 and the fixing unit 7 may be placed together with the tandem image forming part T making it possible to be downsized.

To avoid size-glowing in the transporting direction of the recording medium in the direct transfer type (1), the fixing unit 7 must be placed close to the tandem image forming part T. However, it is impossible to place the fixing unit 7 in a way that gives enough space for the recording medium S to bend, and the fixing unit 7 may affect the image forming on the upper side by the impact generated from the leading end of the recording medium S as it approaches the fixing unit 7 (this becomes distinguishable with a thick sheet), or by the difference between the transport speed of the recording medium when it passes through the fixing unit 7 and when it is transported by the transfer/transport belt. The indirect transfer type, on the other hand, allows the fixing unit 7 to be placed in a way that gives recording medium S an enough space to bend and the fixing unit 7 has almost no effect on the image forming.

For above reasons, the indirect transfer type of the tandem image forming apparatus is particularly interested recently. This type of color image forming apparatus as shown in FIG. 8, prepares for the next image forming by removing the residual toner on the photoconductor 1 by the photoconductor cleaning unit 8 to clean the surface of the photoconductor 1 after the primary transfer. It also prepares for the next image forming by removing the residual toner on the intermediate transfer member 4 by the intermediate transfer member cleaning unit 9 to clean the surface of the intermediate transfer member 4 after the secondary transfer.

Fixing Step and Fixing Unit

In the fixing step, the visible image on the recording medium is fixed by use of the fixing unit. The fixing unit may be properly selected depending on the application; for example, fixing devices with a fixing member and a heat source are appropriately used.

Examples of the fixing members include a combination of an endless belt and a roller, and a combination of a roller and a roller. In view of shorter warm-up period and energy saving, a combination of an endless belt and a roller or induction heating is preferably employed.

The fixing member is exemplified by conventional heating and pressurizing units, i.e. a combination of a heating unit and a pressure. The heating and pressurizing unit is exemplified by a combination of a heating roller, a pressure roller, and an endless belt, or a heating roller and a pressure roller.

In the case where the fixing member is an endless-shaped belt, preferably, the endless-shaped belt is made of materials having a small heat capacity, and includes one in which, for example, there is provided on a base an offset preventing layer. Materials forming the base include, for example, nickel and polyimide. Materials forming the offset preventing layer include, for example, silicone rubbers, and fluorine-based resins.

In the case where the fixing member is a roller, preferably, a core metal of this roller is made of a non-elastic member in order to prevent the deformation or deflection due to a high pressure. These non-elastic members may be suitably selected depending on the purpose. For example, the non-elastic members preferably include high thermal conductivity materials such as aluminum, iron, stainless steel, and brass. Moreover, the roller is preferably covered with an offset preventing layer at the surface thereof. Materials forming this offset preventing layer may be suitably selected depending on the purpose without particular limitation, and preferably include, for example, RTV silicone rubber, tetrafluoroethylene-perfluoroalkyl vinylether (PFA), and polytetrafluoroethylene (PTFE).

In the fixing step, the toner image is transferred onto the recording medium, the recording medium having an image is passed between the nip to fix the image onto the recording medium or the image is transferred and also fixed simultaneously at the nip.

In addition, the fixing step may be carried out for each toner at every transferring onto the recording medium or the all toners are overlapped and then fixed simultaneously.

The nip is formed by contacting at least two fixing members. The nip pressure may be properly selected depending on the application; preferably, the pressure is no less than 5 $N/cm^2$, more preferably 7 to 100 $N/cm^2$, still more preferably 10 to 60 $N/cm^2$. Excessively higher nip pressure tends to impair the roller durability, and the nip pressure of below 5 $N/cm^2$ may bring about insufficient hot-offset resistance.

The fixing temperature of the toner, i.e. the surface temperature of the fixing member heated by the heating unit, may be properly selected depending on the application; preferably, the temperature is 120° C. to 170° C., more preferably 120° C. to 160° C. The temperature below 120° C. may result in insufficient fixing, and the temperature above 170° C. is undesirable for energy saving.

The fixing units are classified into (1) internal heating, i.e. the fixing unit is equipped with at least one of rollers and belts, the heating energy is supplied to the surface to which no toner contacts, and the image transferred onto the recording medium is fixed by heat and pressure, (2) external heating, i.e. the fixing unit is equipped with at least one of rollers and belts, the heating energy is supplied to the surface on which the toner is disposed, and the image transferred onto the recording medium is fixed by heat and pressure; these combination may be possible.

The fixing unit of the internal heating (1) described above may be a fixing unit that is equipped with a heating unit therein such as heaters and halogen lamps.

The fixing unit of the external heating (2) described above may be a fixing unit of which the surface is heated at least partly by a heating unit such as electromagnetic induction-heating units. The electromagnetic induction-heating units may be those generating a magnetic field or heating by electromagnetic induction.

The electromagnetic induction-heating units, which being properly selected depending on the application, preferably comprise a device to generate magnetic field and a heating device by use of electromagnetic induction.

The electromagnetic induction-heating units are preferably constructed from an induction coil accessible to the fixing member such as heating rollers, a shielding layer for the induction coil, and an insulative layer disposed to the shielding layer oppositely to the induction coil. The heating roller is preferably of magnetic material or heat pipes.

It is preferred that the induction coil is disposed to surround the half-cylinder of the heating roller at the side opposite to the site where the heating roller and the fixing member contact.

Fixing Unit of Internal Heating

Figure 9:
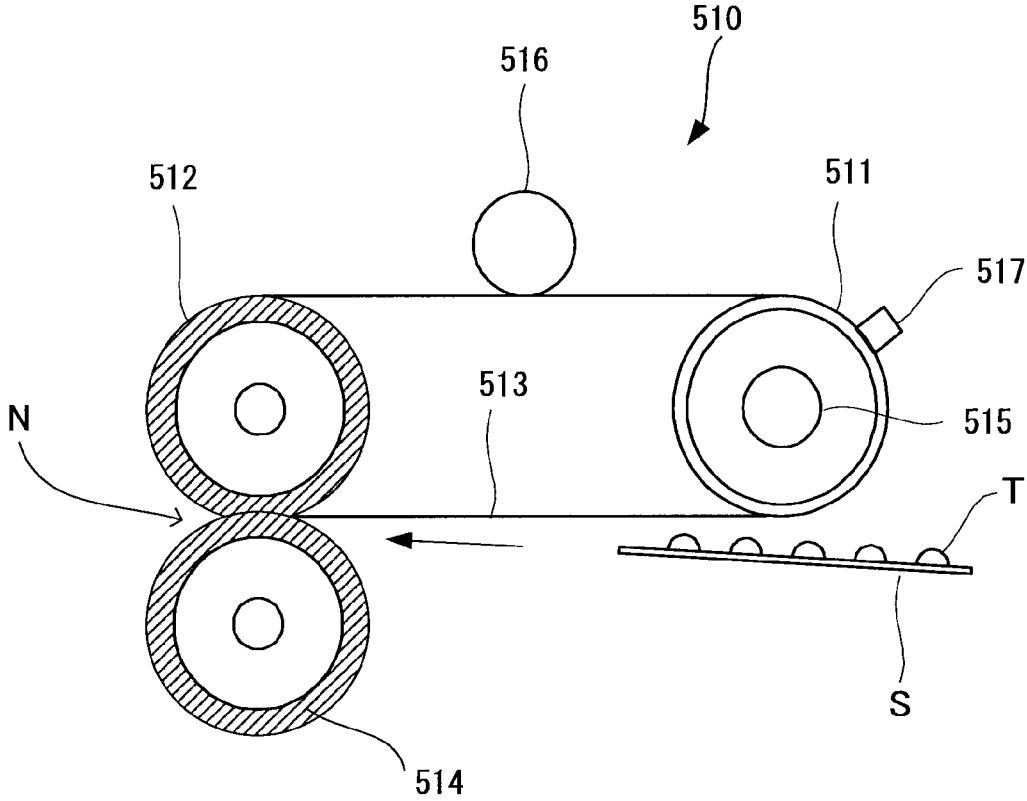
FIG. 9 is a schematic view that exemplarily shows a belt-type fixing unit applied to an inventive image forming apparatus.

FIG. 9 exemplarily shows a belt-type fixing unit of internal heating. The belt-type fixing unit 510 comprises a heating roller 511, a fixing roller 512, a fixing belt 513, and a pressure roller 514.

The fixing belt 513 is looped around the heating roller 511 and the fixing roller 512, which being rotatably mounted, and is heated at a predetermined temperature by the heating roller 511. The heating roller 511 has a heat source 515 therein, and is configured to freely control the temperature thereof by means of a thermal sensor 517 disposed adjacent to the heating roller 511. The fixing roller 512 is rotatably mounted inside of the fixing belt 513 so as to contact with the inner side of the fixing belt 513. The pressure roller 514 is rotatably mounted outside of the fixing belt 513 so as to contact with the outer side of the fixing belt 513. Moreover, the surface hardness of the fixing belt 513 as the image-contact fixing member is lower than the surface hardness of the pressure roller 514 as the non-image-contact member. In the nip N formed between the fixing roller 512 and the pressure roller 514, an intermediate region of the recording medium S introducing edge and the ejecting edge, is located toward the side of the fixing roller 512 compared with the introducing edge and the ejecting edge.

In the belt-fixing device 510 shown in FIG. 9, a toner image T to be fixed is transferred to the heating roller 511. The toner image T on the recording medium S is heated and fused by the heating roller 511 heated at a predetermined temperature by means of the heat source 515, and the fixing belt 513. In this condition, the recording medium S is inserted into the nip N formed between the fixing roller 512 and the pressure roller 514. The recording medium S inserted in the nip N is contacted with a surface of the fixing belt 513 which rotates along with the rotation of the fixing roller 512 and the pressure roller 514, and is pressed at the time passed through the nip N, thereby fixing the toner image T onto the recording medium S.

The recording medium S on which the toner image T is fixed is sequentially passed through between the fixing roller 512 and the pressure roller 514, separated from the fixing belt 513, and transferred to a tray (not shown). In this process, the recording medium S is ejected towards the side of the pressure roller 514 as the non-image-contact fixing member, and thus the recording member is prevented from wrapping around the fixing belt 513. The fixing belt 513 is then cleaned by means of a cleaning roller 516.

Figure 10:
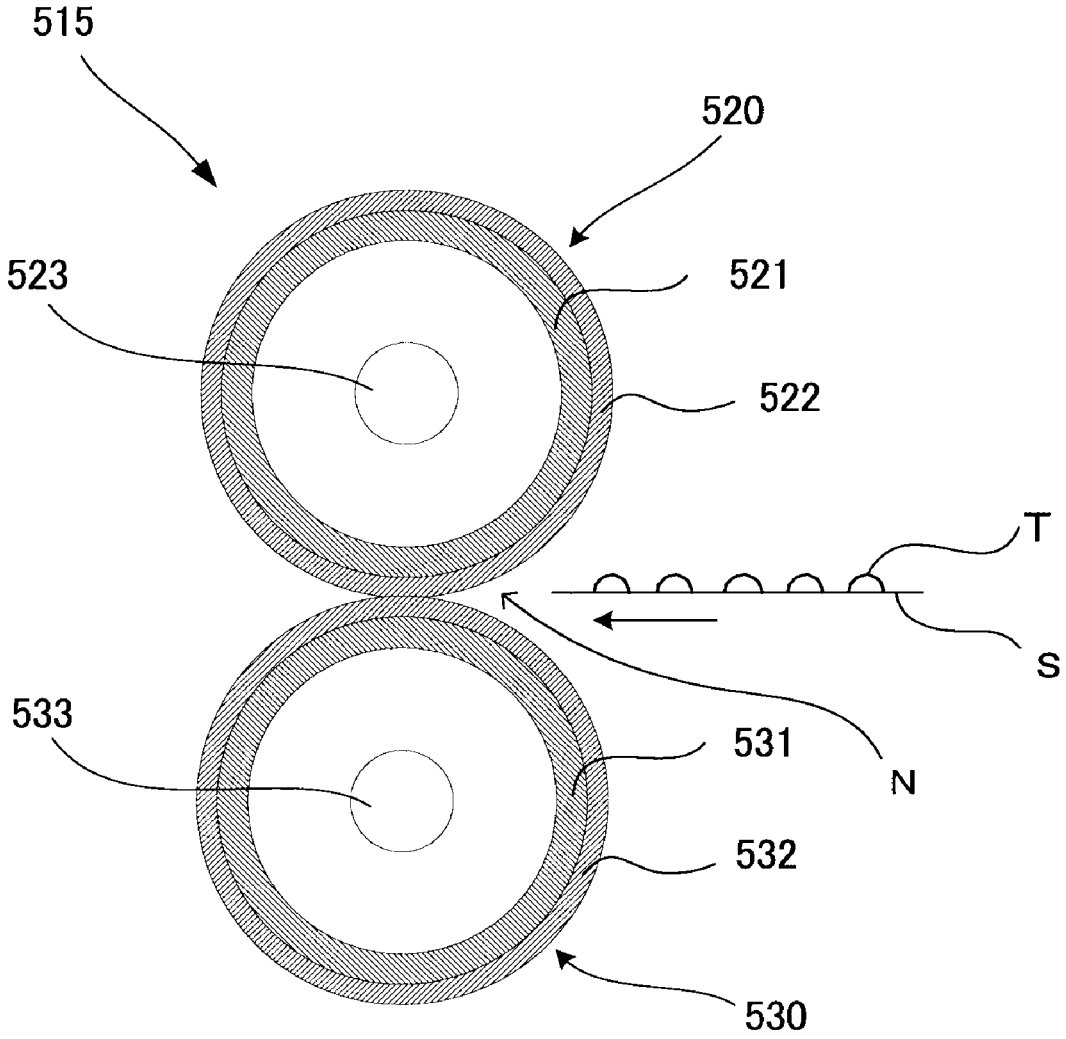
FIG. 10 is a schematic view that exemplarily shows a heat-roller type fixing unit applied to an inventive image forming apparatus.

The fixing device 515 of heat-roll type shown in FIG. 10 comprises a heating roller 520 as the fixing member and a pressure roller 530 disposed to contact therewith.

The heating roller 520 comprises a hollow metal cylinder 521, an offset inhibition layer 522 coated on the surface of the metal cylinder 521, and a heating lamp 523 disposed in the metal cylinder 521. The pressure roller 530 comprises a metal cylinder 531, and an offset inhibition layer 532 coated on the surface of the metal cylinder 531. Alternatively, the metal cylinder 531 of the pressure roller 530 may be hollow and equipped with a heating lamp 533 therein.

The heating roller 520 and the pressure roller 530 are rotatably mounted so as to contact against each other by means of a spring (not shown) to form a nip N. The offset inhibition layer 522 of the heating roller 520 as the image-contact fixing member has a lower surface hardness than the surface hardness of the offset inhibition layer 532 of the pressure roller 530 as the non-image-contact fixing member. In the nip N formed between the heating roller 520 and the pressure roller 530, an intermediate region of the recording medium S introducing edge and the ejecting edge, is located towards the heating roller 520 compared with the introducing edge and the ejecting edge.

In the image-fixing device 515 of heat-roll type shown in FIG. 10, a toner image T to be fixed is transferred to the nip formed between the heating roller 520 and the pressure roller 530. The toner image T on the recording medium S is heated and fused by the heating roller 520 heated at a predetermined temperature by means of the heating lamp 523. At the same time, the recording medium S is passed through the nip N, the recording medium S is pressed by a pressure from the pressure roller 530, and thus the toner image T is fixed into the recording medium S.

The recording medium S, on which the toner image T being fixed, is sequentially passed through between the heating roller 520 and the pressure roller 530, and transferred to a tray (not shown). In this process, the recording medium S is ejected towards the side of the pressure roller 530 as the non-image-contact fixing member, and thus the recording member S is prevented from wrapping around the pressure roller 530. The heating roller 520 is then cleaned by means of a cleaning roller (not shown).

Fixing Unit of External Heating Type

Figure 11:
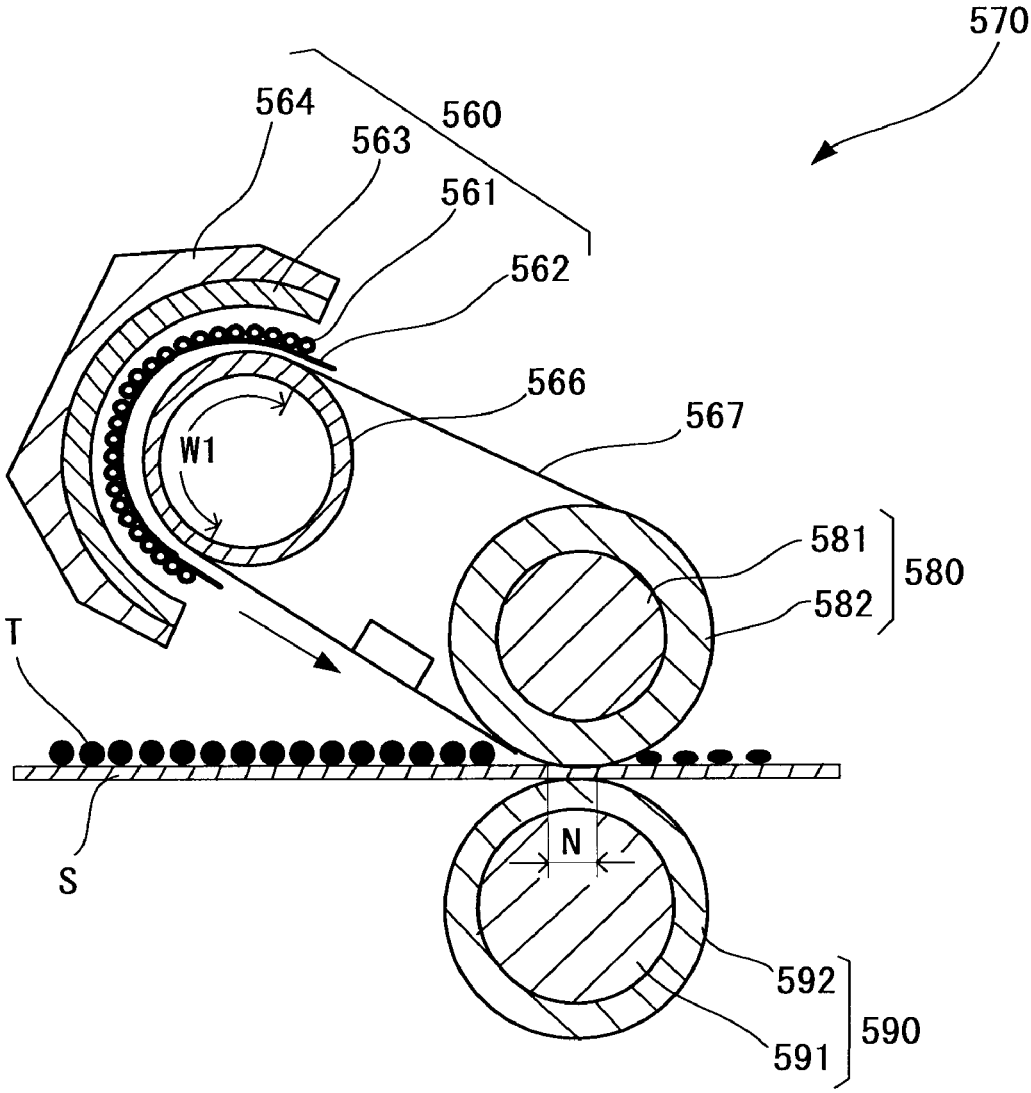
FIG. 11 is a schematic view that exemplarily shows a fixing unit of electromagnetic induction-heating type applied to an inventive image forming apparatus.

FIG. 11 exemplarily shows a fixing device 570 of electromagnetic induction-heating type. The fixing device 570 comprises a heating roller 566, a fixing roller 580, a fixing belt 567, a pressure roller 590, and an electromagnetic induction heating unit 560.

The fixing belt 567 is looped around the heating roller 566 and the fixing roller 580 disposed rotatably inside the fixing belt, and is heated at a predetermined temperature by the heating roller 566.

The heating roller 566 comprises a magnetic metal member formed of iron, cobalt, nickel, or alloy thereof, in a form of hollow cylinder; for example, the outer diameter is 20 mm to 40 mm, and a thickness is 0.3 mm to 1.0 mm, thus the heating roller 566 has a configuration of low thermal capacity and rapid thermal conductivity.

The fixing roller 580 comprises a metal core 581 formed of metal such as a stainless steel or the like, and an elastic layer 582 coated on the surface of the metal core 581. An elastic layer is formed of a thermal resistive silicone rubber in the form of solid or foam. The fixing roller 580 is rotatably mounted inside the fixing belt 567 to contact with the inner side of the fixing belt 567. In order to form a predetermined width of a nip N between the pressure roller 590 and the fixing roller 580 by the pressure from the pressure roller 590, the fixing roller 580 is configured to have an outer diameter of 20 mm to 40 mm, which is larger than that of the heating roller 566. The elastic layer 582 has a thickness of 4 mm to 6 mm so that the thermal capacity of the heating roller 566 becomes smaller than the thermal capacity of the fixing roller 580, thereby shortening the time required for warming up the heating roller 566.

The pressure roller 590 comprises a metal core 591 formed of a metal having a high thermal conductivity such as cupper, aluminum, or the like, and an elastic layer 592 coated on the surface of the metal core 591. The elastic layer 592 has thermal resistance and high toner releasing-ability. The pressure roller 590 is rotatably mounted outside the fixing belt 567 so as to contact against the fixing roller 580 via the fixing belt 567. Apart from the above-listed metals, SUS may be used to form the metal core 591.

An electromagnetic induction heating unit 560 is disposed adjacent to the heating roller 566 and along the axis direction of the heating roller 566. The electromagnetic induction heating unit 560 comprises an exciting coil 561 as a magnetic field generating unit; and a coil guide plate 562 to which the exciting coil 561 is rolled up. The coil guide place 562 is disposed adjacent to the outer circumferential surface of the heating roller 566, and has a half cylinder shape. The exciting coil 561 is one long exciting coil that is alternately rolled up along the coil guide plate 562 in the axial direction of the heating roller 566. The oscillation circuit of the exciting coil 561 is connected to a frequency-variable driving power source (not shown). At the outside of the exciting coil 561, an exciting coil core 563 of a ferromagnetic element such as ferrite and of half cylinder shape is fixed to an exciting coil core supporting member 564 and is closely disposed to the exciting coil 561.

In the image-fixing device 570 shown in FIG. 11, once the exciting coil 561 of the electromagnetic induction heating unit 560 is electrified, alternating magnetic field is formed around the electromagnetic-induction heating unit 560, thereby uniformly and efficiently preheating the heating roller 566, which being adjacent to and surrounded by the exciting coil 561, by the excitation of overcurrent. A recording medium S having a toner image T to be fixed is transferred to a nip N formed between the fixing roller 580 and the pressure roller 590. The heating roller 566 is heated at a predetermined temperature by means of the electromagnetic induction heating unit 560. The fixing belt 567 is heated at the contact region W1 with the heating roller 566 by means of the heating roller 566. The toner image T on the recording medium S is heated and fused by the fixing belt 567. In this condition, the recording medium S is inserted into the nip N formed between the fixing roller 580 and the pressure roller 590. The recording medium S is then contacted with the surface of the fixing belt 580 which rotates along the rotation of the fixing roller 580 and the pressure roller 590.

The recording medium S, on which the toner image T being fixed, is sequentially passed through between the fixing roller 580 and the pressure roller 590, separated from the fixing belt 567, and transferred to a tray (not shown). In this process, the recording medium S is ejected towards the side of the pressure roller 590 as the non-image-contact fixing member, and thus the recording member S is prevented from wrapping around the fixing belt 567. The fixing belt 567 is then cleaned by means of a cleaning roller (not shown).

Figure 12:
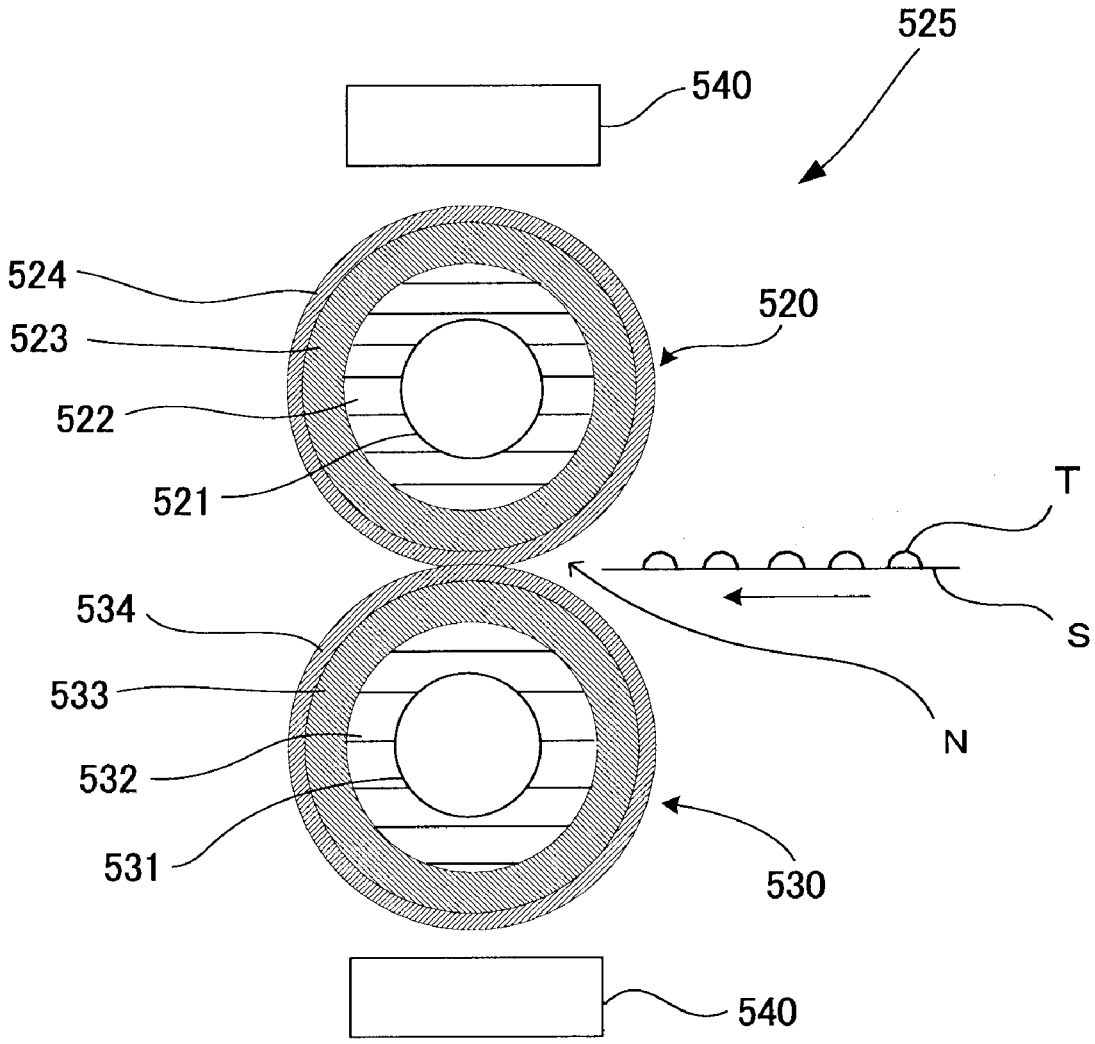
FIG. 12 is a schematic view that exemplarily shows another fixing unit of electromagnetic induction-heating type applied to an inventive image forming apparatus.

The roll-fixing device 525 of electromagnetic type shown FIG. 12 is a fixing unit that comprises a fixing roller 520, a pressure roller 530 contacting therewith, and an electromagnetic induction heat source 540 for heating externally the fixing roller 520 and the pressure roller 530.

The fixing roller 520 has a metal core 521 on which a heat-insulative elastic layer 522, a heat-generating layer 523, and a release layer 524 are coated in this order. The pressure roller 530 has a metal core 531 on which a heat-insulative elastic layer 532, a heat-generating layer 533, and a release layer 534 are coated in this order. The release layers 524 and 534 are formed of tetrafluoroethylene perfluoroalkylvinylether (PFA).

The fixing roller 520 and the pressure roller 530 are urged to contact by a spring (not shown), thereby forming a nip N in a rotatable and compressed condition.

The electromagnetic induction heat sources 540 are disposed near the fixing roller 520 and the pressure roller 530 to heat the heat generating layers 523 and 533 by electromagnetic induction.

In the fixing unit shown in FIG. 12, the fixing roller 520 and the pressure roller 530 are uniformly and efficiently preheated by the electromagnetic induction heat sources 540. Two-dimensional higher pressures may be easily achieved at the nip N due to the combination of rollers.

Cleaning Step and Cleaning Unit

In the cleaning step, residual toners on the photoconductor are removed, which may be favorably carried out by a cleaning unit.

In cases where the developing unit has a developer bearing member that contact with the surface of the photoconductor and develops latent electrostatic images formed on the photoconductor as well as collects the residual toner on the photoconductor, then the cleaning may be conducted without the cleaning unit in a cleaning-less manner.

The cleaning unit may be properly selected from conventional cleaners; examples thereof include magnetic brush cleaners, electrostatic static brush cleaners, magnetic roller cleaners, blade cleaners, brush cleaners, and web cleaners. Among these, cleaning blades are preferable in view of higher toner-removing ability, compact size, and lower cost.

The material of the cleaning rubber blades may be urethane rubber, silicone rubber, fluorinated rubber, chloroprene rubber, and butadiene rubber. Among these, urethane rubber is preferable in particular.

Figure 13:
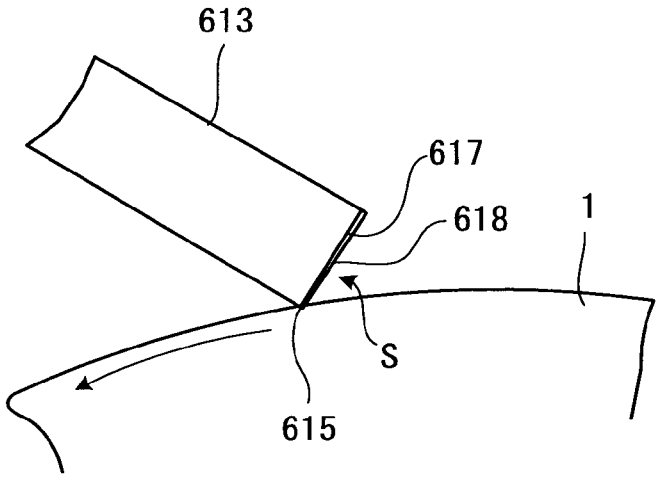
FIG. 13 is a schematic view that exemplarily shows a cleaning blade applied to an inventive image forming apparatus.

FIG. 13 is an enlarged view that explains around the contacting site 615 between a cleaning blade 613 and the photoconductor. The cleaning blade 613 has a toner-blocking face 617 in a relation with the photoconductor drum 1. In this embodiment, the toner-blocking face 617 broadens from the contacting portion 615 toward the upstream of the rotating direction of the photoconductor drum 1 to form an acute angle in the space S.

A coating 618 is provided at the toner-blocking face 617, as shown in FIG. 13, as a higher friction portion with higher friction coefficients. The coating 618 is formed of a material with a higher friction coefficient than that of the cleaning blade 613. The higher friction material is exemplified by diamond-like carbon (DLC), but not limited to. The coating 618 is provided on the toner-blocking face 617 that does not contact with the surface of the photoconductor drum 1.

The cleaning unit may comprise a toner-collecting blade that collects the residual toner scraped by the cleaning blade and a toner-collecting coil that conveys the residual toner collected by the toner-collecting blade (not shown).

Image Forming Apparatus of Cleaning-Less Type

Figure 14:
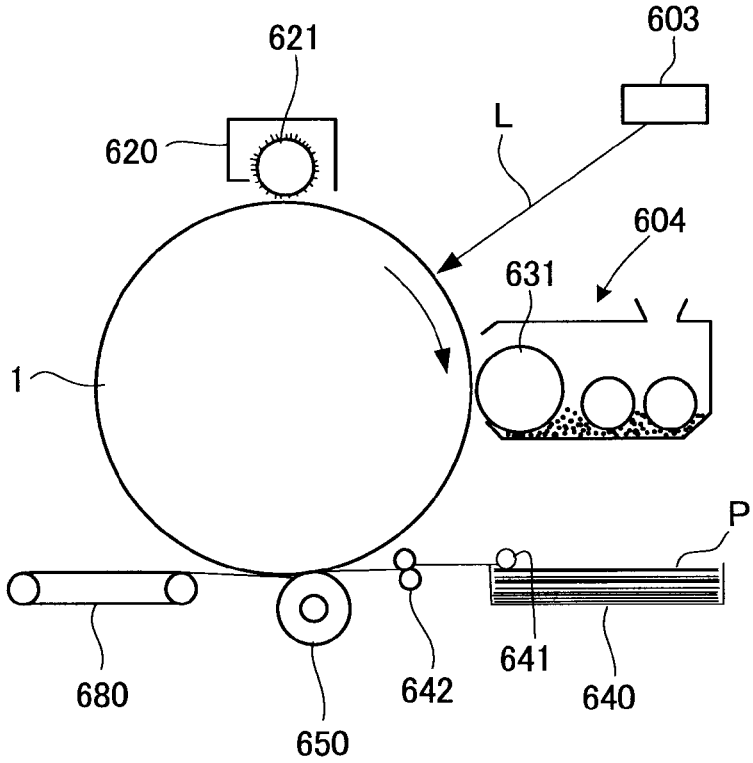
FIG. 14 is a schematic view that exemplarily shows an inventive image forming apparatus of cleaning-less type.

FIG. 14 is a schematic view that exemplarily shows an image forming apparatus of cleaning-less type where its developing unit acts also as a cleaning unit.

The image forming apparatus comprises, as shown in FIG. 14, a photoconductor drum 1, a brush charging unit 620, an exposing unit 603, a developing unit 604, a paper-feeding caste 640, a roller-transfer unit 650, and a recording medium P.

In the image forming apparatus of cleaning-less type, the residual toner on the photoconductor drum 1 comes to a contact-charging device 620, which contacting with the photoconductor drum 1 by action of successively rotating photoconductor drum 1, where the toner is temporarily collected by a magnetic brush (not shown) of a brush charging member that contact with the photoconductor drum, then the toner is ejected again onto the surface of the photoconductor drum 1, and then is finally collected by the developer bearing member 631 along with the developer into the developing unit 604, and the photoconductor drum 1 is repeatedly subjected to image formation.

The "developing unit 604 acts also as a cleaning unit" means a process where some residual toner on the photoconductor drum 1 after the transferring is collected by use of a developing bias, i.e. the potential difference between DC voltage applied to the developer bearing member 631 and the surface voltage of the photoconductor drum.

In the image forming apparatus where the developing unit acts also as a cleaning unit, the residual toner is collected into the developing unit 604 and reused in the following steps, therefore, such effects may be achieved as elimination of waste toner, maintenance free, and cleaner-less system, thus leading to higher space efficiency and significant downsize of image forming apparatuses.

Other Step and Other Device

In the discharging step, the electrophotographic photoconductor is discharged by applying a discharging bias, and the step may be favorably performed by a discharging device.

The discharging device may be properly selected from conventional discharging devices as long as the discharging bias is applied to the electrophotographic photoconductor; examples thereof include discharge lamps.

In the recycling step, toners removed in the cleaning step are recycled into the developing unit, which may be appropriately carried out by recycling devices. The recycling unit may be, for example, conventional conveying devices.

In the controlling step, the respective steps described above are controlled, which may be appropriately carried out by controlling units. The controlling units may be properly selected as long as capable of controlling the units described above; examples thereof include equipments or instruments such as sequencers and computers.

Image Forming Apparatus and Image Forming Method

One embodiment of the image forming method of the present invention by means of the image forming apparatus will be explained with reference to FIG. 15. The image forming apparatus 100 shown in FIG. 15 comprises a photoconductor drum 10 of a latent electrostatic image bearing member, a charging roller 20 as a charging unit, an exposure device 30 as an exposing unit, a developing device 40 as a developing unit, an intermediate transferring member 50, a cleaning device 60 as a cleaning unit, and a charge removing lamp 70 as a charge removing unit.

The intermediate transferring member 50 is an endless belt, and is designed to loop around three rollers 51 disposed therein and to rotate in the direction shown by the arrow by means of the rollers 51. One or more of the three rollers 51 also functions as a transfer bias roller capable of applying a certain transfer bias or a primary bias to the intermediate transferring member 50. A cleaning blade 90 is provided adjacent to the intermediate transferring member 50. There is provided a transferring roller 80 next to the intermediate transferring member 50 as the transferring unit capable of applying a transfer bias so as to transfer a developed image (toner image) to a recording medium 95, a recording medium (secondary transferring). Moreover, there is provided a corona charger 58 around the intermediate transferring member 50 for applying charges to the toner image transferred on the intermediate transferring medium 50. The corona charger 58 is arranged between the contact region of the photoconductor 10 and the intermediate transferring medium 50 and the contact region of the intermediate transferring medium 50 and the recording medium 95.

The developing device 40 comprises a developing belt 41 as a developer bearing member, a black developing unit 45K, yellow developing unit 45Y, magenta developing unit 45M and cyan developing unit 45C, the developing units being positioned around the developing belt 41. The black developing unit 45K comprises a developer container 42K, a developer supplying roller 43K, and a developing roller 44K. The yellow developing unit 45Y comprises a developer container 42Y, a developer supplying roller 43Y, and a developing roller 44Y. The magenta developing unit 45M comprises a developer container 42M, a developer supplying roller 43M, and a developing roller 44M. The cyan developing unit 45C comprises a developer container 42C, a developer supplying roller 43C, and a developing roller 44C. The developing belt 41 is an endless belt looped around a plurality of belt rollers so as to be rotatable. A part of the developing belt 41 is in contact with the photoconductor 10.

Figure 15:
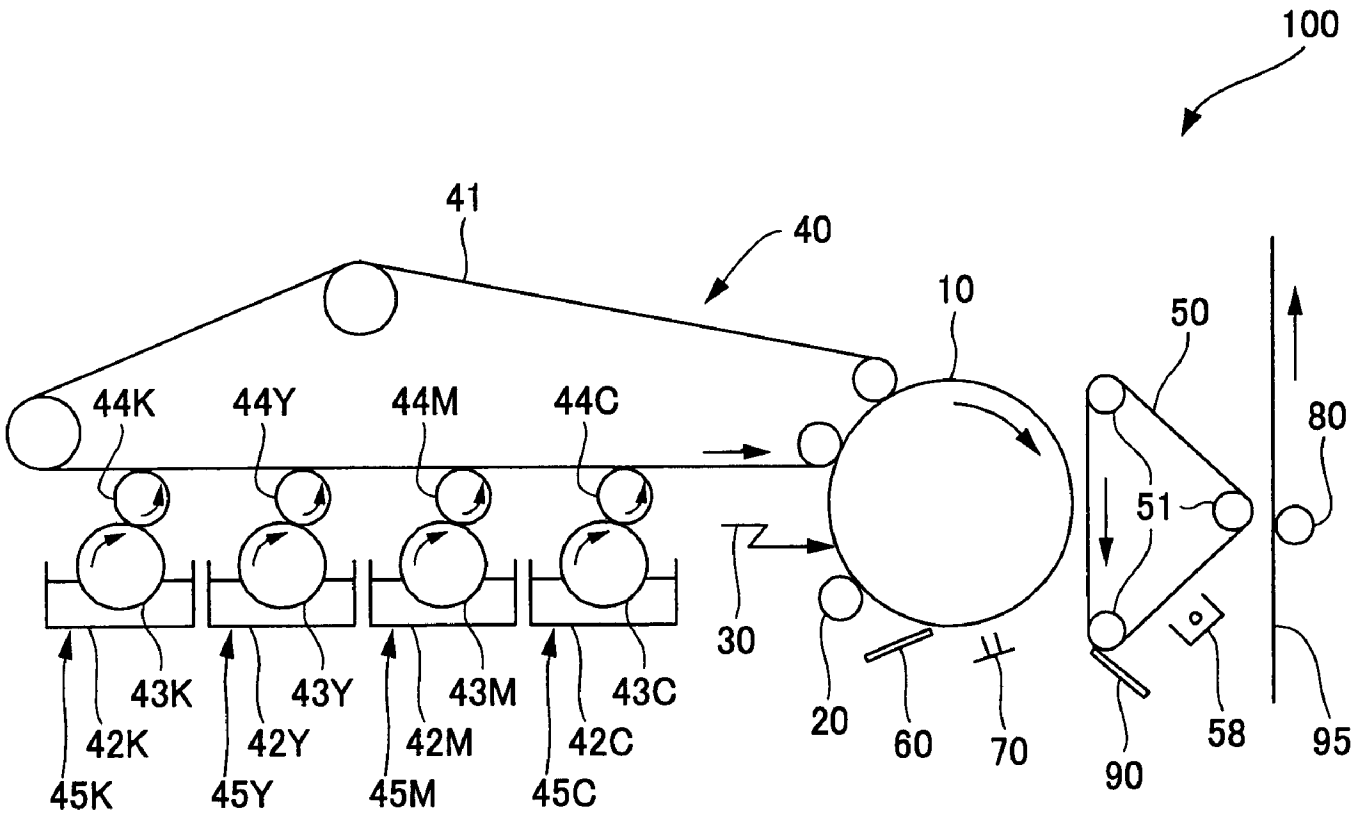
FIG. 15 is a schematic view that exemplarily shows an inventive image forming apparatus.

In the image forming apparatus 100 shown in FIG. 15, the photoconductor drum 10 is uniformly charged by means of, for example, the charging roller 20. An exposure device (not shown) then applies light 30 to the photoconductor drum 10 so as to form a latent electrostatic image. The latent electrostatic image formed on the photoconductor drum 10 is provided with toner from the developing device 40 to form a visible image. The roller 51 applies a bias to the toner image to transfer the visible image onto the intermediate transferring medium 50 (primary transferring), and further applies a bias to transfer the toner image from the intermediate transferring medium 50 to the recording medium 95 (secondary transferring). In this way a transferred image is formed on the recording medium 95. Thereafter, toner particles remained on the photoconductor drum 10 are removed by means of the cleaning device 60, and charges of the photoconductor drum 10 are removed by means of the charge removing lamp 70 on a temporary basis.

Figure 16:
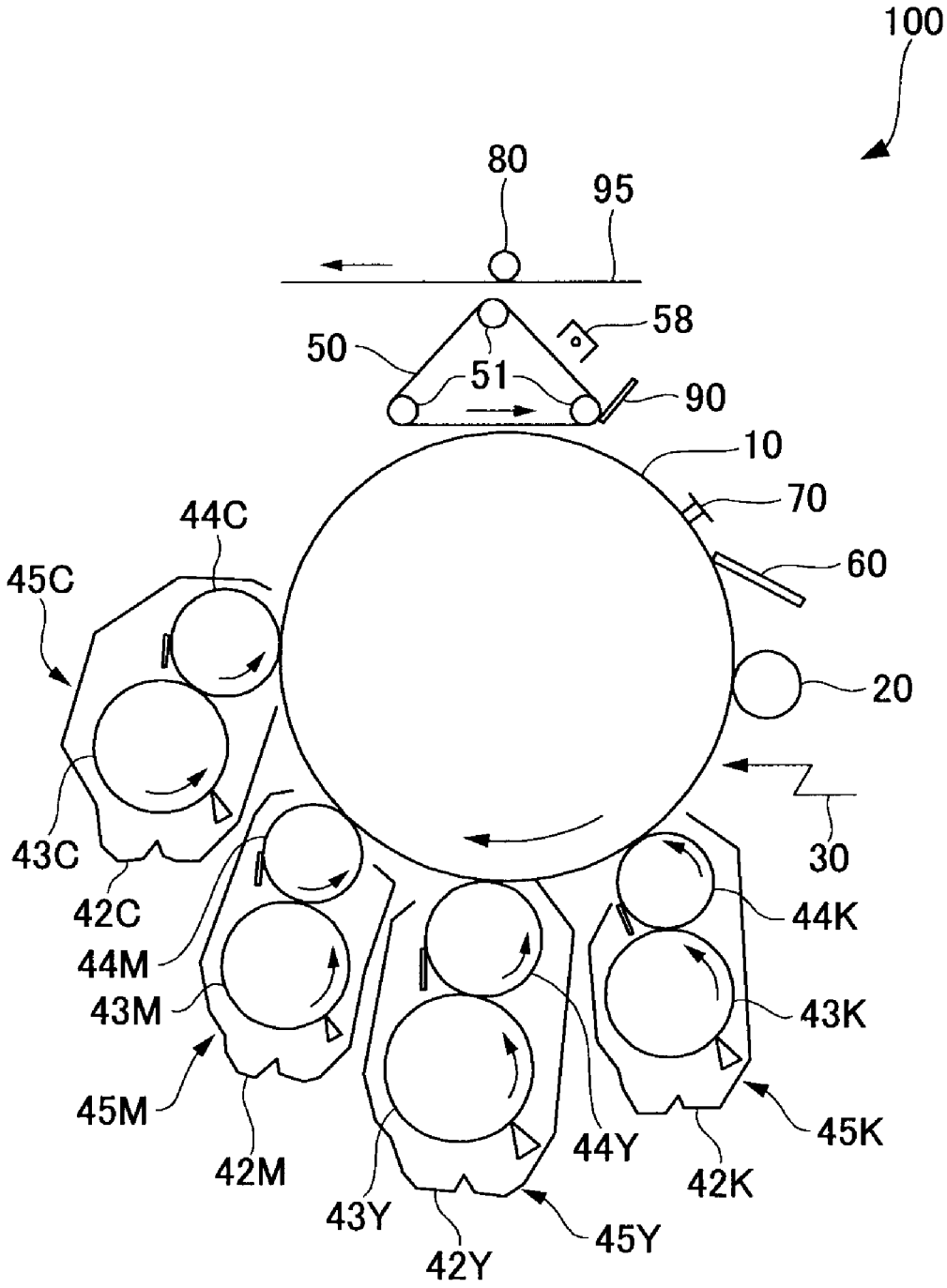
FIG. 16 is a schematic view that exemplarily shows another inventive image forming apparatus.

Another embodiment of the image forming method of the present invention by means of the image forming apparatus will be explained with reference to FIG. 16. The image forming apparatus 100 shown in FIG. 16 has an identical configuration and working effects to those of the image forming apparatus 100 shown in FIG. 15 except that this image forming apparatus 100 does not comprise the developing belt 41 and that the black developing unit 45K, yellow developing unit 45Y, magenta developing unit 45M and cyan developing unit 45C are disposed around the periphery of the photoconductor 10. The reference members identical to those in FIG. 16 are denoted by the same reference numerals as those of FIG. 15.

Tandem Image Forming Apparatus and Image Forming Method

Figure 17:
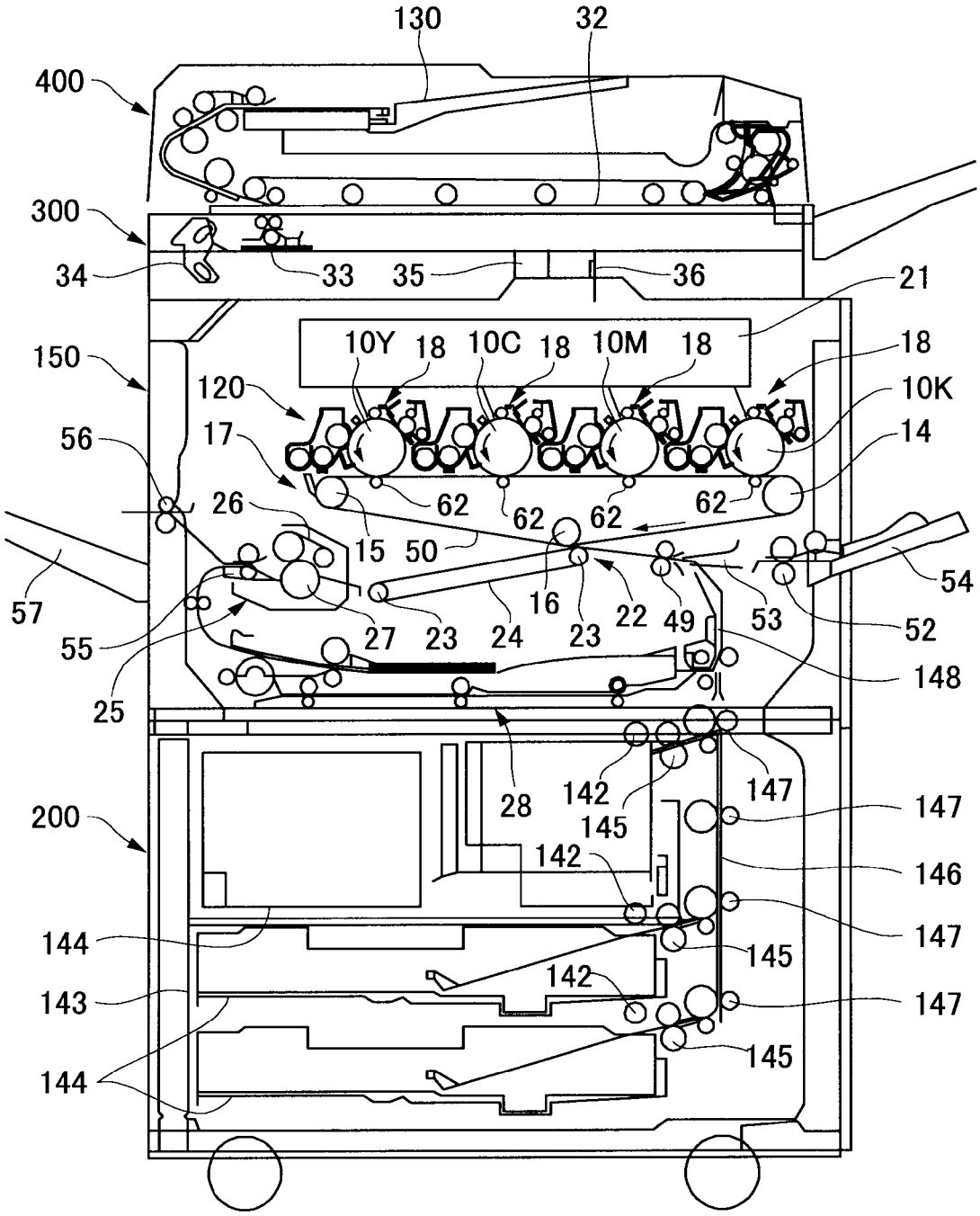
FIG. 17 is a schematic view that exemplarily shows an inventive tandem-type image forming apparatus.

Another embodiment of the image forming method of the present invention by means of the image forming apparatus will be described with reference to FIG. 17. The image forming apparatus 100 shown in FIG. 17 is a tandem color image-forming apparatus. The tandem image forming apparatus comprises a copy machine main body 150, a feeder table 200, a scanner 300, and an automatic document feeder (ADF) 400.

The copy machine main body 150 has an endless-belt intermediate transferring member 50 in the center. The intermediate transferring member 50 is looped around support rollers 14, 15 and 16 and is configured to rotate in a clockwise direction in FIG. 17. A cleaning device 17 for the intermediate transferring member is provided in the vicinity of the support roller 15. The cleaning device 17 removes toner particles remained on the intermediate transferring member 50. On the intermediate transferring member 50 looped around the support rollers 14 and 15, four color-image forming devices 18 of yellow, cyan, magenta, and black are arranged, constituting a tandem developing unit 120. An exposing unit 21 is arranged adjacent to the tandem developing unit 120. A secondary transferring unit 22 is arranged across the intermediate transferring member 50 from the tandem developing unit 120. The secondary transferring unit 22 comprises a secondary transferring belt 24, an endless belt, which is looped around a pair of rollers 23. A paper sheet on the secondary transferring belt 24 is allowed to contact the intermediate transferring member 50. An image fixing device 25 is arranged in the vicinity of the secondary transferring unit 22.

In the tandem image forming apparatus, a sheet reverser 28 is arranged adjacent to both the secondary transferring unit 22 and the image fixing device 25.

Next, full-color image formation (color copying) using the tandem developing unit 120 will be described. At first, a source document is placed on a document tray 130 of the automatic document feeder 400. Alternatively, the automatic document feeder 400 is opened, the source document is placed on a contact glass 32 of a scanner 300, and the automatic document feeder 400 is closed.

When a start switch (not shown) is pushed, the source document placed on the automatic document feeder 400 is transferred onto the contact glass 32, and the scanner 300 is then driven to operate first and second carriages 33 and 34. In a case where the source document is originally placed on the contact glass 32, the scanner 300 is immediately driven after pushing of the start switch. Light is applied from a light source to the document by means of the first carriage 33, and light reflected from the document is further reflected by the mirror of the second carriage 34. The reflected light passes through an image-forming lens 35, and a read sensor 36 receives it. In this way the color document (color image) is scanned, producing 4 types of color information of black, yellow, magenta, and cyan.

Figure 18:
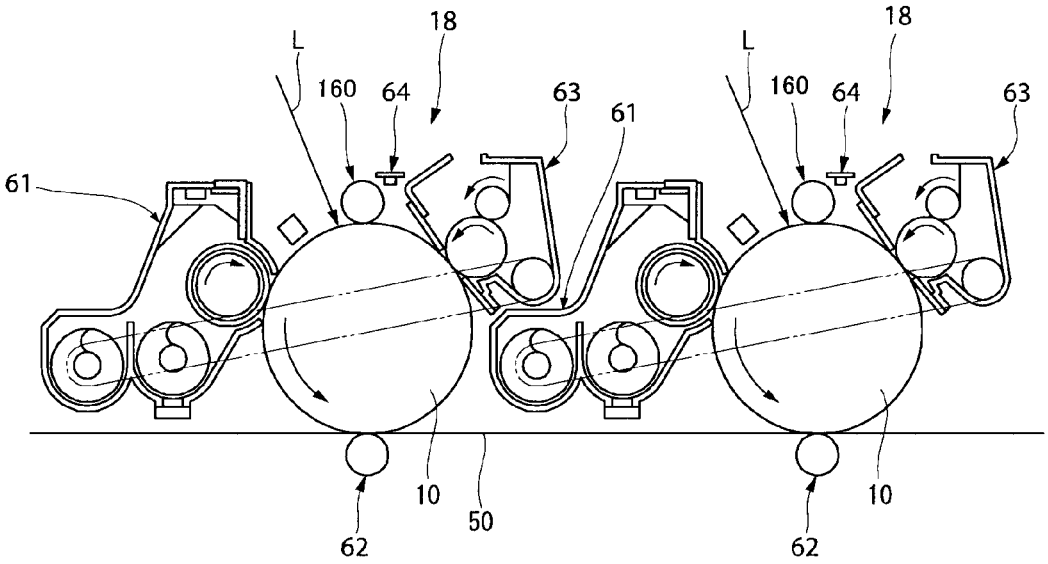
FIG. 18 is an enlarged view of the image forming elements shown in FIG. 17.

Each piece of color information (black, yellow, magenta, and cyan) is transmitted to the image forming unit 18 (black image forming unit, yellow image forming unit, magenta image forming unit, or cyan image forming unit) of the tandem developing unit 120, and toner images of each color are formed in the image-forming units 18. As shown in FIG. 18, each of the image-forming units 18 (black image-forming unit, yellow image forming unit, magenta image forming unit, and cyan image forming unit) of the tandem developing unit 120 comprises: a latent electrostatic image bearing member 10 (latent electrostatic image bearing member for black 10K, latent electrostatic image bearing member for yellow 10Y, latent electrostatic image bearing member for magenta 10M, or latent electrostatic image bearing member for cyan 10C); a charging device 60 for uniformly charging the latent electrostatic image bearing member; an exposing unit for forming a latent electrostatic image corresponding to the color image on the latent electrostatic image bearing member by exposing it to light ("L" in FIG. 18) on the basis of the corresponding color image information; a developing device 61 for developing the latent electrostatic image using the corresponding color toner (black toner, yellow toner, magenta toner, or cyan toner) to form a toner image; a transfer charger 62 for transferring the toner image to the intermediate transferring member 50; a cleaning device 63; and a charge removing device 64. Thus, images of different colors (a black image, a yellow image, a magenta image, and a cyan image) can be formed based on the color image information. The black toner image formed on the photoconductor for black 10K, yellow toner image formed on the photoconductor for yellow 10Y, magenta toner image formed on the photoconductor for magenta 10M, and cyan toner image formed on the photoconductor for cyan 10C are sequentially transferred onto the intermediate transferring member 50 which rotates by means of support rollers 14, 15 and 16 (primary transferring). These toner images are overlaid on the intermediate transferring member 50 to form a composite color image (color transferred image).

On the other hand, one of feed rollers 142 of the feed table 200 is selected and rotated, whereby a sheet of recording medium is ejected from one of multiple feed cassettes 144 in the paper bank 143 and are separated one by one by a separation roller 145. Thereafter, the sheet is fed to a feed path 146, transferred by a transfer roller 147 into a feed path 148 inside the copying machine main body 150, and are bumped against a resist roller 49 to stop. Alternatively, one of the feed rollers 142 is rotated to eject the recording medium placed on a manual feed tray. The sheets are then separated one by one by means of a separation roller 145, fed into a manual feed path 53, and similarly, bumped against the resist roller 49 to stop. The resist roller 49 is generally earthed, but it may be biased for removing paper dusts on the sheet. The resist roller 49 is rotated synchronously with the movement of the composite color image on the intermediate transferring member 50 to transfer the recording medium into between the intermediate transferring member 50 and the secondary transferring unit 22, and the composite color image is transferred onto the sheet by means of the secondary transferring unit 22 (secondary transferring). In this way the color image is formed on the sheet. After image transferring, toner particles remained on the intermediate transferring member 50 are cleaned by means of the cleaning device 17.

The sheet of recording medium having the transferred color image is conveyed by the secondary transferring unit 22 into the image fixing device 25, where the composite color image (color transferred image) is fixed to the sheet (recording sheet) by heat and pressure. Thereafter, the sheet changes its direction by action of a switch hook 55, ejected by an ejecting roller 56, and stacked on an output tray 57. Alternatively, the sheet changes its direction by action of the switch hook 55, flipped over by means of the sheet reverser 28, and transferred back to the image transfer section for recording of another image on the other side. The sheet that bears images on both sides is then ejected by means of the ejecting roller 56, and is stacked on the output tray 57.

Toner-Containing Container

The toner-containing container comprises the toner and/or the developer of the present invention in the container. The container may be properly selected from conventional ones; preferable examples of the container include one having a toner container body and a cap.

The toner container body may be properly selected as regards size, shape, structure, and material depending on the application. The shape is preferably a cylinder. It is particularly preferable that a spiral ridge is formed on the inner surface; thereby the content or the toner moves toward the discharging end when rotated and the spiral part partly or entirely serves as a bellows.

The material of the toner container body is not particularly limited and preferably offers dimensional accuracy. For example, resins are preferable. Among them, polyester resin, polyethylene resin, polypropylene resin, polystyrene resin, polyvinyl chloride resin, polyacrylic acid, polycarbonate resin, ABS resin, polyacetal resin are preferable.

The toner-containing container is easy to preserve and ship, is handy, and is preferably used with the process cartridge and image forming apparatus of the present invention, which are described later, by detachably mounting therein for supplying toner.

Process Cartridge

The process cartridge contains a latent electrostatic image bearing member that is configured to bear a latent electrostatic image thereon, and a developing unit which is configured to develop latent electrostatic images on the latent electrostatic image bearing member by use of a toner to form a visible image. The process cartridge further contains other units such as charging units, transfer units, cleaning units and discharging units as necessary. The toner is the inventive toner described above.

The developing unit has a developer storage for storing the aforementioned toner and/or developer of the present invention and a developer bearing member which is configured to hold and transfer the toner and/or developer stored in the developer storage and may further have a layer thickness control member for controlling the thickness of a toner layer formed on the developer bearing member. Specifically, one-component developing units or two-component developing units described above may be preferably employed.

The charging unit, transfer unit, cleaning unit and discharging unit may be substantially the same as those explained in image forming apparatuses.

The process cartridge may be detachably mounted in a variety of electrophotographic apparatuses, facsimiles and printers and preferably detachably mounted in the image forming apparatus of the present invention.

Figure 19:
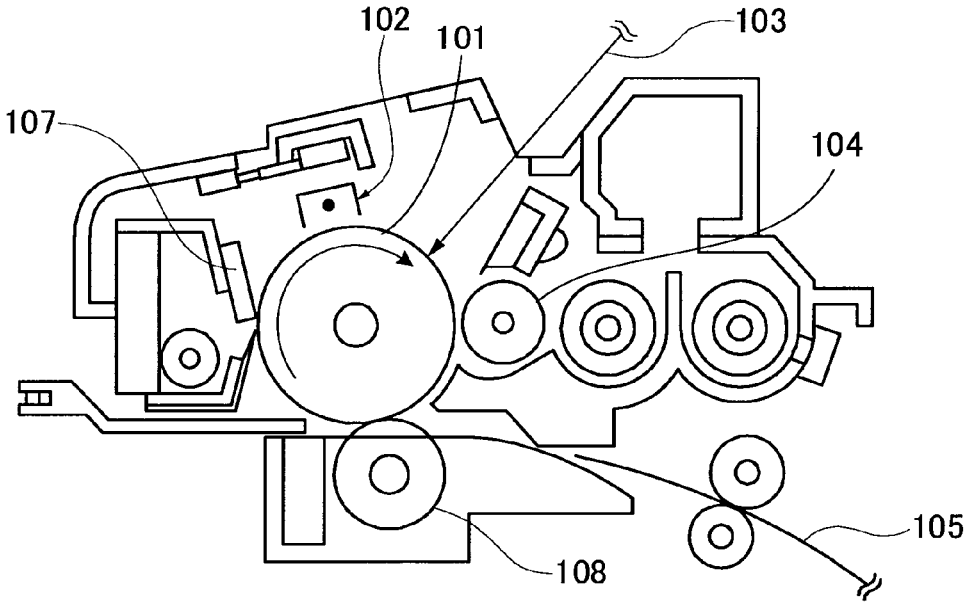
FIG. 19 is a schematic view that exemplarily shows an inventive process cartridge.

The process cartridge comprises, for example as shown in FIG. 19, a built-in photoconductor 101, charging unit 102, developing unit 104, and cleaning unit 107 and, where necessary, further contains other members. In FIG. 19, light irradiation 103 by means of an exposure unit and recording medium 105 are also shown.

The image forming process by means of the process cartridge as shown in FIG. 19 will be explained. A latent electrostatic image corresponding to an exposed image is formed on the photoconductor 101 which is being rotated in an arrow direction by charging using the charging unit 102 and exposing using exposure 103 of exposure unit (not shown). The latent electrostatic image is developed using the toner by means of the developing unit 104, the toner image is then transferred to the recording medium 105 by means of the transfer unit 108 and printed out. The surface of the photoconductor after image transfer is cleaned by means of the cleaning unit 107 and further discharged by means of a discharging unit (not shown) and the above operations are repeated again.

The image forming apparatuses, image forming methods, and process cartridges according to the present invention utilize the toners according to the present invention, thus can form very high quality images for a long period that are free from change of color tone or abnormal images like density reduction and background smear.

The present invention can solve the problems in the art, that is, a toner is provided that can be far from smear or pollution on members in developing units or on carriers, can be excellent in terms of durability, low temperature fixability, hot-offset resistance, storage stability, and milling ability, and can provide high quality images for a long period that are excellent in graininess and sharpness of images, even while using a toner recycle system, and also an image forming apparatus, an image forming method, and a process cartridge are provided that utilize the toner and thus can form very high quality images for a long period that are free from change of color tone or abnormal images like density reduction and background smear.

The image forming apparatuses, image forming methods, and process cartridges according to the present invention utilize the developers according to the present invention in the second aspect, thus can form very high quality images for a long period that are free from change of color tone or abnormal images like density reduction and background smear.

The present invention can solve the problems in the art, that is, a developer is provided that can be far from smear or pollution on members in developing units or on carriers, can be excellent in terms of durability, low temperature fixability, hot-offset resistance, and storage stability, and can provide very high quality images that are far from abnormal images such as density reduction and background smear even under variable temperature and humidity, and also an image forming apparatus, an image forming method, and a process cartridge are provided that utilize the developer and thus that can form very high quality images for a long period that are free from change of color tone or abnormal images like density reduction and background smear.

EXAMPLES

The present invention will be explained with reference to Examples, to which the present invention is in no way limited. In the following descriptions, all percentages and parts are expressed by mass unless indicated otherwise.

In Examples and Comparative Examples, softening temperature of resin, softening temperature of rosin, glass transition temperature Tg of resin or rosin, acid value of resin or rosin, and maximum endothermic peak of wax were measured in the following ways.

Measurement of Softening Temperature of Resin

Using a flow tester (CFT-500D, by Shimadzu Co.), 1 g of a sample resin was extruded from a nozzle of 1 mm diameter and 1 mm long under 1.96 MPa load from a plunger while heating at heat-up rate 6° C./min; and the descent level of the plunger was plotted against the temperature. The temperature, at which half of the sample had flowed out, was determined as the softening temperature.

Measurement of Softening Temperature of Rosin (i) Preparation of Sample 10 g of rosin was melted on a hot plate at 170° C. for 2 hours. Then the rosin was allowed to cool under an open condition at temperature 25° C. and relative humidity 50% for 1 hour, then milled for 10 seconds by use of a coffee mill (National MK-61M) to prepare a sample.

(ii) Measurement

Using a flow tester (CFT-500D, by Shimadzu Co.), 1 g of the sample was extruded from a nozzle of 1 mm diameter and 1 mm long under 1.96 MPa load from a plunger while heating at heat-up rate 6° C./min; and the descent level of the plunger was plotted against the temperature. The temperature, at which half of the polyester binder resin had flowed out, was determined as the softening temperature.

Measurement of Glass Transition Temperature Tg of Resin or Rosin

Using a differential scanning calorimeter (DSC210, by Seiko Instrument Inc.), 0.01 to 0.02 g of a sample was weighed on an aluminum pan, which was then heated to 200° C., thereafter the sample was cooled to 0° C. at cool-down rate 10° C./min followed by heating up at a rate of 10° C./min. The glass transition temperature was determined as the temperature of the point where two lines intersect, i.e. between the extending line of the base line below the endothermic maximum peak temperature and the tangent line at the maximum gradient from the rising point to the peak point.

Acid Value of Resin or Rosin

Acid value was determined in accordance with JIS K0070, except that the solvent was changed from the mixture of methanol and ether defined in JIS K0070 into a mixture of acetone and toluene (acetone/toluene=1/1 by volume).

Maximum Endothermic Peak of Wax

Maximum endothermic peak of wax was determined from a DSC curve measured by use of a differential scanning calorimeter (TA-60WS, DSC-60, by Shimadzu Co.) as a DSC measuring apparatus. The measuring method was based on ASTM D3418-82. The DSC curve was measured at heat-up rate 10° C./min after eliminating prior hysteresis by heating up and cooling down each one time.

Synthetic Example 1

Purification of Rosin 1000 g of tall rosin was added into a flask of 2000 ml equipped with a fractionating column, a reflux condenser, and a trap, and was distilled under a reduced pressure of 1 kPa, thereby distillate at 195° C. to 250° C. was mainly collected. Hereinafter, tall rosin to be purified is referred to as unpurified rosin, and rosin produced by way of collecting main distilling components is referred to as purified rosin.

20 g of rosin was milled for 5 seconds by use of a coffee mill (National MK-61M), and passed through a mesh of opening 1 mm, then the resulting powder was weighed in an amount of 0.5 g into a vial (20 ml) for headspace. Headspace gas was sampled and impurities within unpurified or purified rosin were analyzed by a headspace GC-MS method as follows. The results are shown in Table 1.

Measuring Condition in Headspace GC-MS Method (A) Headspace Sampler (HP7694, by Agilent Co.)
Sample temperature: 200° C.
Loop temperature: 200° C.
Transfer line temperature: 200° C.
Heating time of equilibrium sample: 30 minutes
Pressure gas in vial: helium (He)
Pressure time at vial: 0.3 minute
Loop filling time: 0.03 minute
Equilibrium time at loop: 0.3 minute
Injecting time: 1 minute (B) Gas Chromatography (GC) (HP6890, by Agilent Co.)
Analytical column: DB-1 (60 m-320 μm-5 μm)
Carrier gas: helium (He)
Flow rate: 1 ml/min
Injection temperature: 210° C.
Column head pressure: 34.2 kPa
Injection mode: split
Split ratio: 10:1
Oven temperature: 45° C. (3 minutes)-10° C./min-280° C. (15 minutes)

(C) Mass Spectrometry (MS) (HP5973, by Agilent Co.)
Ionization method: electron impulse (EI)
Interface temperature: 280° C.
Ion source temperature: 230° C.
Quadrupole temperature: 150° C.
Detection mode: Scan 29 to 350 m/sec

TABLE 1

| | hexanoic acid | pentanoic acid | benzaldehyde | n-hexanal | 2-pentylfuran | softening temperature (° C.) | acid value (mgKOH/g) |
|---|---|---|---|---|---|---|---|
| purified rosin | $0.6 \times 10^7$ | $0.4 \times 10^7$ | $0.4 \times 10^7$ | $1.6 \times 10^7$ | $1.9 \times 10^7$ | 75.0 | 167 |

Synthetic Example 2

Synthesis of Polyester Resin

The alcohol components, terephthalic acid, and esterification catalyst of resin H1 shown in Table 2 were added into a four-necked 5 L flask, equipped with a nitrogen inlet, a water outlet, a stirrer, and a thermocouple, then the mixture was subjected to condensation polymerization at 230° C. for 15 hours under nitrogen atmosphere, followed by reacting at 230° C. for 1 hour under 8.0 kPa. After cooling the reactant to 180° C., a purified rosin was added, then the mixture was allowed to react at 200° C. for 15 hours. After cooling the reactant to 180° C., itaconic acid was added, then the mixture was allowed to react at 200° C. for 8 hours. After cooling the reactant to 180° C., trimellitic anhydride was added, then the mixture was heated to 210° C. over two hours, and allowed to react at 210° C. under 10 kPa till an intended softening temperature was realized thereby to synthesize a polyester resin (resin H1).

Synthetic Example 3

Synthesis of Polyester Resin

The alcohol components, terephthalic acid, and esterification catalyst of resin L1 shown in Table 3 were added into a four-necked 5 L flask, equipped with a nitrogen inlet, a water outlet, a stirrer, and a thermocouple, then the mixture was subjected to condensation polymerization at 230° C. for 15 hours under nitrogen atmosphere, followed by reacting at 230° C. for 1 hour under 8.0 kPa. After cooling the reactant to 180° C., a purified rosin was added, then the mixture was allowed to react at 200° C. for 15 hours. After cooling the reactant to 180° C., itaconic acid was added, then the mixture was heated to 210° C. over two hours, and allowed to react at 210° C. under 10 kPa till an intended softening temperature was realized thereby to synthesize a polyester resin (resin L1).

Synthetic Example 4

Synthesis of Polyester Resin

The alcohol components, terephthalic acid, and esterification catalyst of resin L2 shown in Table 3 were added into a four-necked 5 L flask, equipped with a nitrogen inlet, a water outlet, a stirrer, and a thermocouple, then the mixture was subjected to condensation polymerization at 230° C. for 15 hours under nitrogen atmosphere, followed by reacting at 230° C. for 1 hour under 8.0 kPa. After cooling the reactant to 180° C., itaconic acid was added, then the mixture was heated to 210° C. over two hours, and allowed to react at 210° C. under 10 kPa till an intended softening temperature was realized thereby to synthesize a polyester resin (resin L2).

Synthetic Example 5

Synthesis of Polyester Resin

The alcohol components, terephthalic acid, and esterification catalysts of Resins H2 to H4 and H8 shown in Table 2 were respectively added into a four-necked 5 L flask, equipped with a nitrogen inlet, a water outlet, a fractionator, a stirrer, and a thermocouple, then each of the mixtures was subjected to condensation polymerization at 230° C. for 15 hours under nitrogen atmosphere, followed by reacting at 230° C. for 1 hour under 8.0 kPa. After cooling each of the reactants to 180° C., trimellitic anhydride was added, then the mixture was heated to 210° C. over 3 hours and reacted for 10 hours under normal pressure of 101.3 kPa, followed by reacting at 210° C. under 20 kPa till an intended softening temperature was realized thereby to synthesize polyester resins (Resins H2 to H4 and H8).

Synthetic Example 6

Synthesis of Polyester Resin

The alcohol components, terephthalic acid, and esterification catalysts of Resins H5, H6 and L3 to L6 shown in Tables 2 and 3 were respectively added into a four-necked 5 L flask, equipped with a nitrogen inlet, a water outlet, a fractionator, a stirrer, and a thermocouple, then each of the mixtures was subjected to condensation polymerization at 230° C. for 15 hours under nitrogen atmosphere, followed by reacting at 230° C. under 20 kPa till an intended softening temperature was realized thereby to synthesize polyester resins (Resins H5, H6 and L3 to L6).

Synthetic Example 7

Synthesis of Polyester Resin 6 moles of bisphenol A propylene oxide, 4 moles of bisphenol A ethylene oxide, 8 moles of terephthalic acid, and 3 moles of trimellitic anhydride were added into a four-necked 5 L flask, equipped with a nitrogen inlet, a water outlet, a fractionator, a stirrer, and a thermocouple, then the mixture was subjected to condensation polymerization at 220° C. for 15 hours under nitrogen atmosphere, followed by reacting at 220° C. under 20 kPa till an intended softening temperature was realized thereby to synthesize a polyester resin (resin L7).

The resulting resin L7 had a softening temperature of 106.3° C., a glass transition temperature of 59.0° C., and an acid value of 21.0 mgKOH/g.

Synthetic Example 8

Synthesis of Polyester Resin 6 moles of bisphenol A propylene oxide, 4 moles of bisphenol A ethylene oxide, 10 moles of fumaric acid, and 4 moles of trimellitic anhydride were added into a four-necked 5 L flask, equipped with a nitrogen inlet, a water outlet, a fractionator, a stirrer, and a thermocouple, then the mixture was subjected to condensation polymerization at 220° C. for 15 hours under nitrogen atmosphere, followed by reacting at 220° C. under 20 kPa till an intended softening temperature was realized thereby to synthesize a polyester resin (resin H7).

The resulting resin H7 had a softening temperature of 142.5° C., a glass transition temperature of 63.1° C., and an acid value of 28.1 mgKOH/g.

TABLE 2

| | | resin No. | | | | | | |
|---|---|---|---|---|---|---|---|---|
| | | resin H1 | resin H2 | resin H3 | resin H4 | resin H5 | resin H6 | resin H8 |
| alcohol ingredient | 1,3-propanediol | 228 g (20) | 228 g (20) | — | — | 1142 g (100) | — | 457 g (40) |
| | 1,2-propanediol | 913 g (80) | 913 g (80) | 913 g (80) | 1142 g (100) | — | — | 685 g (60) |
| | 2,3-butanediol | — | — | — | — | — | 1350 g (100) | — |
| | glycerin | 276 g (20) | 276 g (20) | 276 g (20) | — | — | — | 276 g (20) |
| carboxylic acid ingredient | terephthalic acid | 2117 g (85) | 2117 g (85) | 1245 g (50) | 1743 g (70) | 1992 g (80) | 1992 g (80) | 2117 g (85) |
| | itaconic acid | 195 g (10) | — | — | — | — | — | 195 g (10) |
| | trimellitic anhydride | 144 g (5) | 144 g (5) | 576 g (20) | 288 g (10) | — | — | 144 g (5) |
| | purified rosin | 498 g (10) | — | — | — | — | — | 498 g (10) |
| esterification catalyst | dibutyltin oxide | — | — | — | — | 0.5 | 0.5 | — |
| | tin (II) dioctanoate | 0.5 | 0.5 | 0.5 | 0.5 | — | — | 0.5 |
| properties of polyester resin | softening temperature (° C.) | 144.5 | 145.3 | 144.2 | 150.8 | 73.3 | 121.5 | 125.0 |
| | glass transition temperature (° C.) | 62.5 | 63.2 | 60.8 | 65.3 | 31.1 | 49.9 | 58.2 |
| | acid value (mgKOH/g) | 35.0 | 32.3 | 49.4 | 41.7 | 45.2 | 43.6 | 34.2 |

The values of amounts as to alcohols and carboxylic acids in parentheses correspond to respective mole ratios.

The amounts of esterification catalysts correspond to a relative amount by mass based on a total of 100 parts by mass of alcohol and carboxylic acid components.

TABLE 3

| | | resin No. | | | | | |
|---|---|---|---|---|---|---|---|
| | | resin L1 | resin L2 | resin L3 | resin L4 | resin L5 | resin L6 |
| alcohol ingredient | 1,3-propanediol | — | — | — | — | 1142 g (100) | — |
| | 1,2-propanediol | 913 g (80) | 913 g (80) | 913 g (80) | 1142 g (100) | — | — |
| | 2,3-butanediol | — | — | — | — | — | 1350 g (100) |
| | glycerin | 276 g (20) | 276 g (20) | 276 g (20) | — | — | — |

TABLE 3-continued

| | | resin No. | | | | | |
|---|---|---|---|---|---|---|---|
| | | resin L1 | resin L2 | resin L3 | resin L4 | resin L5 | resin L6 |
| carboxylic acid ingredient | terephthalic acid | 1743 g (70) | 1992 g (80) | 1992 g (80) | 1992 g (80) | 1743 g (70) | 1743 g (70) |
| | itaconic acid | 432 g (15) | 432 g (15) | — | — | — | — |
| | purified rosin | 1444 g (29) | — | — | — | — | — |
| esterification catalyst | dibutyltin oxide | — | — | — | — | 0.5 | 0.5 |
| | tin (II) dioctanoate | 0.5 | 0.5 | 0.5 | 0.5 | — | — |
| properties of polyester resin | softening temperature (° C.) | 107.0 | 105.3 | 101.6 | 105.0 | 86.2 | 80.5 |
| | glass transition temperature (° C.) | 58.8 | 57.2 | 56.6 | 58.5 | 40.8 | 38.9 |
| | acid value (mgKOH/g) | 38.8 | 35.6 | 40.3 | 30.9 | 35.2 | 32.8 |

The values of amounts as to alcohols and carboxylic acids in parentheses correspond to respective mole ratios.
The amounts of esterification catalysts correspond to a relative amount by mass based on a total of 100 parts by mass of alcohol and carboxylic acid components.

Production Example A-1

Production of Master Batch A1

The pigments shown below, polyester binder resin L1, and pure water were mixed in a ratio of 1:1:0.5 by mass, and kneaded by a twin roll at 70° C.; then the roll temperature was raised to 120° C. to evaporate water, thereby to produce master batch A1 comprised of cyan toner master batch A1 (MB-C1), magenta toner master batch A1 (MB-M1), yellow toner master batch A1 (MB-Y1), and black toner master batch A1 (MB-K1).

| Ingredients of Cyan-Toner Master Batch A1 (MB-C1) | |
|---|---|
| Resin L1 | 100 parts |
| Cyan pigment (C.I. Pigment Blue 15:3) | 100 parts |
| Pure water | 50 parts |
| Ingredients of Magenta-Toner Master Batch A1 (MB-M1) | |
| Resin L1 | 100 parts |
| Magenta pigment (C.I. Pigment Red 122) | 100 parts |
| Pure water | 50 parts |
| Ingredients of Yellow-Toner Master Batch A1 (MB-Y1) | |
| Resin L1 | 100 parts |
| Yellow pigment (C.I. Pigment Yellow 180) | 100 parts |
| Pure water | 50 parts |
| Ingredients of Black-Toner Master Batch A1 (MB-K1) | |
| Resin L1 | 100 parts |
| Black pigment (carbon black) | 100 parts |
| Pure water | 50 parts |

Production Example A-2

Production of Master Batch A2

Master batch A2 comprised of cyan-toner master batch A2 (MB-C2), magenta-toner master batch A2 (MB-M2), yellow-toner master batch A2 (MB-Y2), and black-toner master batch A2 (MB-K2) was prepared in the same manner as Production Example A-1 except that resin L1 was changed into resin L2.

Production Example A-3

Production of Master Batch A3

Master batch A3 comprised of cyan-toner master batch A3 (MB-C3), magenta-toner master batch A3 (MB-M3), yellow-toner master batch A3 (MB-Y3), and black-toner master batch A3 (MB-K3) was prepared in the same manner as Production Example A-1 except that resin L1 was changed into resin L3.

Production Example A-4

Production of Master Batch A4

Master batch A4 comprised of cyan-toner master batch A4 (MB-C4), magenta-toner master batch A4 (MB-M4), yellow-toner master batch A4 (MB-Y4), and black-toner master batch A4 (MB-K4) was prepared in the same manner as Production Example A-1 except that resin L1 was changed into resin L4.

Production Example A-5

Production of Master Batch A5

Master batch A5 comprised of cyan-toner master batch A5 (MB-C5), magenta-toner master batch A5 (MB-M5), yellow-toner master batch A5 (MB-Y5), and black-toner master batch A5 (MB-K5) was prepared in the same manner as Production Example A-1 except that resin L1 was changed into resin L5.

Production Example A-6

Production of Master Batch A6

Master batch A6 comprised of cyan-toner master batch A6 (MB-C6), magenta-toner master batch A6 (MB-M6), yellow-toner master batch A6 (MB-Y6), and black-toner master batch A6 (MB-K6) was prepared in the same manner as Production Example A-1 except that resin L1 was changed into resin L6.

Production Example A-7

Production of Master Batch A7

Master batch A7 comprised of cyan-toner master batch A7 (MB-C7), magenta-toner master batch A7 (MB-M7), yellow-toner master batch A7 (MB-Y7), and black-toner master batch A7 (MB-K7) was prepared in the same manner as Production Example A-1 except that resin L1 was changed into resin L7.

TABLE 4

| | | | resin formulation | | pigment formulation | | deionized |
|---|---|---|---|---|---|---|---|
| | | | resin | amount (parts by mass) | pigment | amount (parts by mass) | water (parts by mass) |
| master batch A1 | cyan | MB-C1 | resin L1 | 100 | C.I.P. blue 15.3 | 100 | 50 |
| | magenta | MB-M1 | resin L1 | 100 | C.I.P. red 122 | 100 | 50 |
| | yellow | MB-Y1 | resin L1 | 100 | C.I.P. yellow 180 | 100 | 50 |
| | black | MB-K1 | resin L1 | 100 | carbon black | 100 | 50 |
| master batch A2 | cyan | MB-C2 | resin L2 | 100 | C.I.P. blue 15.3 | 100 | 50 |
| | magenta | MB-M2 | resin L2 | 100 | C.I.P. red 122 | 100 | 50 |
| | yellow | MB-Y2 | resin L2 | 100 | C.I.P. yellow 180 | 100 | 50 |
| | black | MB-K2 | resin L2 | 100 | carbon black | 100 | 50 |
| master batch A3 | cyan | MB-C3 | resin L3 | 100 | C.I.P. blue 15.3 | 100 | 50 |
| | magenta | MB-M3 | resin L3 | 100 | C.I.P. red 122 | 100 | 50 |
| | yellow | MB-Y3 | resin L3 | 100 | C.I.P. yellow 180 | 100 | 50 |
| | black | MB-K3 | resin L3 | 100 | carbon black | 100 | 50 |
| master batch A4 | cyan | MB-C4 | resin L4 | 100 | C.I.P. blue 15.3 | 100 | 50 |
| | magenta | MB-M4 | resin L4 | 100 | C.I.P. red 122 | 100 | 50 |
| | yellow | MB-Y4 | resin L4 | 100 | C.I.P. yellow 180 | 100 | 50 |
| | black | MB-K4 | resin L4 | 100 | carbon black | 100 | 50 |
| master batch A5 | cyan | MB-C5 | resin L5 | 100 | C.I.P. blue 15.3 | 100 | 50 |
| | magenta | MB-M5 | resin L5 | 100 | C.I.P. red 122 | 100 | 50 |
| | yellow | MB-Y5 | resin L5 | 100 | C.I.P. yellow 180 | 100 | 50 |
| | black | MB-K5 | resin L5 | 100 | carbon black | 100 | 50 |
| master batch A6 | cyan | MB-C6 | resin L6 | 100 | C.I.P. blue 15.3 | 100 | 50 |
| | magenta | MB-M6 | resin L6 | 100 | C.I.P. red 122 | 100 | 50 |
| | yellow | MB-Y6 | resin L6 | 100 | C.I.P. yellow 180 | 100 | 50 |
| | black | MB-K6 | resin L6 | 100 | carbon black | 100 | 50 |
| master batch A7 | cyan | MB-C7 | resin L7 | 100 | C.I.P. blue 15.3 | 100 | 50 |
| | magenta | MB-M7 | resin L7 | 100 | C.I.P. red 122 | 100 | 50 |
| | yellow | MB-Y7 | resin L7 | 100 | C.I.P. yellow 180 | 100 | 50 |
| | black | MB-K7 | resin L7 | 100 | carbon black | 100 | 50 |

C.I.P.: C.I. Pigment

Example A-1

Preparation of Toner A1

Toner A1 comprised of cyan toner A1, magenta toner A1, yellow toner A1, and black toner A1 was prepared as follows.

Production of Cyan Toner A1

The ingredients of cyan toner A1 shown below were pre-mixed by a Henschel mixer (FM10B, by Mitsui Mining Co.), then melt and kneaded at 100° C. to 130° C. by a two-axis kneader (PCM-30, by Ikegai, Ltd.). The resulting mixed-kneaded material was cooled to room temperature, then was coarsely milled into an average particle diameter of 200 to 400 μm by use of a hammer mill. Then the material was finely milled by a supersonic jet mill (Labo Jet, by Japan Pneumatic Mfg. Co.) at a rotation number 36 Hz of the feeder and a jet air pressure of 0.40 MPa to produce toner base particles.

To 100 parts by mass of the toner base particles, 1.0 part by mass of an additive (HDK-2000, by Clariant Co.) was mixed by a Henschel mixer, thereby to produce a cyan toner A1.

| Ingredients of Cyan Toner A1 | |
|---|---|
| Resin H1 of polyester resin (A) | 50 parts |
| Resin L1 of polyester resin (B) | 42 parts |
| Cyan-toner master batch A1 (MB-C1) | 16 parts |

-continued

| Ingredients of Cyan Toner A1 | |
|---|---|
| Paraffin wax HNP-9PD*1) | 3 parts |
| Charge control agent Bontron E-84*2) | 1 part |

*1)maximum endothermic peak: 75.7° C., by Nippon Seiro Co.
*2)Zn (II) 3,5-di-t-butylsalicylate, by Orient Chemical Co.

Preparation of Magenta Toner A1

Magenta toner A1 was prepared in the same manner as cyan toner A1 except that the ingredients of the cyan toner A1 were changed into the ingredients of magenta toner A1 as follows:

| Ingredients of Magenta Toner A1 | |
|---|---|
| Resin H1 of polyester resin (A) | 50 parts |
| Resin L1 of polyester resin (B) | 40 parts |

-continued

| Ingredients of Magenta Toner A1 | |
|---|---|
| Magenta-toner master batch A1 (MB-M1) | 20 parts |
| Paraffin wax HNP-9PD*1) | 3 parts |
| Charge control agent Bontron E-84*2) | 1 part |

*1)maximum endothermic peak: 75.7° C., by Nippon Seiro Co.
*2)Zn (II) 3,5-di-t-butylsalicylate, by Orient Chemical Co.

Preparation of Yellow Toner A1

Yellow toner A1 was prepared in the same manner as cyan toner A1 except that the ingredients of the cyan toner A1 were changed into the ingredients of yellow toner A1 as follows:

| Ingredients of Yellow Toner A1 | |
|---|---|
| Resin H1 of polyester resin (A) | 50 parts |
| Resin L1 of polyester resin (B) | 40 parts |
| Yellow-toner master batch A1 (MB-Y1) | 20 parts |
| Paraffin wax HNP-9PD*1) | 3 parts |
| Charge control agent Bontron E-84*2) | 1 part |

*1)maximum endothermic peak: 75.7° C., by Nippon Seiro Co.
*2)Zn (II) 3,5-di-t-butylsalicylate, by Orient Chemical Co.

Preparation of Black Toner A1

Black toner A1 was prepared in the same manner as cyan toner A1 except that the ingredients of the cyan toner A1 were changed into the ingredients of black toner A1 as follows:

| Ingredients of Black Toner A1 | |
|---|---|
| Resin H1 of polyester resin (A) | 50 parts |
| Resin L1 of polyester resin (B) | 42 parts |
| Black-toner master batch A1 (MB-K1) | 16 parts |
| Paraffin wax HNP-9PD*1) | 3 parts |
| Charge control agent Bontron E-84*2) | 1 part |

*1)maximum endothermic peak: 75.7° C., by Nippon Seiro Co.
*2)Zn (II) 3,5-di-t-butylsalicylate, by Orient Chemical Co.

Example A-2

Preparation of Toner A2

Toner A2 comprised of cyan toner A2, yellow toner A2, magenta toner A2, and black toner A2 was prepared in the same manner as Example A-1 except for changing the respective ingredients of Example A-1 into those shown below.

| Ingredients of Cyan Toner A2 | |
|---|---|
| Resin H2 of polyester resin (A) | 50 parts |
| Resin L5 of polyester resin (B) | 42 parts |
| Cyan-toner master batch A5 (MB-C5) | 16 parts |
| Paraffin wax HNP-9PD*1) | 3 parts |
| Charge control agent Bontron E-84*2) | 1 part |
| **Ingredients of Magenta Toner A2** | |
| Resin H2 of polyester resin (A) | 50 parts |
| Resin L5 of polyester resin (B) | 40 parts |
| Magenta-toner master batch A5 (MB-M5) | 20 parts |
| Paraffin wax HNP-9PD*1) | 3 parts |
| Charge control agent Bontron E-84*2) | 1 part |
| **Ingredients of Yellow Toner A2** | |
| Resin H2 of polyester resin (A) | 50 parts |
| Resin L5 of polyester resin (B) | 40 parts |
| Yellow-toner master batch A5 (MB-Y5) | 20 parts |
| Paraffin wax HNP-9PD*1) | 3 parts |
| Charge control agent Bontron E-84*2) | 1 part |
| **Ingredients of Black Toner A2** | |
| Resin H2 of polyester resin (A) | 50 parts |
| Resin L5 of polyester resin (B) | 42 parts |
| Black-toner master batch A5 (MB-K5) | 16 parts |
| Paraffin wax HNP-9PD*1) | 3 parts |
| Charge control agent Bontron E-84*2) | 1 part |

*1)maximum endothermic peak: 75.7° C., by Nippon Seiro Co.
*2)Zn (II) 3,5-di-t-butylsalicylate, by Orient Chemical Co.

Example A-3

Preparation of Toner A3

Toner A3 comprised of cyan toner A3, yellow toner A3, magenta toner A3, and black toner A3 was prepared in the same manner as Example A-1 except for changing the respective ingredients of Example A-1 into those shown below.

| Ingredients of Cyan Toner A3 | |
|---|---|
| Resin H6 of polyester resin (A) | 50 parts |
| Resin L2 of polyester resin (B) | 42 parts |
| Cyan-toner master batch A2 (MB-C2) | 16 parts |
| Paraffin wax HNP-9PD*1) | 3 parts |
| Charge control agent Bontron E-84*2) | 1 part |
| **Ingredients of Magenta Toner A3** | |
| Resin H6 of polyester resin (A) | 50 parts |
| Resin H2 of polyester resin (B) | 40 parts |
| Magenta-toner master batch A2 (MB-M2) | 20 parts |
| Paraffin wax HNP-9PD*1) | 3 parts |
| Charge control agent Bontron E-84*2) | 1 part |
| **Ingredients of Yellow Toner A3** | |
| Resin H6 of polyester resin (A) | 50 parts |
| Resin H2 of polyester resin (B) | 40 parts |
| Yellow-toner master batch A2 (MB-Y2) | 20 parts |
| Paraffin wax HNP-9PD*1) | 3 parts |
| Charge control agent Bontron E-84*2) | 1 part |
| **Ingredients of Black Toner A3** | |
| Resin H6 of polyester resin (A) | 50 parts |
| Resin L2 of polyester resin (B) | 42 parts |
| Black-toner master batch A2 (MB-K2) | 16 parts |
| Paraffin wax HNP-9PD*1) | 3 parts |
| Charge control agent Bontron E-84*2) | 1 part |

*1)maximum endothermic peak: 75.7° C., by Nippon Seiro Co.
*2)Zn (II) 3,5-di-t-butylsalicylate, by Orient Chemical Co.

Example A-4

Preparation of Toner A4

Toner A4 comprised of cyan toner A4, yellow toner A4, magenta toner A4, and black toner A4 was prepared in the same manner as Example A-1 except for changing the respective ingredients of Example A-1 into those shown below.

| Ingredients of Cyan Toner A4 | |
|---|---|
| Resin H2 of polyester resin (A) | 50 parts |
| Resin L2 of polyester resin (B) | 42 parts |
| Cyan-toner master batch A2 (MB-C2) | 16 parts |
| Paraffin wax HNP-9PD*1) | 3 parts |
| Charge control agent Bontron E-84*2) | 1 part |
| Ingredients of Magenta Toner A4 | |
| Resin H2 of polyester resin (A) | 50 parts |
| Resin L2 of polyester resin (B) | 40 parts |
| Magenta-toner master batch A2 (MB-M2) | 20 parts |
| Paraffin wax HNP-9PD*1) | 3 parts |
| Charge control agent Bontron E-84*2) | 1 part |
| Ingredients of Yellow Toner A4 | |
| Resin H2 of polyester resin (A) | 50 parts |
| Resin L2 of polyester resin (B) | 40 parts |
| Yellow-toner master batch A2 (MB-Y2) | 20 parts |
| Paraffin wax HNP-9PD*1) | 3 parts |
| Charge control agent Bontron E-84*2) | 1 part |
| Ingredients of Black Toner A4 | |
| Resin H2 of polyester resin (A) | 50 parts |
| Resin L2 of polyester resin (B) | 42 parts |
| Black-toner master batch A2 (MB-K2) | 16 parts |
| Paraffin wax HNP-9PD*1) | 3 parts |
| Charge control agent Bontron E-84*2) | 1 part |

*1)maximum endothermic peak: 75.7° C., by Nippon Seiro Co.
*2)Zn (II) 3,5-di-t-butylsalicylate, by Orient Chemical Co.

Example A-5

Preparation of Toner A5

Toner A5 comprised of cyan toner A5, yellow toner A5, magenta toner A5, and black toner A5 was prepared in the same manner as Example A-1 except for changing the respective ingredients of Example A-1 into those shown below.

| Ingredients of Cyan Toner A5 | |
|---|---|
| Resin H3 of polyester resin (A) | 50 parts |
| Resin L3 of polyester resin (B) | 42 parts |
| Cyan-toner master batch A3 (MB-C3) | 16 parts |
| Paraffin wax HNP-9PD*1) | 3 parts |
| Charge control agent Bontron E-84*2) | 1 part |
| Ingredients of Magenta Toner A5 | |
| Resin H3 of polyester resin (A) | 50 parts |
| Resin L3 of polyester resin (B) | 50 parts |
| Magenta-toner master batch A3 (MB-M3) | 20 parts |
| Paraffin wax HNP-9PD*1) | 3 parts |
| Charge control agent Bontron E-84*2) | 1 part |
| Ingredients of Yellow Toner A5 | |
| Resin H3 of polyester resin (A) | 50 parts |
| Resin L3 of polyester resin (B) | 40 parts |
| Yellow-toner master batch A3 (MB-Y3) | 20 parts |
| Paraffin wax HNP-9PD*1) | 3 parts |
| Charge control agent Bontron E-84*2) | 1 part |
| Ingredients of Black Toner A5 | |
| Resin H3 of polyester resin (A) | 50 parts |
| Resin L3 of polyester resin (B) | 42 parts |
| Black-toner master batch A3 (MB-K3) | 16 parts |
| Paraffin wax HNP-9PD*1) | 3 parts |
| Charge control agent Bontron E-84*2) | 1 part |

*1)maximum endothermic peak: 75.7° C., by Nippon Seiro Co.
*2)Zn (II) 3,5-di-t-butylsalicylate, by Orient Chemical Co.

Example A-6

Preparation of Toner A6

Toner A6 comprised of cyan toner A6, yellow toner A6, magenta toner A6, and black toner A6 was prepared in the same manner as Example A-1 except for changing the respective ingredients of Example A-1 into those shown below.

| Ingredients of Cyan Toner A6 | |
|---|---|
| Resin H4 of polyester resin (A) | 50 parts |
| Resin L4 of polyester resin (B) | 42 parts |
| Cyan-toner master batch A4 (MB-C4) | 16 parts |
| Paraffin wax HNP-9PD*1) | 3 parts |
| Charge control agent Bontron E-84*2) | 1 part |
| Ingredients of Magenta Toner A6 | |
| Resin H4 of polyester resin (A) | 50 parts |
| Resin L4 of polyester resin (B) | 40 parts |
| Magenta-toner master batch A4 (MB-M4) | 20 parts |
| Paraffin wax HNP-9PD*1) | 3 parts |
| Charge control agent Bontron E-84*2) | 1 part |
| Ingredients of Yellow Toner A6 | |
| Resin H4 of polyester resin (A) | 50 parts |
| Resin L4 of polyester resin (B) | 40 parts |
| Yellow-toner master batch A4 (MB-Y4) | 20 parts |
| Paraffin wax HNP-9PD*1) | 3 parts |
| Charge control agent Bontron E-84*2) | 1 part |
| Ingredients of Black Toner A6 | |
| Resin H4 of polyester resin (A) | 50 parts |
| Resin L4 of polyester resin (B) | 42 parts |
| Black-toner master batch A4 (MB-K4) | 16 parts |
| Paraffin wax HNP-9PD*1) | 3 parts |
| Charge control agent Bontron E-84*2) | 1 part |

*1)maximum endothermic peak: 75.7° C., by Nippon Seiro Co.
*2)Zn (II) 3,5-di-t-butylsalicylate, by Orient Chemical Co.

Example A-7

Preparation of Toner A7

Toner A7 comprised of cyan toner A7, yellow toner A7, magenta toner A7, and black toner A7 was prepared in the same manner as Example A-1 except for changing the respective ingredients of Example A-1 into those shown below.

| Ingredients of Cyan Toner A7 | |
|---|---|
| Resin H1 of polyester resin (A) | 50 parts |
| Resin L1 of polyester resin (B) | 42 parts |
| Cyan-toner master batch A1 (MB-C1) | 16 parts |
| Paraffin wax HNP-9PD*1) | 3 parts |
| Charge control agent Bontron E-84*2) | 1 part |
| Ingredients of Magenta Toner A7 | |
| Resin H1 of polyester resin (A) | 50 parts |
| Resin L1 of polyester resin (B) | 40 parts |
| Magenta-toner master batch A1 (MB-M1) | 20 parts |
| Paraffin wax HNP-9PD*1) | 3 parts |
| Charge control agent Bontron E-84*2) | 1 part |
| Ingredients of Yellow Toner A7 | |
| Resin H1 of polyester resin (A) | 50 parts |
| Resin L1 of polyester resin (B) | 40 parts |
| Yellow-toner master batch A1 (MB-Y1) | 20 parts |
| Paraffin wax HNP-9PD*1) | 3 parts |
| Charge control agent Bontron E-84*2) | 1 part |

-continued

| Ingredients of Black Toner A7 | |
|---|---|
| Resin H1 of polyester resin (A) | 50 parts |
| Resin L1 of polyester resin (B) | 42 parts |
| Black-toner master batch A1 (MB-K1) | 16 parts |
| Paraffin wax HNP-9PD*1) | 3 parts |
| Charge control agent Bontron E-84*2) | 1 part |

*1)maximum endothermic peak: 75.7° C., by Nippon Seiro Co.
*2)Zn (II) 3,5-di-t-butylsalicylate, by Orient Chemical Co.

Example A-8

Preparation of Toner A8

Toner A8 comprised of cyan toner A8, yellow toner A8, magenta toner A8, and black toner A8 was prepared in the same manner as Example A-1, except that the respective ingredients of Example A-1 were changed into those shown below and the milling was carried out by use of the supersonic jet mill (Labo Jet, by Japan Pneumatic Mfg. Co.) at a rotation number 39 Hz of the feeder and a jet air pressure of 0.35 MPa.

| Ingredients of Cyan Toner A8 | |
|---|---|
| Resin H1 of polyester resin (A) | 50 parts |
| Resin L1 of polyester resin (B) | 42 parts |
| Cyan-toner master batch A1 (MB-C1) | 16 parts |
| De-free fatty acid carnauba wax WA03*1) | 3 parts |
| Charge control agent Bontron E-84*2) | 1 part |
| Ingredients of Magenta Toner A8 | |
| Resin H1 of polyester resin (A) | 50 parts |
| Resin L1 of polyester resin (B) | 40 parts |
| Magenta-toner master batch A1 (MB-M1) | 20 parts |
| De-free fatty acid carnauba wax WA03*1) | 3 parts |
| Charge control agent Bontron E-84*2) | 1 part |
| Ingredients of Yellow Toner A8 | |
| Resin H1 of polyester resin (A) | 50 parts |
| Resin L1 of polyester resin (B) | 40 parts |
| Yellow-toner master batch A1 (MB-Y1) | 20 parts |
| De-free fatty acid carnauba wax WA03*1) | 3 parts |
| Charge control agent Bontron E-84*2) | 1 part |
| Ingredients of Black Toner A8 | |
| Resin H1 of polyester resin (A) | 50 parts |
| Resin L1 of polyester resin (B) | 42 parts |
| Black-toner master batch A1 (MB-K1) | 16 parts |
| De-free fatty acid carnauba wax WA03*1) | 3 parts |
| Charge control agent Bontron E-84*2) | 1 part |

*1)maximum endothermic peak: 82.1° C., by Toakasei Co.
*2)Zn (II) 3,5-di-t-butylsalicylate, by Orient Chemical Co.

Comparative Example A-1

Preparation of Toner A9

Toner A9 comprised of cyan toner A9, yellow toner A9, magenta toner A9, and black toner A9 was prepared in the same manner as Example A-1 except for changing the respective ingredients of Example A-1 into those shown below.

| Ingredients of Cyan Toner A9 | |
|---|---|
| Resin H6 of polyester resin (A) | 50 parts |
| Resin L6 of polyester resin (B) | 42 parts |

-continued

| | |
|---|---|
| Cyan-toner master batch A6 (MB-C6) | 16 parts |
| Paraffin wax HNP-9PD*1) | 3 parts |
| Charge control agent Bontron E-84*2) | 1 part |
| Ingredients of Magenta Toner A9 | |
| Resin H6 of polyester resin (A) | 50 parts |
| Resin L6 of polyester resin (B) | 40 parts |
| Magenta-toner master batch A6 (MB-M6) | 20 parts |
| Paraffin wax HNP-9PD*1) | 3 parts |
| Charge control agent Bontron E-84*2) | 1 part |
| Ingredients of Yellow Toner A9 | |
| Resin H6 of polyester resin (A) | 50 parts |
| Resin L6 of polyester resin (B) | 40 parts |
| Yellow-toner master batch A6 (MB-Y6) | 20 parts |
| Paraffin wax HNP-9PD*1) | 3 parts |
| Charge control agent Bontron E-84*2) | 1 part |
| Ingredients of Black Toner A9 | |
| Resin H6 of polyester resin (A) | 50 parts |
| Resin L6 of polyester resin (B) | 42 parts |
| Black-toner master batch A6 (MB-K6) | 16 parts |
| Paraffin wax HNP-9PD*1) | 3 Parts |
| Charge control agent Bontron E-84*2) | 1 part |

*1)maximum endothermic peak: 75.7° C., by Nippon Seiro Co.
*2)Zn (II) 3,5-di-t-butylsalicylate, by Orient Chemical Co.

Comparative Example A-2

Preparation of Toner A10

Toner A10 comprised of cyan toner A10, yellow toner A10, magenta toner A10, and black toner A10 was prepared in the same manner as Example A-1 except for changing the respective ingredients of Example A-1 into those shown below.

| Ingredients of Cyan Toner A10 | |
|---|---|
| Resin H5 of polyester resin (A) | 50 parts |
| Resin L1 of polyester resin (B) | 42 parts |
| Cyan-toner master batch A1 (MB-C1) | 16 parts |
| Paraffin wax HNP-9PD*1) | 3 parts |
| Charge control agent Bontron E-84*2) | 1 part |
| Ingredients of Magenta Toner A10 | |
| Resin H5 of polyester resin (A) | 50 parts |
| Resin L1 of polyester resin (B) | 40 parts |
| Magenta-toner master batch A1 (MB-M1) | 20 parts |
| Paraffin wax HNP-9PD*1) | 3 parts |
| Charge control agent Bontron E-84*2) | 1 part |
| Ingredients of Yellow Toner A10 | |
| Resin H5 of polyester resin (A) | 50 parts |
| Resin L1 of polyester resin (B) | 40 parts |
| Yellow-toner master batch A1 (MB-Y1) | 20 parts |
| Paraffin wax HNP-9PD*1) | 3 parts |
| Charge control agent Bontron E-84*2) | 1 part |
| Ingredients of Black Toner A10 | |
| Resin H5 of polyester resin (A) | 50 parts |
| Resin L1 of polyester resin (B) | 42 parts |
| Black-toner master batch A1 (MB-K1) | 16 parts |
| Paraffin wax HNP-9PD*1) | 3 parts |
| Charge control agent Bontron E-84*2) | 1 part |

*1)maximum endothermic peak: 75.7° C., by Nippon Seiro Co.
*2)Zn (II) 3,5-di-t-butylsalicylate, by Orient Chemical Co.

Comparative Example A-3

Preparation of Toner A11

Toner A11 comprised of cyan toner A11, yellow toner A11, magenta toner A11, and black toner A11 was prepared in the same manner as Example A-1 except for changing the respective ingredients of Example A-1 into those shown below.

| Ingredients of Cyan Toner A11 | |
|---|---|
| Resin H7 of polyester resin (A) | 50 parts |
| Resin L7 of polyester resin (B) | 42 parts |
| Cyan-toner master batch A7 (MB-C7) | 16 parts |
| Paraffin wax HNP-9PD*1) | 3 parts |
| Charge control agent Bontron E-84*2) | 1 part |
| Ingredients of Magenta Toner A11 | |
| Resin H7 of polyester resin (A) | 50 parts |
| Resin L7 of polyester resin (B) | 40 parts |
| Magenta-toner master batch A7 (MB-M7) | 20 parts |
| Paraffin wax HNP-9PD*1) | 3 parts |
| Charge control agent Bontron E-84*2) | 1 part |
| Ingredients of Yellow Toner A11 | |
| Resin H7 of polyester resin (A) | 50 parts |
| Resin L7 of polyester resin (B) | 40 parts |
| Yellow-toner master batch A7 (MB-Y7) | 20 parts |
| Paraffin wax HNP-9PD*1) | 3 parts |
| Charge control agent Bontron E-84*2) | 1 part |
| Ingredients of Black Toner A11 | |
| Resin H7 of polyester resin (A) | 50 parts |
| Resin L7 of polyester resin (B) | 42 parts |
| Black-toner master batch A7 (MB-K7) | 16 parts |
| Paraffin wax HNP-9PD*1) | 3 parts |
| Charge control agent Bontron E-84*2) | 1 part |

*1)maximum endothermic peak: 75.7° C., by Nippon Seiro Co.
*2)Zn (II) 3,5-di-t-butylsalicylate, by Orient Chemical Co.

Comparative Example A-4

Preparation of Toner A12

Toner A12 comprised of cyan toner A12, yellow toner A12, magenta toner A12, and black toner A12 was prepared in the same manner as Example A-1, except that the respective ingredients of Example A-1 were changed into those shown below, and the particles were classified such that the content of particles, having a particle diameter of no more than 5 μm, was controlled into 50%±5% by particle number using an air classifier (MDS-I, by Japan Pneumatic Mfg. Co.) after the material was finely milled by a supersonic jet mill (Labo Jet, by Japan Pneumatic Mfg. Co.) at a rotation number 36 Hz of the feeder and a jet air pressure of 0.40 MPa.

| Ingredients of Cyan Toner A12 | |
|---|---|
| Resin H1 of polyester resin (A) | 50 parts |
| Resin L1 of polyester resin (B) | 42 parts |
| Cyan-toner master batch A1 (MB-C1) | 16 parts |
| Paraffin wax HNP-9PD*1) | 3 parts |
| Charge control agent Bontron E-84*2) | 1 part |
| Ingredients of Magenta Toner A12 | |
| Resin H1 of polyester resin (A) | 50 parts |
| Resin L1 of polyester resin (B) | 40 parts |
| Magenta-toner master batch A1 (MB-M1) | 20 parts |
| Paraffin wax HNP-9PD*1) | 3 parts |

-continued

| | |
|---|---|
| Charge control agent Bontron E-84*2) | 1 part |
| Ingredients of Yellow Toner A12 | |
| Resin H1 of polyester resin (A) | 50 parts |
| Resin L1 of polyester resin (B) | 40 parts |
| Yellow-toner master batch A1 (MB-Y1) | 20 parts |
| Paraffin wax HNP-9PD*1) | 3 parts |
| Charge control agent Bontron E-84*2) | 1 part |
| Ingredients of Black Toner A12 | |
| Resin H1 of polyester resin (A) | 50 parts |
| Resin L1 of polyester resin (B) | 42 parts |
| Black-toner master batch A1 (MB-K1) | 16 parts |
| Paraffin wax HNP-9PD*1) | 3 parts |
| Charge control agent Bontron E-84*2) | 1 part |

*1)maximum endothermic peak: 75.7° C., by Nippon Seiro Co.
*2)Zn (II) 3,5-di-t-butylsalicylate, by Orient Chemical Co.

Comparative Example A-6

Preparation of Toner A13

Toner A13 comprised of cyan toner A13, yellow toner A13, magenta toner A13, and black toner A13 was prepared in the same manner as Example A-1, except that the respective ingredients of Example A-1 were changed into those shown below, and the particles were classified such that the content of particles, having a particle diameter of no more than 5 μm, was controlled into 30%±5% by particle number using an air classifier (MDS-I, by Japan Pneumatic Mfg. Co.) after the material was finely milled by a supersonic jet mill (Labo Jet, by Japan Pneumatic Mfg. Co.) at a rotation number 36 Hz of the feeder and a jet air pressure of 0.40 MPa.

| Ingredients of Cyan Toner A13 | |
|---|---|
| Resin H1 of polyester resin (A) | 50 parts |
| Resin L1 of polyester resin (B) | 42 parts |
| Cyan-toner master batch A1 (MB-C1) | 16 parts |
| Paraffin wax HNP-9PD*1) | 3 parts |
| Charge control agent Bontron E-84*2) | 1 part |
| Ingredients of Magenta Toner A13 | |
| Resin H1 of polyester resin (A) | 50 parts |
| Resin L1 of polyester resin (B) | 40 parts |
| Magenta-toner master batch A1 (MB-M1) | 20 parts |
| Paraffin wax HNP-9PD*1) | 3 parts |
| Charge control agent Bontron E-84*2) | 1 part |
| Ingredients of Yellow Toner A13 | |
| Resin H1 of polyester resin (A) | 50 parts |
| Resin L1 of polyester resin (B) | 40 parts |
| Yellow-toner master batch A1 (MB-Y1) | 20 parts |
| Paraffin wax HNP-9PD*1) | 3 parts |
| Charge control agent Bontron E-84*2) | 1 part |
| Ingredients of Black Toner A13 | |
| Resin H1 of polyester resin (A) | 50 parts |
| Resin L1 of polyester resin (B) | 42 parts |
| Black-toner master batch A1 (MB-K1) | 16 parts |
| Paraffin wax HNP-9PD*1) | 3 parts |
| Charge control agent Bontron E-84*2) | 1 part |

*1)maximum endothermic peak: 75.7° C., by Nippon Seiro Co.
*2)Zn (II) 3,5-di-t-butylsalicylate, by Orient Chemical Co.

Comparative Example A-6

Preparation of Toner A14

Toner A14 comprised of cyan toner A14, yellow toner A14, magenta toner A14, and black toner A14 was prepared in the same manner as Example A-1 except for changing the respective ingredients of Example A-1 into those shown below.

| Ingredients of Cyan Toner A14 | |
|---|---|
| Resin H8 of polyester resin (A) | 50 parts |
| Resin L5 of polyester resin (B) | 42 parts |
| Cyan-toner master batch A5 (MB-C5) | 16 parts |
| Paraffin wax HNP-9PD*1) | 3 parts |
| Charge control agent Bontron E-84*2) | 1 part |
| Ingredients of Magenta Toner A14 | |
| Resin H8 of polyester resin (A) | 50 parts |
| Resin L5 of polyester resin (B) | 40 parts |
| Magenta-toner master batch A5 (MB-M5) | 20 parts |
| Paraffin wax HNP-9PD*1) | 3 parts |
| Charge control agent Bontron E-84*2) | 1 part |
| Ingredients of Yellow Toner A14 | |
| Resin H8 of polyester resin (A) | 50 parts |
| Resin L5 of polyester resin (B) | 40 parts |
| Yellow-toner master batch A5 (MB-Y5) | 20 parts |
| Paraffin wax HNP-9PD*1) | 3 parts |
| Charge control agent Bontron E-84*2) | 1 part |
| Ingredients of Black Toner A14 | |
| Resin H8 of polyester resin (A) | 50 parts |
| Resin L5 of polyester resin (B) | 42 parts |
| Black-toner master batch A5 (MB-K5) | 16 parts |
| Paraffin wax HNP-9PD*1) | 3 parts |
| Charge control agent Bontron E-84*2) | 1 part |

*1)maximum endothermic peak: 75.7° C., by Nippon Seiro Co.
*2)Zn (II) 3,5-di-t-butylsalicylate, by Orient Chemical Co.

Comparative Example A-7

Preparation of Toner A15

Toner A15 comprised of cyan toner A15, yellow toner A15, magenta toner A15, and black toner A15 was prepared in the same manner as Example A-1 except for changing the respective ingredients of Example A-1 into those shown below.

| Ingredients of Cyan Toner A15 | |
|---|---|
| Resin H1 of polyester resin (A) | 50 parts |
| Resin L1 of polyester resin (B) | 42 parts |
| Cyan-toner master batch A1 (MB-C1) | 16 parts |
| Charge control agent Bontron E-84*1) | 1 part |
| Ingredients of Magenta Toner A15 | |
| Resin H1 of polyester resin (A) | 50 parts |
| Resin L1 of polyester resin (B) | 40 parts |
| Magenta-toner master batch A1 (MB-M1) | 20 parts |
| Charge control agent Bontron E-84*1) | 1 part |
| Ingredients of Yellow Toner A15 | |
| Resin H1 of polyester resin (A) | 50 parts |
| Resin L1 of polyester resin (B) | 40 parts |
| Yellow-toner master batch A1 (MB-Y1) | 20 parts |
| Charge control agent Bontron E-84*1) | 1 part |
| Ingredients of Black Toner A15 | |
| Resin H1 of polyester resin (A) | 50 parts |
| Resin L1 of polyester resin (B) | 42 parts |
| Black-toner master batch A1 (MB-K1) | 16 parts |
| Charge control agent Bontron E-84*1) | 1 part |

*1)Zn (II) 3,5-di-t-butylsalicylate, by Orient Chemical Co.

Comparative Example A-8

Preparation of Toner A16

Toner A16 comprised of cyan toner A16, yellow toner A16, magenta toner A16, and black toner A16 was prepared in the same manner as Example A-1, except that each material was finely milled by a supersonic jet mill (Labo Jet, by Japan Pneumatic Mfg. Co.) at a rotation number 20 Hz of the feeder and a jet air pressure of 0.50 MPa.

The ingredients of the toners A1 to A16 of Examples A-1 to A-8 and Comparative Examples A-1 to A-8 are summarized in Tables 5 and 6. Each of the differences ΔTm between softening temperatures Tm(A) and Tm(B) of polyester resins (A) and (B) was also determined and shown in Tables 5 and 6.

TABLE 5

| | | | ingredients | | | | | |
|---|---|---|---|---|---|---|---|---|
| | | toner | polyester (A) | polyester (B) | master batch | wax | charge control agent | ΔTm (° C.) |
| Ex. A-1 | toner A1 | cyan | resin H1 (50) | resin L1 (42) | MB-C1 (16) | HNP-9PD (3) | E-84 (1) | 37.5 |
| | | magenta | resin H1 (50) | resin L1 (40) | MB-M1 (20) | HNP-9PD (3) | E-84 (1) | |
| | | yellow | resin H1 (50) | resin L1 (40) | MB-Y1 (20) | HNP-9PD (3) | E-84 (1) | |
| | | black | resin H1 (50) | resin L1 (42) | MB-K1 (16) | HNP-9PD (3) | E-84 (1) | |
| Ex. A-2 | toner A2 | cyan | resin H2 (50) | resin L5 (42) | MB-C5 (16) | HNP-9PD (3) | E-84 (1) | 59.1 |
| | | magenta | resin H2 (50) | resin L5 (40) | MB-M5 (20) | HNP-9PD (3) | E-84 (1) | |
| | | yellow | resin H2 (50) | resin L5 (40) | MB-Y5 (20) | HNP-9PD (3) | E-84 (1) | |
| | | black | resin H2 (50) | resin L5 (42) | MB-K5 (16) | HNP-9PD (3) | E-84 (1) | |
| Ex. A-3 | toner A3 | cyan | resin H6 (50) | resin L2 (42) | MB-C2 (16) | HNP-9PD (3) | E-84 (1) | 16.2 |
| | | magenta | resin H6 (50) | resin L2 (40) | MB-M2 (20) | HNP-9PD (3) | E-84 (1) | |
| | | yellow | resin H6 (50) | resin L2 (40) | MB-Y2 (20) | HNP-9PD (3) | E-84 (1) | |
| | | black | resin H6 (50) | resin L2 (42) | MB-K2 (16) | HNP-9PD (3) | E-84 (1) | |

TABLE 5-continued

| | | | ingredients | | | | | |
|---|---|---|---|---|---|---|---|---|
| | | toner | polyester (A) | polyester (B) | master batch | wax | charge control agent | ΔTm (° C.) |
| Ex. A-4 | toner | cyan | resin H2 (50) | resin L2 (42) | MB-C2 (16) | HNP-9PD (3) | E-84 (1) | 40.0 |
| | A4 | magenta | resin H2 (50) | resin L2 (40) | MB-M2 (20) | HNP-9PD (3) | E-84 (1) | |
| | | yellow | resin H2 (50) | resin L2 (40) | MB-Y2 (20) | HNP-9PD (3) | E-84 (1) | |
| | | black | resin H2 (50) | resin L2 (42) | MB-K2 (16) | HNP-9PD (3) | E-84 (1) | |
| Ex. A-5 | toner | cyan | resin H3 (50) | resin L3 (42) | MB-C3 (16) | HNP-9PD (3) | E-84 (1) | 42.6 |
| | A5 | magenta | resin H3 (50) | resin L3 (40) | MB-M3 (20) | HNP-9PD (3) | E-84 (1) | |
| | | yellow | resin H3 (50) | resin L3 (40) | MB-Y3 (20) | HNP-9PD (3) | E-84 (1) | |
| | | black | resin H3 (50) | resin L3 (42) | MB-K3 (16) | HNP-9PD (3) | E-84 (1) | |
| Ex. A-6 | toner | cyan | resin H4 (50) | resin L4 (42) | MB-C4 (16) | HNP-9PD (3) | E-84 (1) | 45.8 |
| | A6 | magenta | resin H4 (50) | resin L4 (40) | MB-M4 (20) | HNP-9PD (3) | E-84 (1) | |
| | | yellow | resin H4 (50) | resin L4 (40) | MB-Y4 (20) | HNP-9PD (3) | E-84 (1) | |
| | | black | resin H4 (50) | resin L4 (42) | MB-K4 (16) | HNP-9PD (3) | E-84 (1) | |
| Ex. A-7 | toner | cyan | resin H1 (50) | resin L1 (42) | MB-C1 (16) | HNP-9PD (3) | E-84 (1) | 37.5 |
| | A7 | magenta | resin H1 (50) | resin L1 (40) | MB-M1 (20) | HNP-9PD (3) | E-84 (1) | |
| | | yellow | resin H1 (50) | resin L1 (40) | MB-Y1 (20) | HNP-9PD (3) | E-84 (1) | |
| | | black | resin H1 (50) | resin L1 (42) | MB-K1 (16) | HNP-9PD (3) | E-84 (1) | |
| Ex. A-8 | toner | cyan | resin H1 (50) | resin L1 (42) | MB-C1 (16) | WA-03 (3) | E-84 (1) | 37.5 |
| | A8 | magenta | resin H1 (50) | resin L1 (40) | MB-M1 (20) | WA-03 (3) | E-84 (1) | |
| | | yellow | resin H1 (50) | resin L1 (40) | MB-Y1 (20) | WA-03 (3) | E-84 (1) | |
| | | black | resin H1 (50) | resin L1 (42) | MB-K1 (16) | WA-03 (3) | E-84 (1) | |

number in ( ): parts by mass

TABLE 6

| | | | ingredients | | | | | |
|---|---|---|---|---|---|---|---|---|
| | | | polyester (A) | polyester (B) | master batch | wax | charge control agent | ΔTm (° C.) |
| Com. Ex. A-1 | toner A9 | cyan | resin H6 (50) | resin L6 (42) | MB-C6 (16) | HNP-9PD (3) | E-84 (1) | 41.0 |
| | | magenta | resin H6 (50) | resin L6 (40) | MB-M6 (20) | HNP-9PD (3) | E-84 (1) | |
| | | yellow | resin H6 (50) | resin L6 (40) | MB-Y6 (20) | HNP-9PD (3) | E-84 (1) | |
| | | black | resin H6 (50) | resin L6 (42) | MB-K6 (16) | HNP-9PD (3) | E-84 (1) | |
| Com. Ex. A-2 | toner A10 | cyan | resin H5 (50) | resin L1 (42) | MB-C1 (16) | HNP-9PD (3) | E-84 (1) | 33.7 |
| | | magenta | resin H5 (50) | resin L1 (40) | MB-M1 (20) | HNP-9PD (3) | E-84 (1) | |
| | | yellow | resin H5 (50) | resin L1 (40) | MB-Y1 (20) | HNP-9PD (3) | E-84 (1) | |
| | | black | resin H5 (50) | resin L1 (42) | MB-K1 (16) | HNP-9PD (3) | E-84 (1) | |
| Com. Ex. A-3 | toner A11 | cyan | resin H7 (50) | resin L7 (42) | MB-C7 (16) | HNP-9PD (3) | E-84 (1) | 36.2 |
| | | magenta | resin H7 (50) | resin L7 (40) | MB-M7 (20) | HNP-9PD (3) | E-84 (1) | |
| | | yellow | resin H7 (50) | resin L7 (40) | MB-Y7 (20) | HNP-9PD (3) | E-84 (1) | |
| | | black | resin H7 (50) | resin L7 (42) | MB-K7 (16) | HNP-9PD (3) | E-84 (1) | |
| Com. Ex. A-4 | toner A12 | cyan | resin H1 (50) | resin L1 (42) | MB-C1 (16) | HNP-9PD (3) | E-84 (1) | 37.5 |
| | | magenta | resin H1 (50) | resin L1 (40) | MB-M1 (20) | HNP-9PD (3) | E-84 (1) | |
| | | yellow | resin H1 (50) | resin L1 (40) | MB-Y1 (20) | HNP-9PD (3) | E-84 (1) | |
| | | black | resin H1 (50) | resin L1 (42) | MB-K1 (16) | HNP-9PD (3) | E-84 (1) | |
| Com. Ex. A-5 | toner A13 | cyan | resin H1 (50) | resin L1 (42) | MB-C1 (16) | HNP-9PD (3) | E-84 (1) | 37.5 |
| | | magenta | resin H1 (50) | resin L1 (40) | MB-M1 (20) | HNP-9PD (3) | E-84 (1) | |
| | | yellow | resin H1 (50) | resin L1 (40) | MB-Y1 (20) | HNP-9PD (3) | E-84 (1) | |
| | | black | resin H1 (50) | resin L1 (42) | MB-K1 (16) | HNP-9PD (3) | E-84 (1) | |
| Com. Ex. A-6 | toner A14 | cyan | resin H8 (50) | resin L5 (42) | MB-C5 (16) | HNP-9PD (3) | E-84 (1) | 38.8 |
| | | magenta | resin H8 (50) | resin L5 (40) | MB-M5 (20) | HNP-9PD (3) | E-84 (1) | |
| | | yellow | resin H8 (50) | resin L5 (40) | MB-Y5 (20) | HNP-9PD (3) | E-84 (1) | |
| | | black | resin H8 (50) | resin L5 (42) | MB-K5 (16) | HNP-9PD (3) | E-84 (1) | |
| Com. Ex. A-7 | toner A15 | cyan | resin H1 (50) | resin L1 (42) | MB-C1 (16) | non | E-84 (1) | 37.5 |
| | | magenta | resin H1 (50) | resin L1 (40) | MB-M1 (20) | non | E-84 (1) | |
| | | yellow | resin H1 (50) | resin L1 (40) | MB-Y1 (20) | non | E-84 (1) | |
| | | black | resin H1 (50) | resin L1 (42) | MB-K1 (16) | non | E-84 (1) | |
| Com. Ex. A-8 | toner A16 | cyan | resin H1 (50) | resin L1 (42) | MB-C1 (16) | HNP-9PD (3) | E-84 (1) | 37.5 |
| | | magenta | resin H1 (50) | resin L1 (40) | MB-M1 (20) | HNP-9PD (3) | E-84 (1) | |
| | | yellow | resin H1 (50) | resin L1 (40) | MB-Y1 (20) | HNP-9PD (3) | E-84 (1) | |
| | | black | resin H1 (50) | resin L1 (42) | MB-K1 (16) | HNP-9PD (3) | E-84 (1) | |

number in ( ): parts by mass

The toners of A1 to A16 of Examples A-1 to A-8 and Comparative Examples A-1 to A-8 were measured in terms of their mass average particle diameter ($D_4$), particle size distribution, and content of particles having a particle diameter of no more than 5 μm as follows. The results are shown in Tables 7 and 8.

Mass Average Particle Diameter ($D_4$), Particle Size Distribution, and Content of Particles Having Particle Diameter of No More than 5 μm The mass average particle diameter ($D_4$) was measured by use of a particle size analyzer (Multisizer III, by Beckman Coulter Co.) at aperture diameter 100 μm, and analyzed using an analysis software of Beckman Coulter Multisizer 3 Version 3.51. Specifically, to a 100 ml glass beaker, 0.5 ml of a 10% by mass surfactant (alkylbenzene sulfonate Neogen SC-A, by Daiichi Kogyo Seiyaku Co.) was added, then 0.5 g of each toner was added thereto and stirred with Microspartel, and 80 ml of deionized water was poured into the beaker. The resulting dispersion was dispersed in an ultrasonic dispersing apparatus (W-113MK-II, by Honda Electronics Co.) for 10 minutes. The dispersion was measured using the Multisizer III and Isoton III (by Beckman Coulter Co.) as a solution for measurement. The toner sample dispersion was titrated and measured in a condition that the concentration indicated by the apparatus i.e. Multisizer III was 8%±2% by mass. It is important for the measurement that the concentration of the toner sample is 8%±2% by mass from the viewpoint of measurement repeatability; the concentration range may result in less error in the measurement.

In order to measure particles having a particle diameter (Pd) of no less than 2.00 μm to less than 40.30 μm, thirteen channels were used such as 2.00 μm≦Pd<2.52 μm, 2.52 μm≦Pd<3.17 μm, 3.17 μm≦Pd<4.00 μm, 4.00 μm≦Pd<5.04 μm, 5.04 μm≦Pd<6.35 μm, 6.35 μm≦Pd<8.00 μm, 8.00 μm≦Pd<10.08 μm, 10.08 μm≦Pd<12.70 μm, 12.70 μm≦Pd<16.00 μm, 16.00 μm≦Pd<20.20 μm, 20.20 μm≦Pd<25.40 μm, 25.40 μm≦Pd<32.00 μm, and 32.00 μm≦Pd<40.30 μm.

Mass of each toner and number of toner particles were measured, then the mass distribution and the number distribution were calculated. From the distributions, the mass average particle diameter ($D_4$), the number average particle diameter (Dn), and the content of particles having a particle diameter of no more than 5 μm were determined, and size distribution ($D_4$/Dn) was calculated.

TABLE 7

| | toner | | D4 (μm) | D4/Dn | content of particles with diameter of no more than 5 μm (% by number) |
|---|---|---|---|---|---|
| Ex. A-1 | toner A1 | cyan | 6.8 | 1.79 | 65.7 |
| | | magenta | 6.8 | 1.79 | 65.0 |
| | | yellow | 6.7 | 1.79 | 65.4 |
| | | black | 6.8 | 1.78 | 64.8 |
| Ex. A-2 | toner A2 | cyan | 6.7 | 1.72 | 62.0 |
| | | magenta | 6.7 | 1.71 | 60.9 |
| | | yellow | 6.8 | 1.71 | 62.0 |
| | | black | 6.8 | 1.71 | 62.3 |
| Ex. A-3 | toner A3 | cyan | 6.8 | 1.89 | 69.7 |
| | | magenta | 6.8 | 1.89 | 69.5 |
| | | yellow | 6.8 | 1.87 | 68.1 |
| | | black | 6.8 | 1.88 | 67.2 |
| Ex. A-4 | toner A4 | cyan | 6.8 | 1.83 | 68.4 |
| | | magenta | 6.7 | 1.83 | 68.3 |
| | | yellow | 6.8 | 1.83 | 68.8 |
| | | black | 6.7 | 1.83 | 68.4 |

TABLE 7-continued

| | toner | | D4 (μm) | D4/Dn | content of particles with diameter of no more than 5 μm (% by number) |
|---|---|---|---|---|---|
| Ex. A-5 | toner A5 | cyan | 6.6 | 1.73 | 65.6 |
| | | magenta | 6.8 | 1.75 | 65.6 |
| | | yellow | 6.8 | 1.74 | 64.9 |
| | | black | 6.8 | 1.74 | 65.0 |
| Ex. A-6 | toner A6 | cyan | 6.6 | 1.65 | 60.8 |
| | | magenta | 6.7 | 1.64 | 60.0 |
| | | yellow | 6.7 | 1.65 | 61.1 |
| | | black | 6.6 | 1.65 | 60.7 |
| Ex. A-7 | toner A7 | cyan | 4.9 | 1.37 | 84.8 |
| | | magenta | 5.0 | 1.35 | 83.9 |
| | | yellow | 4.9 | 1.36 | 84.9 |
| | | black | 4.9 | 1.37 | 83.5 |
| Ex. A-8 | toner A8 | cyan | 7.8 | 1.95 | 69.2 |
| | | magenta | 7.8 | 1.98 | 71.2 |
| | | yellow | 7.7 | 1.96 | 69.6 |
| | | black | 7.7 | 1.95 | 68.0 |

TABLE 8

| | toner | | D4 (μm) | D4/Dn | content of particles with diameter of no more than 5 μm (% by number) |
|---|---|---|---|---|---|
| Com. Ex. A-1 | toner A9 | cyan | 6.8 | 1.78 | 64.2 |
| | | magenta | 6.8 | 1.78 | 64.5 |
| | | yellow | 6.8 | 1.78 | 65.0 |
| | | black | 6.6 | 1.76 | 64.2 |
| Com. Ex. A-2 | toner A10 | cyan | 6.8 | 1.78 | 64.2 |
| | | magenta | 6.8 | 1.78 | 65.2 |
| | | yellow | 6.8 | 1.78 | 65.1 |
| | | black | 6.8 | 1.78 | 64.7 |
| Com. Ex. A-3 | toner A11 | cyan | 6.7 | 1.81 | 66.3 |
| | | magenta | 6.7 | 1.80 | 66.0 |
| | | yellow | 6.8 | 1.81 | 66.8 |
| | | black | 6.8 | 1.81 | 65.7 |
| Com. Ex. A-4 | toner A12 | cyan | 7.4 | 1.78 | 50.6 |
| | | magenta | 7.4 | 1.77 | 51.2 |
| | | yellow | 7.3 | 1.78 | 50.2 |
| | | black | 7.3 | 1.78 | 50.9 |
| Com. Ex. A-5 | toner A13 | cyan | 7.7 | 1.60 | 30.9 |
| | | magenta | 7.7 | 1.62 | 32.5 |
| | | yellow | 7.7 | 1.61 | 30.8 |
| | | black | 7.8 | 1.60 | 30.4 |
| Com. Ex. A-6 | toner A14 | cyan | 6.8 | 1.76 | 62.5 |
| | | magenta | 6.7 | 1.76 | 63.0 |
| | | yellow | 6.7 | 1.77 | 62.4 |
| | | black | 6.8 | 1.76 | 60.8 |
| Com. Ex. A-7 | toner A15 | cyan | 6.8 | 1.80 | 64.9 |
| | | magenta | 6.8 | 1.80 | 65.3 |
| | | yellow | 6.8 | 1.79 | 66.6 |
| | | black | 6.8 | 1.79 | 64.7 |
| Com. Ex. A-8 | toner A16 | cyan | 4.2 | 1.18 | 91.2 |
| | | magenta | 4.2 | 1.17 | 90.5 |
| | | yellow | 4.2 | 1.17 | 92.0 |
| | | black | 4.2 | 1.17 | 91.6 |

Preparation of Carrier A

Carrier A used for two-component developers was prepared as follows.

A coating material of the ingredients shown below was dispersed for 10 minutes using a stirrer to prepare a coating liquid. The coating liquid was poured into a coating device where 5,000 parts of a core material (Mn ferrite particles, mass average particle diameter: 35 μm) was coated with the coating liquid while forming a swirl flow by action of a rotatable bottom disc and stirring blades within a fluidized bed. The resulting coated material was heated at 250° C. for 2 hours in an electric furnace to prepare Carrier A.

| Ingredients of Coating Material | |
|---|---|
| Toluene | 450 parts |
| Silicone resin SR2400*1) | 450 parts |
| Amino silane SH6020*2) | 10 parts |
| Carbon black | 10 parts |

*1)non-volatile content: 50%, by Toray Dow Corning Silicone Co.
*2)by Toray Dow Corning Silicone Co.

Evaluation of Toner Properties

The toners of A1 to A16 of Examples A-1 to A-8 and Comparative Examples A-1 to A-8 were evaluated in terms of their milling ability and high-temperature storage stability as follows. The results are shown in Table 9.

Measurement of Milling Ability

The melted-kneaded materials of the ingredients shown Tables 5 and 6 were coarsely milled into a particle diameter of 200 to 400 μm using a hammer mill, then weighed precisely in an amount of 10.00 g, followed by milling for 30 seconds by use of a mill mixer (MM-I, by Hitachi Living Systems, Ltd.). The milled materials were passed through a 30 mesh screen (opening: 500 μm) and the residual amount (Ag) on the screen of each milled material was weighed precisely to determined the residual rate from the Equation (i); this procedure was repeated three times and the average of the residual rates (Rr) was considered as an index of milling ability; and the milling ability was evaluated in accordance with the following criteria. The smaller is the residual rate, the more excellent is the milling ability.

$$Rr=[(A)/\text{amount of resin prior to milling (10.00 g)}]\times 100 \qquad \text{Equation (i):}$$

Evaluation Criteria

A: Rr (residual rate)<5%

B: 5%≦Rr<10%

C: 10%≦Rr<15%

D: 15%≦Rr<20%

E: 20%≦Rr

High-Temperature Storage Stability

The high-temperature storage stability was determined using a penetrometer (Nikka Engineering Co.). Specifically, 10 g of each toner was placed into a 30 ml glass container (screw vial) under a temperature of 20° C. to 25° C. and 40% to 60% RH, and the cap was closed. The toner-containing glass container was tapped 100 times, flowed by allowing to stand for 24 hours at 50° C. within a temperature-controlled chamber; then the penetration degree was measured by the penetrometer, and the high-temperature storage stability was evaluated in accordance with the evaluation criteria. The larger is the penetration degree (Pd), the more excellent is the high-temperature storage stability.

Evaluation Criteria

A: 30 mm≦Pd (penetration degree)

B: 20 mm≦Pd<30 mm

C: 15 mm≦Pd<20 mm

D: 8 mm≦Pd<15 mm

E: Pd<8 mm

TABLE 9

| | toner | milling ability | high-temperature storage stability |
|---|---|---|---|
| Ex. A-1 | toner A1 | A | A |
| Ex. A-2 | toner A2 | B | C |
| Ex. A-3 | toner A3 | B | C |
| Ex. A-4 | toner A4 | A | A |
| Ex. A-5 | toner A5 | A | B |
| Ex. A-6 | toner A6 | A | B |
| Ex. A-7 | toner A7 | A | A |
| Ex. A-8 | toner A8 | A | A |
| Com. Ex. A-1 | toner A9 | D | E |
| Com. Ex. A-2 | toner A10 | B | E |
| Com. Ex. A-3 | toner A11 | C | B |
| Com. Ex. A-4 | toner A12 | A | A |
| Com. Ex. A-5 | toner A13 | A | A |
| Com. Ex. A-6 | toner A14 | C | E |
| Com. Ex. A-7 | toner A15 | D | D |
| Com. Ex. A-8 | toner A16 | A | B |

Examples A-9 to A-16 and Comparative Examples A-9 to A-16

Image Formation and Evaluation

Two-component developers were prepared from the resulting toners in accordance with the procedures described below, and the two-component developers were installed into an image forming apparatus (test apparatus A) shown in FIG. 21 and images were formed to evaluate various properties. The results are shown in Tables 10 and 11.

Preparation of Two-Component Developer

The carrier for two-component developers was Carrier A (ferrite carrier having an average particle diameter of 35 μm and a silicone resin coating of 0.5 μm thick on an average). 7 parts of each toner was mixed uniformly with 100 parts of Carrier A for 3 minutes at 48 rpm by use of a turbula mixer (by Willy A. Bachofen AG), which mixing by action of tumbling its vessel, thereby to charge electrically. In Examples A-9 to A-16 and Comparative Examples A-9 to A-17, 200 g of Carrier A and 14 g of each toner were mixed within a 500 ml vial.

Test Apparatus A

Figure 21:
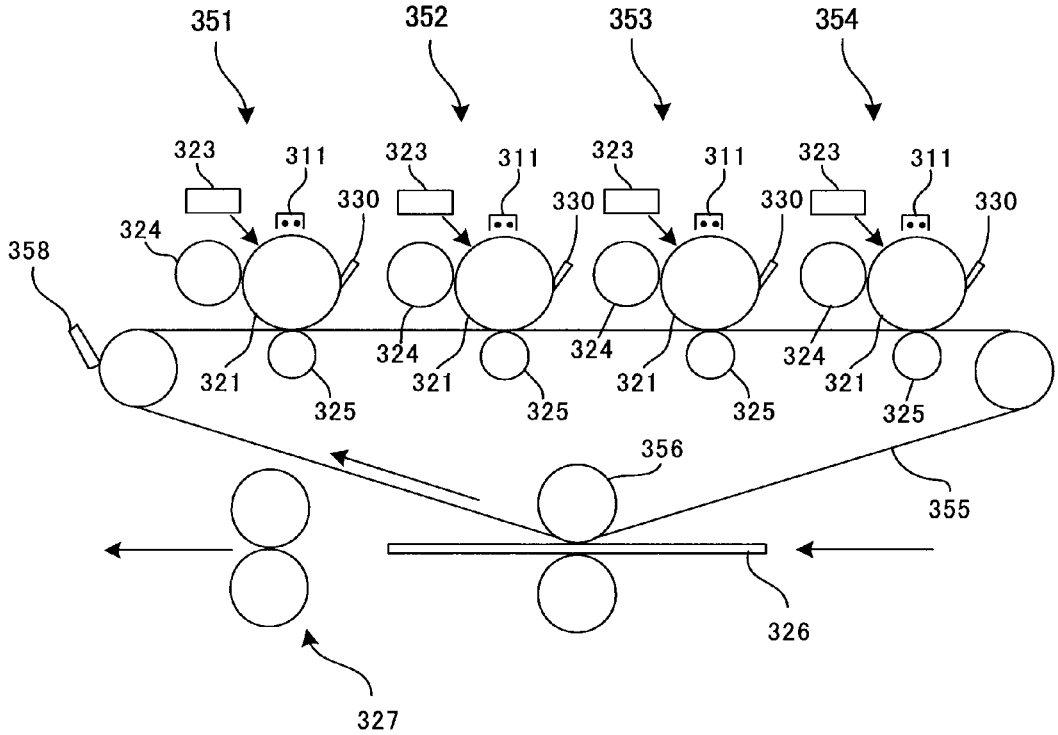
FIG. 21 is a schematic view that shows an image forming apparatus (test apparatus A) utilized in Examples.

The image forming apparatus shown in FIG. 21 is a tandem image forming apparatus of indirect transfer type that employs non-contact charging, two-component developing, secondary transfer, blade cleaning, and external-heating roller fixing.

The image forming apparatus (test apparatus A) shown in FIG. 21 is equipped with corona chargers of non-contact type as charging units 311 as shown in FIG. 3. Developing units 324 are a two-component developing unit as shown in FIG. 6. The cleaning units 330 have a cleaning blade as shown in FIG. 10. The fixing unit 327 is a roller-type fixing device of electromagnetic induction heating as shown in FIG. 12.

The image forming element 351 of image forming apparatus (test apparatus A) shown in FIG. 21 is equipped with charging unit 311, exposing unit 323, developing unit 324, primary transfer unit 325, and cleaning unit 330 around photoconductor drum 321. The photoconductor drum 321 of the image forming element 341 bears a latent electrostatic image while rotating by action of charging unit 310 and exposing unit 323. The latent electrostatic image is developed using a yellow toner by the developing unit 324, and a visible image of the yellow toner is formed on the photoconductor drum 321. The visible image is transferred onto an intermediate transfer belt 355 by the primary transfer unit 325, then the residual yellow toner on the photoconductor drum 321 is removed by the cleaning unit 330. Similarly, visible images of magenta, cyan, and black toners are formed onto the recording medium by the image forming elements 352, 353, and 354, then a color image formed on the intermediate transfer belt 355 is fixed onto a recording medium 326 by a transfer device 356, then the residual toner on the intermediate transfer belt 355 is removed by an intermediate transfer belt cleaning unit 358. The color image formed on the recording medium 326 is fixed by the fixing unit 327.

Low-Temperature Fixability

Using the test apparatus A, a solid image was formed in a toner deposition amount of 0.85±0.1 mg/cm$^2$ on a thick transfer paper (copy paper <135>, by NBS Ricoh Co.), and the image was fixed while changing the temperature of the fixing belt. The surface of the fixed image was drawn at a load of 50 g by a ruby needle (tip radius: 260 to 320 μm, tip angle: 60°) using a drawing tester AD-401 (by Ueshima Seisakusyo Co.); then the drawn surface was intensely rubbed 5 times using a cloth (Hanicot #440, by Hanilon Co.). The lower-limit fixing temperature (LFT) was defined as the fixing-belt temperature at which substantially no image being removed, and the low-temperature fixability was evaluated in accordance with the following criteria. The solid image was formed on the transfer paper at the site of 3.0 cm from the paper end in the paper-feed direction.

Evaluation Criteria

A: LFT (lower-limit fixing temperature)≦125° C.

B: 125° C.<LFT≦135° C.

C: 135° C.<LFT≦145° C.

D: 145° C.<LFT≦155° C.

E: 155° C.<LFT

Hot Offset Resistance

Using the test apparatus A, a solid image was formed in a toner deposition amount of 0.85±0.1 mg/cm$^2$ on a regular transfer paper (type 6200, by Ricoh Co.), and the image was fixed while changing the temperature of the fixing belt. The existence of hot offset was visually evaluated. The upper-limit temperature, at which substantially no offset occurred, was defined as the upper-limit fixing temperature (UFT), and the offset was evaluated in accordance with the following criteria. The solid image was formed on the transfer paper at the site of 3.0 cm from the paper end in the paper-feed direction.

Evaluation Criteria

A: 230° C.≦UFT (upper-limit fixing temperature)

B: 210° C.≦UFT<230° C.

C: 190° C.≦UFT<210° C.

D: 180° C.≦UFT<190° C.

E: UFT<180° C.

Initial Image

An image evaluation chart was output in a full-color mode by the test apparatus A, and initial image quality was evaluated in terms of color tone (color shade) change, background smear, image density, and existence of thin spots. Existence of problems and rank of image quality were evaluated from visual inspection and ranked into 5 steps in accordance with the following criteria.

Evaluation Criteria

A: no image problems, excellent

B: color tone, image density, and/or background smear being slightly observable compared to original image, but no problem and good in actual use C: some difference in color tone (color shade), image density, and background smear D: apparent color tone change, density change, and/or background smear E: remarkable color tone change, density change, and/or background smear, far from normal image Stability with Time After running printing 50,000 sheets of an image chart with 80% image area in full color mode (20% image area per color) using the test apparatus A, the image quality was evaluated in the same manner as the initial image quality described above in comparison with the initial image according to the following criteria.

Evaluation Criteria

A: no problem, excellent

B: problems being slightly observed in tone, image density, and background smear, when compared with original image, but substantially no problem under usual temperatures and humidities C: some difference in color tone (color shade), image density, and background smear in comparison with original image D: apparent color tone change, density change, and/or background smear in comparison with original image E: remarkable color tone change, density change, and/or background smear, far from normal image in comparison with original image Background Smear After running printing 100 sheets and 10,000 sheets of an image chart with 5% image area in mono-color mode under a condition of 10° C. and 15% RH, using the test apparatus A, a thin line image of 600 dpi was output on type 6000 paper (by Ricoh Co.), then image density (ID) at non-image area was measured by a color meter (X-Rite 938, by X-Rite Co.) and evaluated in accordance with the following criteria.

Evaluation Criteria

A: ID (image density)<0.003

B: 0.003≦ID<0.010

C: 0.010≦ID<0.015

D: 0.015≦ID<0.030

E: 0.030≦ID

Carrier Smear

Carrier smear (also referred to as "carrier spent") is an index of carrier smear as one of toner properties; the higher is the mechanical strength of toner, the less is the carrier smear. The specific evaluation process was such that after running printing 100 sheets and 30,000 sheets of an image chart with 50% image area in mono-color mode, using the test apparatus A, the developer was sampled; a proper amount of the sample developer was placed into a cage of a mesh with an opening of 32 μm and air-blown to separate toner and carrier; 1.0 g of the carrier was inserted into a 50 ml glass bottle, to which 10 ml of chloroform was added, then the mixture was shaken by hand 50 times, followed by allowing to stand 10 minutes; thereafter, the supernatant chloroform solution was added into a glass cell, the transmittance (Tm) of the chloroform solution was measured by a turbidity meter; and the carrier smear was evaluated in accordance with the following criteria.

Evaluation Criteria

A: 95%≦Tm (transmittance)

B: 90%≦Tm<95%

C: 80%≦Tm<90%

D: 70%≦Tm<80%

E: Tm<70%

Smear of Developing Sleeve

After running printing 100 sheets and 50,000 sheets of an image chart with 50% image area in mono-color mode, using the test apparatus A, the smear of the developing sleeve was evaluated to rank in the following 5 steps based on visual inspection whether the toner had deposited firmly on the developing sleeve in the developing unit while considering also occurrence of abnormal output images.

Evaluation Criteria

A: no abnormal image, no firm-toner deposition on sleeve

B: no abnormal image, but slight firm-toner deposition on sleeve

C: some abnormal image, evident firm-toner deposition on sleeve

D: evident abnormal image, sever firm-toner deposition on sleeve, problematic level E: evident abnormal image, sever firm-toner deposition on sleeve, impossible to form normal image Filming on Photoconductor After running printing 100 sheets and 50,000 sheets of an image chart with 50% image area in mono-color mode, using the test apparatus A, filming on the photoconductor was evaluated to rank in the following 5 steps based on visual inspection as to filming condition on the photoconductor while considering also occurrence of abnormal output images.

Evaluation Criteria

A: no abnormal image, no toner filming on photoconductor

B: no abnormal image, but slight toner filming on photoconductor

C: some abnormal image, evident toner filming on photoconductor

D: evident abnormal image, sever toner filming on photoconductor, problematic level E: evident abnormal image, sever toner filming on photoconductor, impossible to form normal image

Example A-17

Toners were evaluated in the same manner as Example A-9, except that the test apparatus A of Example A-9 was changed into an image forming apparatus (test apparatus B) shown in FIG. 20 described below. The results are shown in Tables 10 and 11.

Test Apparatus B

Figure 20:
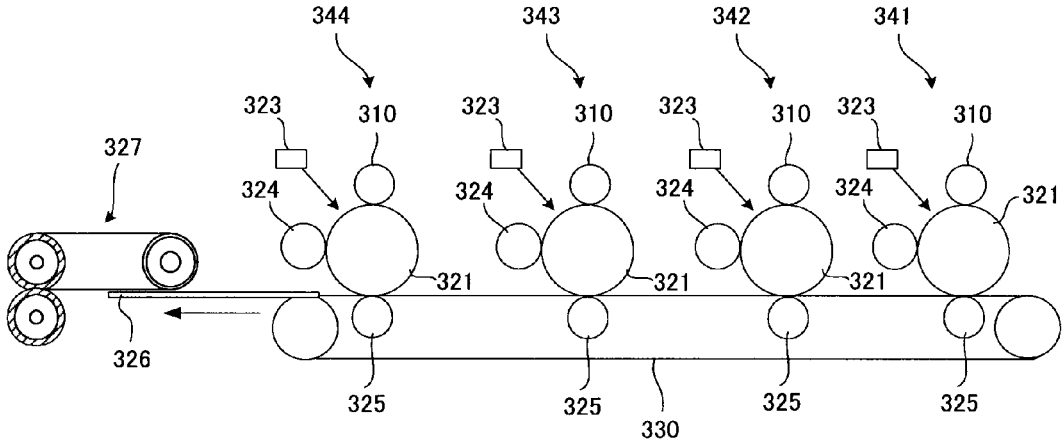
FIG. 20 is a schematic view that shows an image forming apparatus (test apparatus B) utilized in Examples.

The image forming apparatus (test apparatus B) shown in FIG. 20 is a tandem image forming apparatus of direct transfer type that employs contact charging, one-component developing, direct transfer, cleaner-less, and internal-heating belt fixing.

The image forming apparatus (test apparatus B) shown in FIG. 20 is equipped with charging rollers of contact type as charging units 310 as shown in FIG. 1. Developing units 324 are a one-component developing unit as shown in FIG. 5 that is cleaner-less with respect to collecting residual toners. The fixing unit 327 is a belt-type fixing device as shown in FIG. 9 that is equipped with a halogen lamp to heat the heating roller. Conveying belt 330 is also shown in FIG. 20.

The image forming element 341 of image forming apparatus (test apparatus B) shown in FIG. 20 is equipped with charging unit 310, exposing unit 323, developing unit 324, and transfer unit 325 around photoconductor drum 321. The photoconductor drum 321 of the image forming element 341 bears a latent electrostatic image while rotating by action of charging unit 310 and exposing unit 323. The latent electrostatic image is developed using a yellow toner by the developing unit 324, and a visible image of the yellow toner is formed on the photoconductor drum 321. The visible image is transferred onto a recording medium 326 by the transfer unit 325, then the residual toner on the photoconductor drum 321 is collected by the developing unit 324. Similarly, visible images of magenta, cyan, and black toners are overlapped onto the recording medium by the image forming elements 342, 343, and 344, then a color image formed on the recording medium 326 is fixed by the fixing unit 327.

Comparative Example A-17

Image Formation and Evaluation

A two-component developer was prepared from the toner A12 in a similar manner as Example A-17, and toner properties were evaluated in accordance with similar procedures as Example 17 using the image forming apparatus (test apparatus B) shown in FIG. 20. The results are shown in Tables 10 and 11.

TABLE 10

| | | test apparatus | LTF | hot offset resistance | initial image | stability with time |
|---|---|---|---|---|---|---|
| Ex. A-9 | toner A1 | A | A | A | A | A |
| Ex. A-10 | toner A2 | A | A | B | A | B |
| Ex. A-11 | toner A3 | A | B | C | A | B |
| Ex. A-12 | toner A4 | A | B | A | A | A |
| Ex. A-13 | toner A5 | A | B | B | A | A |
| Ex. A-14 | toner A6 | A | B | B | A | B |
| Ex. A-15 | toner A7 | A | A | A | A | A |
| Ex. A-16 | toner A8 | A | A | A | A | A |
| Ex. A-17 | toner A1 | B | A | B | A | A |
| Com. Ex. A-9 | toner A9 | A | E | E | D | E |
| Com. Ex. A-10 | toner A10 | A | D | E | C | D |
| Com. Ex. A-11 | toner A11 | A | D | C | C | D |
| Com. Ex. A-12 | toner A12 | A | A | A | D | E |
| Com. Ex. A-13 | toner A13 | A | A | A | D | E |
| Com. Ex. A-14 | toner A14 | A | B | E | A | D |
| Com. Ex. A-15 | toner A15 | A | B | E | A | E |
| Com. Ex. A-16 | toner A16 | A | A | B | C | E |
| Com. Ex. A-17 | toner A12 | B | A | A | D | E |

LTF: low temperature fixability

TABLE 11

| | smear of carrier | | smear of developing sleeve | | filming on photoconductor | |
|---|---|---|---|---|---|---|
| | after 100 sheets | after 30000 sheets | after 100 sheets | after 50000 sheets | after 100 sheets | after 50000 sheets |
| Ex. A-9 | A | B | A | B | A | A |
| Ex. A-10 | A | B | A | B | A | B |
| Ex. A-11 | A | B | A | B | A | B |
| Ex. A-12 | A | B | A | B | A | A |
| Ex. A-13 | A | B | A | B | A | B |
| Ex. A-14 | A | B | A | B | A | B |
| Ex. A-15 | A | B | A | B | A | A |
| Ex. A-16 | A | A | A | A | A | A |
| Ex. A-17 | A | B | — | — | A | A |
| Com. Ex. A-9 | B | E | A | E | A | E |
| Com. Ex. A-10 | A | E | A | E | A | E |
| Com. Ex. A-11 | A | E | A | E | A | E |
| Com. Ex. A-12 | A | B | A | B | A | C |
| Com. Ex. A-13 | A | B | A | B | A | C |
| Com. Ex. A-14 | B | D | B | D | B | D |
| Com. Ex. A-15 | A | E | A | E | A | E |
| Com. Ex. A-16 | C | E | C | E | C | E |
| Com. Ex. A-17 | A | B | — | — | A | C |

Production Example B-1

Preparation of Toner B-1

The ingredients of toner B1 shown below were pre-mixed by a Henschel mixer (FM10B, by Mitsui Mining Co.), then melt and kneaded at 100° C. to 130° C. by a two-axis kneader (PCM-30, by Ikegai, Ltd.). The resulting mixed-kneaded material was cooled to room temperature, then was coarsely milled into an average particle diameter of 200 to 400 μm by use of a hammer mill. Then the material was finely milled by a supersonic jet mill (Labo Jet, by Japan Pneumatic Mfg. Co.) and classified by an air classifier (MDS-I, by Japan Pneumatic Mfg. Co.) to produce toner base particles.

Then 1.0 part by mass of an additive (HDK-2000, by Clariant Co.) was mixed to 100 parts by mass of the toner base particles by a Henschel mixer, thereby to produce a toner B1.

| Ingredients of Toner B1 | |
|---|---|
| Resin H1 of polyester resin (A) | 50 parts |
| Resin L1 of polyester resin (B) | 42 parts |
| Carbon black | 6 parts |
| Carnauba wax*1) | 5 parts |
| Charge control agent Bontron E-84*2) | 1 part |

*1)maximum endothermic peak: 83° C.,
*2)Zn (II) 3,5-di-t-butylsalicylate, by Orient Chemical Co.

Production Example B-2

Preparation of Toner B2

Toner B2 was prepared in the same manner as Production Example B-1 except for changing into the ingredients of Toner B2 described below.

| Ingredients of Toner B2 | |
|---|---|
| Resin H2 of polyester resin (A) | 50 parts |
| Resin L5 of polyester resin (B) | 42 parts |

-continued

| Ingredients of Toner B2 | |
|---|---|
| Carbon black | 6 parts |
| Carnauba wax*1) | 5 parts |
| Charge control agent Bontron E-84*2) | 1 part |

*1)maximum endothermic peak: 83° C.,
*2)Zn (II) 3,5-di-t-butylsalicylate, by Orient Chemical Co.

Production Example B-3

Preparation of Toner B3

Toner B3 was prepared in the same manner as Production Example B-1 except for changing into the ingredients of Toner B3 described below.

| Ingredients of Toner B3 | |
|---|---|
| Resin H6 of polyester resin (A) | 50 parts |
| Resin L2 of polyester resin (B) | 42 parts |
| Carbon black | 6 parts |
| Carnauba wax*1) | 5 parts |
| Charge control agent Bontron E-84*2) | 1 part |

*1)maximum endothermic peak: 83° C.,
*2)Zn (II) 3,5-di-t-butylsalicylate, by Orient Chemical Co.

Production Example B-4

Preparation of Toner B4

Toner B4 was prepared in the same manner as Production Example B-1 except for changing into the ingredients of Toner B4 described below.

| Ingredients of Toner B4 | |
|---|---|
| Resin H2 of polyester resin (A) | 50 parts |
| Resin L2 of polyester resin (B) | 42 parts |
| Carbon black | 6 parts |
| Carnauba wax*1) | 5 parts |
| Charge control agent Bontron E-84*2) | 1 part |

*1)maximum endothermic peak: 83° C.,
*2)Zn (II) 3,5-di-t-butylsalicylate, by Orient Chemical Co.

Production Example B-5

Preparation of Toner B5

Toner B5 was prepared in the same manner as Production Example B-1 except for changing into the ingredients of Toner B5 described below.

| Ingredients of Toner B5 | |
|---|---|
| Resin H3 of polyester resin (A) | 50 parts |
| Resin L3 of polyester resin (B) | 42 parts |
| Carbon black | 6 parts |
| Carnauba wax*1) | 5 parts |
| Charge control agent Bontron E-84*2) | 1 part |

*1)maximum endothermic peak: 83° C.,
*2)Zn (II) 3,5-di-t-butylsalicylate, by Orient Chemical Co.

Production Example B-6

Preparation of Toner B6

Toner B6 was prepared in the same manner as Production Example B-1 except for changing into the ingredients of Toner B6 described below.

| Ingredients of Toner B6 | |
|---|---|
| Resin H4 of polyester resin (A) | 50 parts |
| Resin L4 of polyester resin (B) | 42 parts |
| Carbon black | 6 parts |
| Carnauba wax*1) | 5 parts |
| Charge control agent Bontron E-84*2) | 1 part |

*1)maximum endothermic peak: 83° C.,
*2)Zn (II) 3,5-di-t-butylsalicylate, by Orient Chemical Co.

Production Example B-7

Preparation of Toner B7

Toner B7 was prepared in the same manner as Production Example B-1 except for changing into the ingredients of Toner B7 described below.

| Ingredients of Toner B7 | |
|---|---|
| Resin H6 of polyester resin (A) | 50 parts |
| Resin L6 of polyester resin (B) | 42 parts |
| Carbon black | 6 parts |

-continued

| Ingredients of Toner B7 | |
|---|---|
| Carnauba wax*1) | 5 parts |
| Charge control agent Bontron E-84*2) | 1 part |

*1)maximum endothermic peak: 83° C.,
*2)Zn (II) 3,5-di-t-butylsalicylate, by Orient Chemical Co.

Production Example B-8

Preparation of Toner B8

Toner B8 was prepared in the same manner as Production Example B-1 except for changing into the ingredients of Toner B8 described below.

| Ingredients of Toner B8 | |
|---|---|
| Resin H5 of polyester resin (A) | 50 parts |
| Resin L1 of polyester resin (B) | 42 parts |
| Carbon black | 6 parts |
| Carnauba wax*1) | 5 parts |
| Charge control agent Bontron E-84*2) | 1 part |

*1)maximum endothermic peak: 83° C.,
*2)Zn (II) 3,5-di-t-butylsalicylate, by Orient Chemical Co.

Production Example B-9

Preparation of Toner B9

Toner B9 was prepared in the same manner as Production Example B-1 except for changing into the ingredients of Toner B9 described below.

| Ingredients of Toner B9 | |
|---|---|
| Resin H7 of polyester resin (A) | 50 parts |
| Resin L7 of polyester resin (B) | 42 parts |
| Carbon black | 6 parts |
| Carnauba wax*1) | 5 parts |
| Charge control agent Bontron E-84*2) | 1 part |

*1)maximum endothermic peak: 83° C.,
*2)Zn (II) 3,5-di-t-butylsalicylate, by Orient Chemical Co.

The ingredients of the toners B1 to B9 are summarized in Table 12. Each of the differences ΔTm between softening temperatures Tm(A) and Tm(B) of polyester resins (A) and (B) was determined. The mass average particle diameter ($D_4$), particle size distribution, and content of particles having a particle diameter of no more than 5 μm were also measured as follows. The results are shown in Table 12.

Mass Average Particle Diameter ($D_4$), Particle Size Distribution, and Content of Particles Having Particle Diameter of No More Than 5 μm The mass average particle diameter ($D_4$) was measured by use of a particle size analyzer (Multisizer III, by Beckman Coulter Co.) at aperture diameter 100 μm, and analyzed using an analysis software of Beckman Coulter Multisizer 3 Version 3.51. Specifically, to a 100 ml glass beaker, 0.5 ml of a 10% by mass surfactant (alkylbenzene sulfonate Neogen SC-A, by Daiichi Kogyo Seiyaku Co.) was added, then 0.5 g of each toner was added thereto and stirred with Microspartel, and 80 ml of deionized water was poured into the beaker. The resulting dispersion was dispersed in an ultrasonic dispersing apparatus (W-113MK-II, by Honda Electronics Co.) for 10 minutes. The dispersion was measured using the Multisizer III and Isoton III (by Beckman Coulter Co.) as a solution for measurement. The toner sample dispersion was titrated and measured in a condition that the concentration indicated by the apparatus i.e. Multisizer III was 8%±2% by mass. It is important for the measurement that the concentration of the toner sample is 8%±2% by mass from the viewpoint of measurement repeatability; the concentration range may result in less error in the measurement.

In order to measure particles having a particle diameter (Pd) of no less than 2.00 μm to less than 40.30 μm, thirteen channels were used such as 2.00 μm≦Pd<2.52 μm, 2.52 μm≦Pd<3.17 μm, 3.17 μm≦Pd<4.00 μm, 4.00 μm≦Pd<5.04 μm, 5.04 μm≦Pd<6.35 μm, 6.35 μm≦Pd<8.00 μm, 8.00 μm≦Pd<10.08 μm, 10.08 μm≦Pd<12.70 μm, 12.70 μm≦Pd<16.00 μm, 16.00 μm≦Pd<20.20 μm, 20.20 μm≦Pd<25.40 μm, 25.40 μm≦Pd<32.00 μm and 32.00 μm≦Pd<40.30 μm.

Mass of each toner and number of toner particles were measured, then the mass distribution and the number distribution were calculated. From the distributions, the mass average particle diameter ($D_4$), the number average particle diameter (Dn), and the content of particles having a particle diameter of no more than 5 μm were determined, and size distribution ($D_4$/Dn) was calculated.

TABLE 12

| | | ingredients | | | | | | | | particles of |
|---|---|---|---|---|---|---|---|---|---|---|
| | toner | polyester (A) | polyester (B) | CB | wax | charge control agent | ΔTm (° C.) | D4 (μm) | D4/Dn | no more than 5 μm |
| Pro. Ex. B-1 | toner B-1 | resin H1 (50) | resin L1 (42) | CB (6) | carnauba wax (5) | E-84 (1) | 37.5 | 6.8 | 1.78 | 64.8 |
| Pro. Ex. B-2 | toner B-2 | resin H2 (50) | resin L5 (42) | CB (6) | carnauba wax (5) | E-84 (1) | 59.1 | 6.8 | 1.71 | 62.3 |
| Pro. Ex. B-3 | toner B-3 | resin H6 (50) | resin L2 (42) | CB (6) | carnauba wax (5) | E-84 (1) | 16.2 | 6.8 | 1.88 | 67.2 |
| Pro. Ex. B-4 | toner B-4 | resin H2 (50) | resin L2 (42) | CB (6) | carnauba wax (5) | E-84 (1) | 40.0 | 6.7 | 1.83 | 68.4 |
| Pro. Ex. B-5 | toner B-5 | resin H3 (50) | resin L3 (42) | CB (6) | carnauba wax (5) | E-84 (1) | 42.6 | 6.8 | 1.74 | 65.0 |
| Pro. Ex. B-6 | toner B-6 | resin H4 (50) | resin L4 (42) | CB (6) | carnauba wax (5) | E-84 (1) | 45.8 | 6.6 | 1.65 | 60.7 |
| Pro. Ex. B-7 | toner B-7 | resin H6 (50) | resin L6 (42) | CB (6) | carnauba wax (5) | E-84 (1) | 41.0 | 6.6 | 1.76 | 64.2 |
| Pro. Ex. B-8 | toner B-8 | resin H5 (50) | resin L1 (42) | CB (6) | carnauba wax (5) | E-84 (1) | 33.7 | 6.8 | 1.78 | 64.7 |
| Pro. Ex. B-9 | toner B-9 | resin H7 (50) | resin L7 (42) | CB (6) | carnauba wax (5) | E-84 (1) | 36.2 | 6.8 | 1.81 | 65.7 |

Pro. Ex.: Production Example,
CB: carbon black
particles of no more than 5 μm: content of particles with diameter of no more than 5 μm (% by number)
number in ( ): parts by mass

Production Example B-10

Preparation of Carrier A

A carrier A used for two-component developer was prepared as follows. Five parts (by solid content) of tetrabutoxymethylated benzoguanamine solution in a mixed solvent of toluene and butanol (solid content: 70% by mass), 5 parts (by solid content) of an acrylic resin solution (solid content: 50% by mass), and 15 parts (by solid content) of a methylphenyl silicone resin solution (solid content: 23% by mass) as a methyl silicone resin having a silanol group were mixed to prepare a solution at room temperature. Five parts of carbon black (Black Perls 2000, by Cabot Co.) was added to the solution, and the dispersion was diluted by adding 80 parts of toluene, then was stirred and dispersed by a homogenizer, followed by adding 10 parts of aminosilane SH6020 (by Toray Dow Corning Silicone Co.) and dispersing for 10 minutes, thereby to prepare a coating liquid.

The coating liquid was poured into a coating device where 5,000 parts of a core material (Mn ferrite particles, mass average particle diameter: 35 μm) was coated with the coating liquid while forming a swirl flow by action of a rotatable bottom disc and stirring blades within a fluidized bed. The resulting coated material was heated at 250° C. for 2 hours in an electric furnace to prepare a carrier A.

Production Example B-11

Preparation of Carrier B

A carrier B used for two-component developer was prepared as follows. Five parts (by solid content) of tetrabutoxymethylated benzoguanamine solution in a mixed solvent of toluene and butanol (solid content: 70% by mass), 5 parts (by solid content) of an acrylic resin solution (solid content: 50% by mass), and 15 parts (by solid content) of a methyl silicone resin solution (solid content: 23% by mass) as a methyl silicone resin having a silanol group were mixed to prepare a solution at room temperature. Five parts of carbon black (Black Perls 2000, by Cabot Co.) was added to the solution, and the dispersion was diluted by adding 80 parts of toluene, then was stirred and dispersed by a homogenizer, followed by adding 10 parts of aminosilane SH6020 (by Toray Dow Corning Silicone Co.) and dispersing for 10 minutes, thereby to prepare a coating liquid.

The coating liquid was poured into a coating device where 5,000 parts of a core material (Mn ferrite particles, mass average particle diameter: 35 μm) was coated with the coating liquid while forming a swirl flow by action of a rotatable bottom disc and stirring blades within a fluidized bed. The resulting coated material was heated at 250° C. for 2 hours in an electric furnace to prepare a carrier B.

Production Example B-12

Preparation of Carrier C

A carrier C used for two-component developer was prepared as follows. Two parts (by solid content) of tetrabutoxymethylated benzoguanamine solution in a mixed solvent of toluene and butanol (solid content: 70% by mass), 2 parts (by solid content) of an acrylic resin solution (solid content: 50% by mass), and 21 parts (by solid content) of a silicone resin solution (solid content: 23% by mass) as a methyl silicone resin having a silanol group were mixed to prepare a solution at room temperature. Five parts of carbon black (Black Perls 2000, by Cabot Co.) was added to the solution, and the dispersion was diluted by adding 80 parts of toluene, then was stirred and dispersed by a homogenizer, followed by adding 10 parts of aminosilane SH6020 (by Toray Dow Corning Silicone Co.) and dispersing for 10 minutes, thereby to prepare a coating liquid.

The coating liquid was poured into a coating device where 5,000 parts of a core material (Mn ferrite particles, mass average particle diameter: 35 μm) was coated with the coating liquid while forming a swirl flow by action of a rotatable bottom disc and stirring blades within a fluidized bed. The resulting coated material was heated at 250° C. for 2 hours in an electric furnace to prepare a carrier C.

Production Example B-13

Preparation of Carrier D

A carrier D used for two-component developer was prepared as follows. Five parts (by solid content) of tetrabutoxymethylated benzoguanamine solution in a mixed solvent of toluene and butanol (solid content: 70% by mass), 5 parts (by solid content) of an acrylic resin solution (solid content: 50% by mass), and 15 parts (by solid content) of a silicone resin solution (solid content: 23% by mass) as a methyl silicone resin having a silanol group were mixed to prepare a solution at room temperature. Five parts of carbon black (Black Perls 2000, by Cabot Co.) and 7.6 parts of alumina particles (0.3 μm, resistivity: $10^{14}$ ohm·cm) were added to the solution, and the dispersion was diluted by adding 80 parts of toluene, then was stirred and dispersed by a homogenizer, followed by adding 10 parts of aminosilane SH6020 (by Toray Dow Corning Silicone Co.) and dispersing for 10 minutes, thereby to prepare a coating liquid.

The coating liquid was poured into a coating device where 5,000 parts of a core material (Mn ferrite particles, mass average particle diameter: 35 μm) was coated with the coating liquid while forming a swirl flow by action of a rotatable bottom disc and stirring blades within a fluidized bed. The resulting coated material was heated at 250° C. for 2 hours in an electric furnace to prepare a carrier D.

Production Example B-14

Preparation of Carrier E

A carrier E used for two-component developer was prepared as follows. Five parts of carbon black (Black Perls 2000, by Cabot Co.) was added to 25 parts (by solid content) of a silicone resin solution SR2410 (solid content: 23%, by Toray Industries, Inc.), and the dispersion was diluted by adding 80 parts of toluene, then was stirred and dispersed by a homogenizer, followed by adding 10 parts of aminosilane SH6020 (by Toray Dow Corning Silicone Co.) and dispersing for 10 minutes, thereby to prepare a coating liquid.

The coating liquid was poured into a coating device where 5,000 parts of a core material (Mn ferrite particles, mass average particle diameter: 35 μm) was coated with the coating liquid while forming a swirl flow by action of a rotatable bottom disc and stirring blades within a fluidized bed. The resulting coated material was heated at 250° C. for 2 hours in an electric furnace to prepare a carrier E.

Examples B-1 to B-9 and Comparative Examples B-1 to B-5

Image Formation and Evaluation

Two-component developers of Examples B-1 to B-9 and Comparative Examples B-1 to B-5 were prepared in accordance with the procedures described below, and the resulting two-component developers were installed into an image forming apparatus shown in FIG. 21 and images were formed to evaluate various properties as follows. The results are shown in Tables 13 and 14.

Preparation of Two-Component Developer

Combining the carriers and the toners as shown in Table 13, 7 parts of each toner was mixed uniformly with 100 parts of each carrier for 3 minutes at 48 rpm by use of a turbula mixer (by Willy A. Bachofen AG), which mixing by action of tumbling its vessel, thereby to charge electrically. In Examples B-1 to B-9 and Comparative Examples B-1 to B-5, 200 g of each carrier and 14 g of each toner were mixed within a 500 ml vial.

The image forming apparatus shown in FIG. 21 is a tandem image forming apparatus of indirect transfer type that employs non-contact charging, two-component developing, secondary transfer, blade cleaning, and external-heating roller fixing.

The image forming apparatus shown in FIG. 21 is equipped with corona chargers of non-contact type as charging units 311 as shown in FIG. 3. Developing units 324 are a two-component developing unit as shown in FIG. 6. The cleaning units 330 have a cleaning blade as shown in FIG. 10. The fixing unit 327 is a roller-type fixing device of electromagnetic induction heating as shown in FIG. 12.

The image forming element 351 of image forming apparatus shown in FIG. 21 is equipped with charging unit 311, exposing unit 323, developing unit 324, primary transfer unit 325, and cleaning unit 330 around photoconductor drum 321. The photoconductor drum 321 of the image forming element 341 bears a latent electrostatic image while rotating by action of charging unit 310 and exposing unit 323. The latent electrostatic image is developed using a yellow toner by the developing unit 324, and a visible image of the yellow toner is formed on the photoconductor drum 321. The visible image is transferred onto an intermediate transfer belt 355 by the primary transfer unit 325, then the residual yellow toner on the photoconductor drum 321 is removed by the cleaning unit 330. Similarly, visible images of magenta, cyan, and black toners are formed onto the recording medium by the image forming elements 352, 353, and 354, then a color image formed on the intermediate transfer belt 355 is fixed onto a recording medium 326 by a transfer device 356, then the residual toner on the intermediate transfer belt 355 is removed by an intermediate transfer belt cleaning unit 358. The color image formed on the recording medium 326 is fixed by the fixing unit 327.

Low-Temperature Fixability

Using the image forming apparatus as shown in FIG. 21, a solid image was formed in a toner deposition amount of 0.85±0.1 mg/cm$^2$ on a thick transfer paper (copy paper <135>, by NBS Ricoh Co.), and the image was fixed while changing the temperature of the fixing belt. The surface of the fixed image was drawn at a load of 50 g by a ruby needle (tip radius: 260 to 320 μm, tip angle: 60°) using a drawing tester AD-401 (by Ueshima Seisakusyo Co., Ltd.); then the drawn surface was intensely rubbed 5 times using a cloth (Hanicot #440, by Hanilon Co.). The lower-limit fixing temperature (LFT) was defined as the fixing-belt temperature at which substantially no image being removed, and the low-temperature fixability was evaluated in accordance with the following criteria. The solid image was formed on the transfer paper at the site of 3.0 cm from the paper end in the paper-feed direction.

Evaluation Criteria

A: LFT (lower-limit fixing temperature)≦125° C.
B: 125° C.<LFT≦135° C.
C: 135° C.<LFT≦145° C.
D: 145° C.<LFT≦155° C.
E: 155° C.<LFT Hot Offset Resistance Using the image forming apparatus as shown in FIG. 21, a solid image was formed in a toner deposition amount of 0.85±0.1 mg/cm$^2$ on a regular transfer paper (type 6200, by Ricoh Co.), and the image was fixed while changing the temperature of the fixing belt. The existence of hot offset was visually evaluated. The upper-limit temperature, at which substantially no offset occurred, was defined as the upper-limit fixing temperature (UFT), and the offset was evaluated in accordance with the following criteria. The solid image was formed on the transfer paper at the site of 3.0 cm from the paper end in the paper-feed direction.

Evaluation Criteria

A: 230° C.≦UFT (upper-limit fixing temperature)
B: 210° C.≦UFT<230° C.
C: 190° C.≦UFT<210° C.
D: 180° C.≦UFT<190° C.
E: UFT<180° C.

Initial Image

An image evaluation chart was output in a full-color mode by the image forming apparatus as shown in FIG. 21, and initial image quality was evaluated in terms of color tone (color shade) change, background smear, image density, and existence of thin spots. Existence of problems and rank of image quality were evaluated from visual inspection and ranked into 5 steps in accordance with the following criteria.

Evaluation Criteria

A: no image problems, excellent

B: color tone, image density, and/or background smear being slightly observable compared to original image, but no problem and good in actual use C: some difference in color tone (color shade), image density, and background smear D: apparent color tone change, density change, and/or background smear E: remarkable color tone change, density change, and/or background smear, far from normal image Stability with Time After running printing 50,000 sheets of an image chart with 80% image area in full color mode (20% image area per color) using the image forming apparatus as shown in FIG. 21, the image quality is evaluated in the same manner as the initial image quality described above in comparison with the initial image according to the following criteria.

Evaluation Criteria

A: no problem, excellent

B: problems being slightly observed in tone, image density, and background smear, when compared with original image, but substantially no problem under usual temperatures and humidities C: some difference in color tone (color shade), image density, and background smear in comparison with original image D: apparent color tone change, density change, and/or background smear in comparison with original image E: remarkable color tone change, density change, and/or background smear, far from normal image in comparison with original image Background Smear (1)

After running printing 100 sheets and 10,000 sheets of an image chart with 5% image area in mono-color mode under a condition of 10° C. and 15% RH, using the image forming apparatus as shown in FIG. 21, a thin line image of 600 dpi was output on type 6000 paper (by Ricoh Co.), then image density (ID) at non-image area was measured by a color meter (X-Rite 938, by X-Rite Co.) and evaluated in accordance with the following criteria.

Evaluation Criteria

A: ID (image density)<0.003
B: 0.003≦ID<0.010
C: 0.010≦ID<0.015
D: 0.015≦ID<0.030
E: 0.030≦ID Background Smear (2)

After running printing 100 sheets and 10,000 sheets of an image chart with 5% image area in mono-color mode under a condition of 35° C. and 50% RH, using the image forming apparatus as shown in FIG. 21, a thin line image of 600 dpi was output on type 6000 paper (by Ricoh Co.), then image density (ID) at non-image area was measured by a color meter (X-Rite 938, by X-Rite Co.) and evaluated in accordance with the following criteria.

Evaluation Criteria

A: ID (image density)<0.003
B: 0.003≦ID<0.010
C: 0.010≦ID<0.015
D: 0.015≦ID<0.030
E: 0.030≦ID Carrier Smear Carrier smear (also referred to as "carrier spent") is an index of carrier smear as one of toner properties; and the higher is the mechanical strength of toner, the less is the carrier smear. The specific evaluation process was such that after running printing 100 sheets and 30,000 sheets of an image chart with 50% image area in mono-color mode, using the image forming apparatus as shown in FIG. 21, the developer was sampled; a proper amount of the sample developer was placed into a cage of a mesh with an opening of 32 μm and air-blown to separate toner and carrier; 1.0 g of the carrier was inserted into a 50 ml glass bottle, to which 10 ml of chloroform was added, then the mixture was shaken by hand 50 times, followed by allowing to stand 10 minutes; thereafter, the supernatant chloroform solution was added into a glass cell, the transmittance (Tm) of the chloroform solution was measured by a turbidity meter; and the carrier smear was evaluated in accordance with the following criteria.

Evaluation Criteria

A: 95%≦Tm (transmittance)

B: 90%≦Tm<95%

C: 80%≦Tm<90%

D: 70%≦Tm<80%

E: Tm<70%

Smear of Developing Sleeve

After running printing 100 sheets and 50,000 sheets of an image chart with 50% image area in mono-color mode, using the image forming apparatus as shown in FIG. 21, the smear of the developing sleeve was evaluated to rank in the following 5 steps based on visual inspection whether the toner had deposited firmly on the developing sleeve in the developing unit while considering also occurrence of abnormal output images.

Evaluation Criteria

A: no abnormal image, no firm-toner deposition on sleeve

B: no abnormal image, but slight firm-toner deposition on sleeve

C: some abnormal image, evident firm-toner deposition on sleeve

D: evident abnormal image, sever firm-toner deposition on sleeve, problematic level E: evident abnormal image, sever firm-toner deposition on sleeve, impossible to form normal image Filming on Photoconductor After running printing 100 sheets and 50,000 sheets of an image chart with 50% image area in mono-color mode, using the image forming apparatus as shown in FIG. 21, filming on the photoconductor was evaluated to rank in the following 5 steps based on visual inspection as to filming condition on the photoconductor while considering also occurrence of abnormal output images.

Evaluation Criteria

A: no abnormal image, no toner filming on photoconductor

B: no abnormal image, but slight toner filming on photoconductor

C: some abnormal image, evident toner filming on photoconductor

D: evident abnormal image, sever toner filming on photoconductor, problematic level E: evident abnormal image, sever toner filming on photoconductor, impossible to form normal image

TABLE 13

| | toner | carrier | LTF | hot offset resistance | initial image | stability with time |
|---|---|---|---|---|---|---|
| Ex. B-1 | toner B1 | A | A | A | A | A |
| Ex. B-2 | toner B2 | A | A | B | A | B |
| Ex. B-3 | toner B3 | A | B | C | A | B |
| Ex. B-4 | toner B4 | A | B | A | A | A |
| Ex. B-5 | toner B5 | A | B | B | A | A |
| Ex. B-6 | toner B6 | A | B | B | A | B |
| Ex. B-7 | toner B6 | B | B | B | A | B |
| Ex. B-8 | toner B6 | C | B | B | B | B |
| Ex. B-9 | toner B6 | D | B | B | A | B |
| Com. Ex. B-1 | toner B7 | A | E | E | D | E |
| Com. Ex. B-2 | toner B8 | A | D | E | C | D |
| Com. Ex. B-3 | toner B9 | A | D | C | C | D |
| Com. Ex. B-4 | toner B6 | E | B | B | B | B |
| Com. Ex. B-5 | toner B7 | E | E | E | D | E |

LTF: low temperature fixability

TABLE 14

| | background smear | | smear of carrier | | smear of developing sleeve | | filming on photoconductor | |
|---|---|---|---|---|---|---|---|---|
| | 1 | 2 | after 100 sheets | after 30000 sheets | after 100 sheets | after 50000 sheets | after 100 sheets | after 50000 sheets |
| Ex. B-1 | A | C | A | B | A | B | A | A |
| Ex. B-2 | A | C | A | B | A | B | A | B |
| Ex. B-3 | A | C | A | B | A | B | A | B |
| Ex. B-4 | A | C | A | B | A | B | A | A |
| Ex. B-5 | A | C | A | B | A | B | A | B |
| Ex. B-6 | A | C | A | B | A | B | A | B |
| Ex. B-7 | A | B | A | A | A | B | A | B |
| Ex. B-8 | B | C | A | B | A | B | A | B |
| Ex. B-9 | A | A | A | A | A | B | A | B |
| Com. Ex. B-1 | D | D | B | E | A | E | A | E |
| Com. Ex. B-2 | C | E | A | E | A | E | A | E |
| Com. Ex. B-3 | C | E | A | E | A | E | A | E |
| Com. Ex. B-4 | B | D | A | B | A | B | A | B |
| Com. Ex. B-5 | D | E | C | E | A | E | A | E |

The toners according to the present invention may be far from smear or pollution on members in developing units or on carriers, may be excellent in terms of durability, low temperature fixability, hot-offset resistance, storage stability, and milling ability, and may provide high quality images for a long period, even while using a toner recycle system, therefore, are appropriately used for electrophotographic image forming apparatuses, image forming methods, developers, toner-containing containers, and process cartridges.

The image forming apparatuses, image forming methods, and process cartridges according to the present invention employ the toners according to the present invention, therefore, may form very high quality images that are free from tone change, density reduction, and abnormal images such as background smear, consequently, may be widely applied for laser printers, direct digital platemakers, full color copiers on the basis of direct or indirect electrophotographic multi-color image developing processes, full color laser printers, regular paper facsimiles of full color systems, and the like.

The developers, in the second aspect of the present invention, may be far from smear or pollution on members in developing units or on carriers, may be excellent in terms of durability, low temperature fixability, hot-offset resistance, and storage stability, and may provide very high quality images that are free from density reduction and abnormal images such as background smear even under variable temperature and humidity, therefore, are appropriately used for electrophotographic image forming apparatuses, image forming methods, developers, toner-containing containers, and process cartridges.

The image forming apparatuses, image forming methods, developer-containing containers, and process cartridges according to the present invention employ the toners according to the present invention, therefore, may form very high quality images that are free from tone change, density reduction, and abnormal images such as background smear, consequently, may be widely applied for laser printers, direct digital platemakers, full color copiers on the basis of direct or indirect electrophotographic multi-color image developing processes, full color laser printers, regular paper facsimiles of full color systems, and the like.

What is claimed is:

1. A toner, comprising a binder resin, a releasing agent, and a colorant, wherein the mass average particle diameter of the toner is 3 μm to 8 μm, the content of particles having a particle diameter of no more than 5 μm is from 60% by number to 90% by number, the binder resin comprises a polyester resin (A) having a softening temperature Tm(A) from no lower than 120° C. to no higher than 160° C. and a polyester resin (B) having a softening temperature Tm(B) from no lower than 80° C. to lower than 120° C., and at least one of the polyester resins (A) and (B) is prepared by condensation polymerization between an alcohol component and a carboxylic acid component, and the alcohol component comprises divalent alcohol of 1,2-propanediol in a content of no less than 65% by mole and consists substantially of aliphatic alcohol.

2. The toner according to claim 1, wherein the ratio $D_4$/Dn is 1.65 to 2.00 ($D_4$: mass average particle diameter of toner, Dn: number average particle diameter of toner).

3. The toner according to claim 1, wherein a maximum endothermic peak appears in a range of 60° C. to 120° C. when the releasing agent is measured by DSC.

4. The toner according to claim 1, wherein the releasing agent comprises carnauba wax.

5. The toner according to claim 1, wherein the content of the aliphatic alcohol in the alcohol component is no less than 90% by mole.

6. The toner according to claim 1, wherein at least one of alcohol components of the polyester resins (A) and (B) further comprises glycerin.

7. The toner according to claim 1, wherein the alcohol component of the polyester resin (A) further comprises 1,3-propanediol.

8. The toner according to claim 1, wherein at least one of carboxylic acid components of the polyester resins (A) and (B) comprises an aliphatic dicarboxylic acid of 2 to 4 carbon atoms.

9. The toner according to claim 1, wherein at least one of carboxylic acid components of the polyester resins (A) and (B) comprises a purified rosin.

10. The toner according to claim 1, wherein the mass ratio (A)/(B) of the polyester resin (A) and the polyester resin (B) is 1/9 to 9/1.

11. The toner according to claim 1, wherein the difference [Tm(A)−Tm(B)] between Tm(A) and Tm(B) is no less than 10° C.

12. A developer, comprising a toner and a carrier, wherein the toner comprises a binder resin, a releasing agent, and a colorant, the carrier comprises a core material and a coating layer on the surface of the core material, the binder resin comprises a polyester resin (A) having a softening temperature Tm(A) from no lower than 120° C. to no higher than 160° C. and a polyester resin (B) having a softening temperature Tm(B) from no lower than 80° C. to lower than 120° C., at least one of the polyester resins (A) and (B) is prepared by condensation polymerization between an alcohol component and a carboxylic acid component, and the alcohol component comprises divalent alcohol of 1,2-propanediol in a content of no less than 65% by mole and consists substantially of aliphatic alcohol, the coating layer comprises a condensation product between an N-alkoxyalkylated benzoguanamine resin and a resin capable of reacting with the N-alkoxyalkylated benzoguanamine resin, and the resin capable of reacting with the N-alkoxyalkylated benzoguanamine resin is a silicone resin that has at least one of a silanol group and a hydrolyzable group.

13. The developer according to claim 12, wherein the resin capable of reacting with the N-alkoxyalkylated benzoguanamine resin comprises a methyl silicone resin that has a silanol group.

14. The developer according to claim 12, wherein the coating layer comprises fine particles of an inorganic oxide.

15. The developer according to claim 12, wherein the releasing agent comprises carnauba wax.

16. The developer according to claim 12, wherein the content of the aliphatic alcohol in the alcohol component is no less than 90% by mole.

17. The developer according to claim 12, wherein at least one of alcohol components of the polyester resins (A) and (B) further comprises glycerin.

18. The developer according to claim 12, wherein the alcohol component of the polyester resin (A) further comprises 1,3-propanediol.

19. The developer according to claim 12, wherein at least one of carboxylic acid components of the polyester resins (A) and (B) comprises an aliphatic dicarboxylic acid of 2 to 4 carbon atoms.

20. The developer according to claim 12, wherein at least one of carboxylic acid components of the polyester resins (A) and (B) comprises a purified rosin.

21. The developer according to of claim 12, wherein the mass ratio (A)/(B) of the polyester resin (A) and the polyester resin (B) is 1/9 to 9/1.

22. The developer according to claims 12, wherein the difference [Tm(A)−Tm(B)] between Tm(A) and Tm(B) is no less than 10° C.

* * * * *